US011447942B2

(12) United States Patent
Koga et al.

(10) Patent No.: US 11,447,942 B2
(45) Date of Patent: Sep. 20, 2022

(54) TOILET SEAT DEVICE AND TOILET DEVICE

(71) Applicant: LIXIL Corporation, Tokyo (JP)

(72) Inventors: Kazuki Koga, Tokyo (JP); Hiroaki Watanabe, Tokyo (JP); Tomoya Sasaki, Tokyo (JP); Tsunaki Itou, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 17/043,647

(22) PCT Filed: Mar. 15, 2019

(86) PCT No.: PCT/JP2019/010795
§ 371 (c)(1),
(2) Date: Sep. 29, 2020

(87) PCT Pub. No.: WO2019/188402
PCT Pub. Date: Oct. 3, 2019

(65) Prior Publication Data

US 2021/0017752 A1 Jan. 21, 2021

(30) Foreign Application Priority Data

Mar. 30, 2018 (JP) ..... JP2018-068533
Mar. 30, 2018 (JP) ..... JP2018-068534
Mar. 30, 2018 (JP) ..... JP2018-068536

(51) Int. Cl.
*E03D 9/08* (2006.01)
*A47K 10/48* (2006.01)
(Continued)

(52) U.S. Cl.
CPC ..... *E03D 9/08* (2013.01); *A47K 10/48* (2013.01); *A47K 13/307* (2013.01); *E03D 9/05* (2013.01); *E03D 2201/00* (2013.01)

(58) Field of Classification Search
CPC ..... E03D 9/08; A47K 13/307; A47K 10/48
See application file for complete search history.

(56) References Cited

U.S. PATENT DOCUMENTS 5,706,525 A * 1/1998 Olivier ..... E03D 9/08 4/420.4
7,216,374 B2 * 5/2007 Hassan ..... A47K 13/30 4/217
(Continued)

FOREIGN PATENT DOCUMENTS

JP S62-41831 A 2/1987
JP H6-2354 A 1/1994
(Continued)

*Primary Examiner* — Janie M Loeppke
(74) *Attorney, Agent, or Firm* — Morrison & Foerster LLP

(57) ABSTRACT

A toilet seat device includes a toilet seat, a casing provided in rear of the toilet seat, and a functional component that ejects liquid or that blows out or suctions gas. The functional component is a private part cleaning device that cleans a private part of a sitting person, a blower device that provides warm air into a toilet bowl, or a deodorizing device that deodorizes an inner portion of the toilet bowl, for example. At least part of the functional component is provided in the toilet seat, and the other part of the functional component is provided in the casing.

20 Claims, 36 Drawing Sheets

(51) Int. Cl.
*A47K 13/30* (2006.01)
*E03D 9/05* (2006.01)

(56) References Cited

U.S. PATENT DOCUMENTS

| | | | | |
|---|---|---|---|---|
| 10,982,422 | B2 * | 4/2021 | Schwab | B05B 7/32 |
| 2002/0002735 | A1 | 1/2002 | Moon | |
| 2005/0166310 | A1 * | 8/2005 | Furukawa | A47K 13/10 4/420.4 |
| 2008/0060119 | A1 * | 3/2008 | Pinizzotto | E03D 9/005 4/217 |

FOREIGN PATENT DOCUMENTS

| | | | |
|---|---|---|---|
| JP | H9-203103 | A | 8/1997 |
| JP | 2000-192526 | A | 7/2000 |
| JP | 2002-47715 | A | 2/2002 |
| JP | 2003-34967 | A | 2/2003 |
| JP | 2005-213877 | A | 8/2005 |
| JP | 2007-270564 | A | 10/2007 |
| JP | 2009-281513 | A | 12/2009 |
| JP | 2018-35656 | A | 3/2018 |

* cited by examiner

TOILET SEAT DEVICE AND TOILET DEVICE

CROSS-REFERENCE TO RELATED APPLICATIONS

This application is a national stage application under 35 USC 371 of International Application No. PCT/JP2019/010795, filed Mar. 15, 2019, which claims the priority of Japanese Application No. 2018-068533, filed Mar. 30, 2018, Japanese Application No. 2018-068534, filed Mar. 30, 2018, and Japanese Application No. 2018-068536, filed Mar. 30, 2018, the entire contents of each of which are incorporated herein by reference.

FIELD OF THE DISCLOSURE

The present disclosure relates to a toilet seat device and a toilet device.

BACKGROUND OF THE DISCLOSURE

Many toilet seats provided in toilet devices are each mounted on a rim part provided to surround an upper opening of a toilet bowl. The toilet seat is rotatably supported in a rear part of the toilet device, by means of a hinge part provided with a hinge shaft of which an axial direction is set to a left-and-right direction. During use of the toilet device, the toilet seat is manually or electrically rotated to be opened or closed.

For example, the toilet device described in Patent Literature 1 includes a toilet seat that accommodates a private part cleaning device used to clean the private part of the sitting person with warm water, and a low tank is installed immediately behind the toilet seat. The private part cleaning device includes a nozzle body, a warm water tank, and a control device. The nozzle body passes through an opening part provided on the toilet seat and stops at a predetermined position within the toilet, and warm water is ejected from an ejection hole formed at a tip of the nozzle body, so that the private part of the sitting person is cleaned.

Patent Literature 1: Japanese Unexamined Patent Application Publication No. 2005-213877

SUMMARY OF THE DISCLOSURE

In the toilet device described in Patent Literature 1, all the components of the private part cleaning device are provided in the toilet seat. Accordingly, the toilet seat becomes heavy, and the load torque at the time of manually or electrically rotating the toilet seat is increased. Further, a toilet device in these days is also provided with a deodorizing device for deodorizing the toilet bowl, a blower device for providing warm air, and the like, besides the private part cleaning device. Accordingly, if all such components are provided in the toilet seat, the toilet seat will be heavier, and the load torque will be further increased.

A heavier toilet seat requires increased strength or rigidity of the hinge part, which rotatably supports the toilet seat. Accordingly, besides the toilet seat, the hinge part will be also heavier. Also, if the load torque at the time of rotating the toilet seat is increased, the drive torque required to rotate the toilet seat against the load torque will also need to be increased. This requires a scaled-up drive system for electrically rotating the toilet seat.

The disclosure is provided in view of the above-described circumstances, and a purpose thereof is to provide a toilet seat device and a toilet device in which increase in weight of the toilet seat can be restrained.

Conventionally, a functional component, such as a private part cleaning device, has been sometimes built into the toilet seat, which is rotatably attached to the toilet body. When a functional component is thus built into the toilet seat, a shutter for opening or closing an opening-and-closing port formed on the toilet seat is generally attached to the toilet seat (see Patent Literature 1, for example).

As a result of study of the technology disclosed in Patent Literature 1, the inventors have recognized that there has been room for improvement in terms of obtaining favorable design properties in the case where a shutter is attached to the toilet seat.

One aspect of the disclosure has been made in view of such a problem, and a purpose thereof is to provide a technology for obtaining favorable design properties in the case where a shutter is attached to the toilet seat.

Conventionally, a toilet device sometimes includes a functional device into which a functional component, such as a private part cleaning device and a drying device, is built. For example, Patent Literature 1 discloses, as the functional device, a toilet seat into which a private part cleaning device as a functional component is built.

Meanwhile, to a base part of the functional device supporting a functional component, an impact load may be sometimes applied. This occurs when, in the example of Patent Literature 1, the toilet seat in which the base part is provided is opened or closed. When such an impact load is directly transmitted from the base part to a functional component, durability of the functional component may be negatively affected. With regard to such a problem, no measures are adopted in the technology disclosed in Patent Literature 1, and there has been room for further improvement.

One aspect of the disclosure has been made in view of such a problem, and a purpose thereof is to provide a technology for enabling protection of a functional component even when an impact load is applied to the base part.

To solve the problem above, a first aspect of the disclosure relates to a toilet seat device. The toilet seat device includes a toilet seat, a casing provided in rear of the toilet seat, and a functional component that ejects liquid or that blows out or suctions gas. At least part of the functional component is provided in the toilet seat, and the other part of the functional component is provided in the casing.

In this aspect, in the toilet seat device, increase in weight of the toilet seat can be restrained.

To solve the aforementioned problem, a first aspect of the disclosure relates to a toilet seat device. The toilet seat device includes a toilet seat that is rotatably attached to a toilet body and that has an opening-and-closing port formed on a reverse face, and a shutter attached to the toilet seat such as to enable opening and closing of the opening-and-closing port. When the toilet seat is placed at a laid position at which the toilet seat is laid over the toilet body and when the toilet seat is viewed from the front side, a large part of an entire range in a front-and-rear direction of the shutter, from a front end toward a rear end of the shutter, is located in rear of an inner circumferential surface of a center opening part of the toilet seat and at a position that overlaps the inner circumferential surface.

In this aspect, the shutter is less likely to appear in an external view when the toilet seat is placed at the laid position. Accordingly, neat appearance can be achieved, and favorable design properties can be obtained.

To solve the aforementioned problem, a first aspect of the disclosure relates to a functional device. The functional device is used for a toilet device, and the functional device includes a base part, a functional component disposed to be spaced away from the base part, and a supporting structure that allows the base part to support the functional component to be relatively movable. The supporting structure includes an impact absorption member provided to be deformable with a relative move of the base part with respect to the functional component.

In this aspect, when an impact load is applied to the base part, the base part relatively moves with respect to the functional component, so that the impact absorption member is deformed. As a result, the impact load transmitted from the base part to the functional component can be reduced by the impact absorption member, so that the functional component can be protected.

BRIEF DESCRIPTION OF THE FIGURES

Some embodiments will now be described, by way of example only, with reference to the accompanying drawings which are meant to be exemplary, in which.

DETAILED DESCRIPTION OF THE DISCLOSURE

Figure 1:
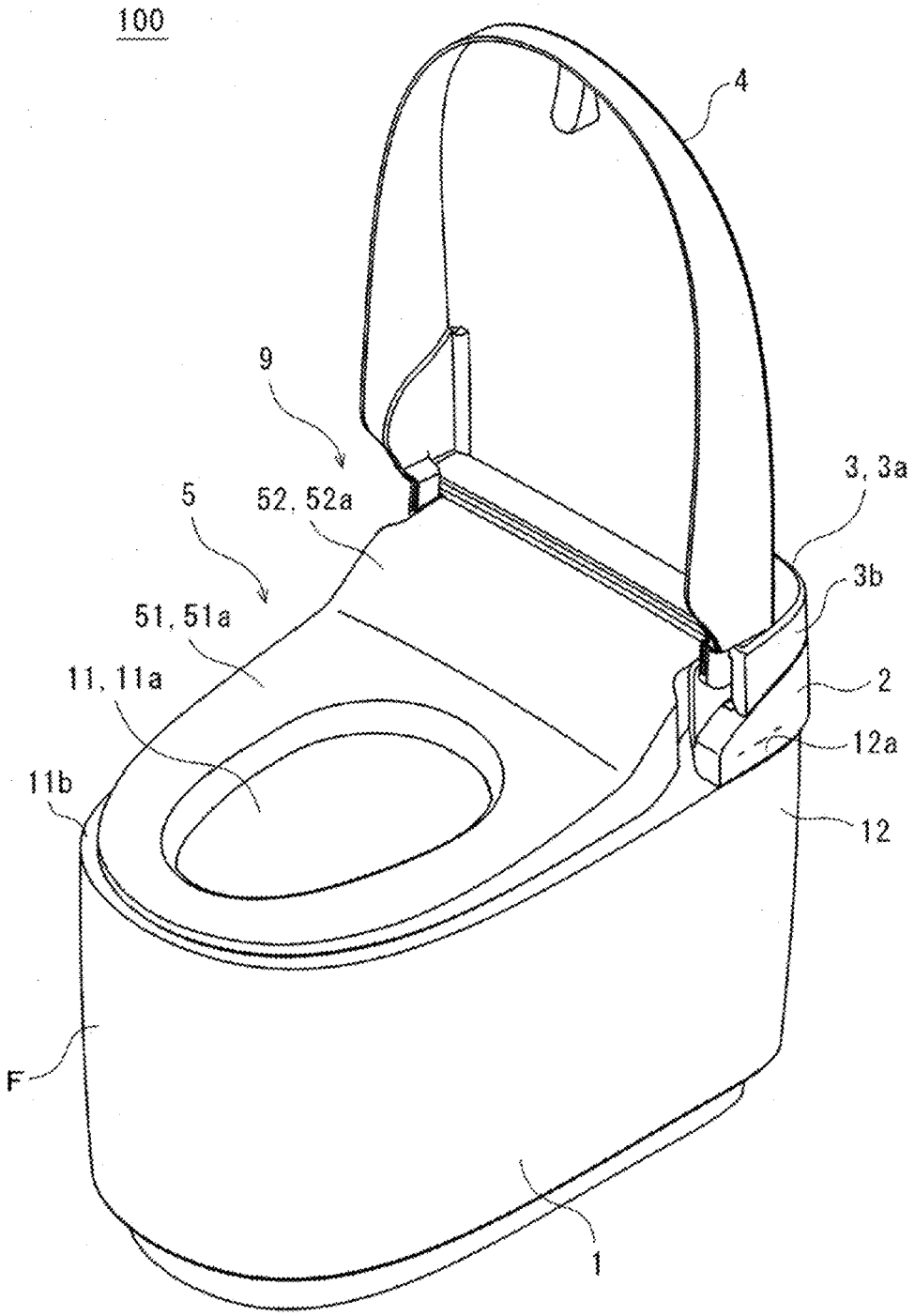
FIG. 1 is a perspective view that shows an external view of a toilet device including a toilet seat device according to some embodiments.

In the following embodiments and modifications, like reference characters denote like constituting elements, and the same description will be omitted. Also, in each drawing, part of the constituting elements may be appropriately omitted, or the size of a constituting element may be appropriately enlarged or reduced, for the sake of convenience.

Each of the following embodiments and modifications merely describes a specific example for carrying out the disclosure. The embodiments and modifications are not intended to limit the technical scopes of the disclosure, and various design modifications, including changes, addition, and deletion of constituting elements, may be made to the embodiments or modifications without departing from the scopes of ideas of the disclosure. In the following embodiments, matters to which design modifications may be made are emphasized with the expression of "embodiment", but design modifications may also be made to matters without such expression. Also, the hatching provided on the cross sections in the drawings is not provided to limit the materials of the objects with the hatching.

Figure 2:
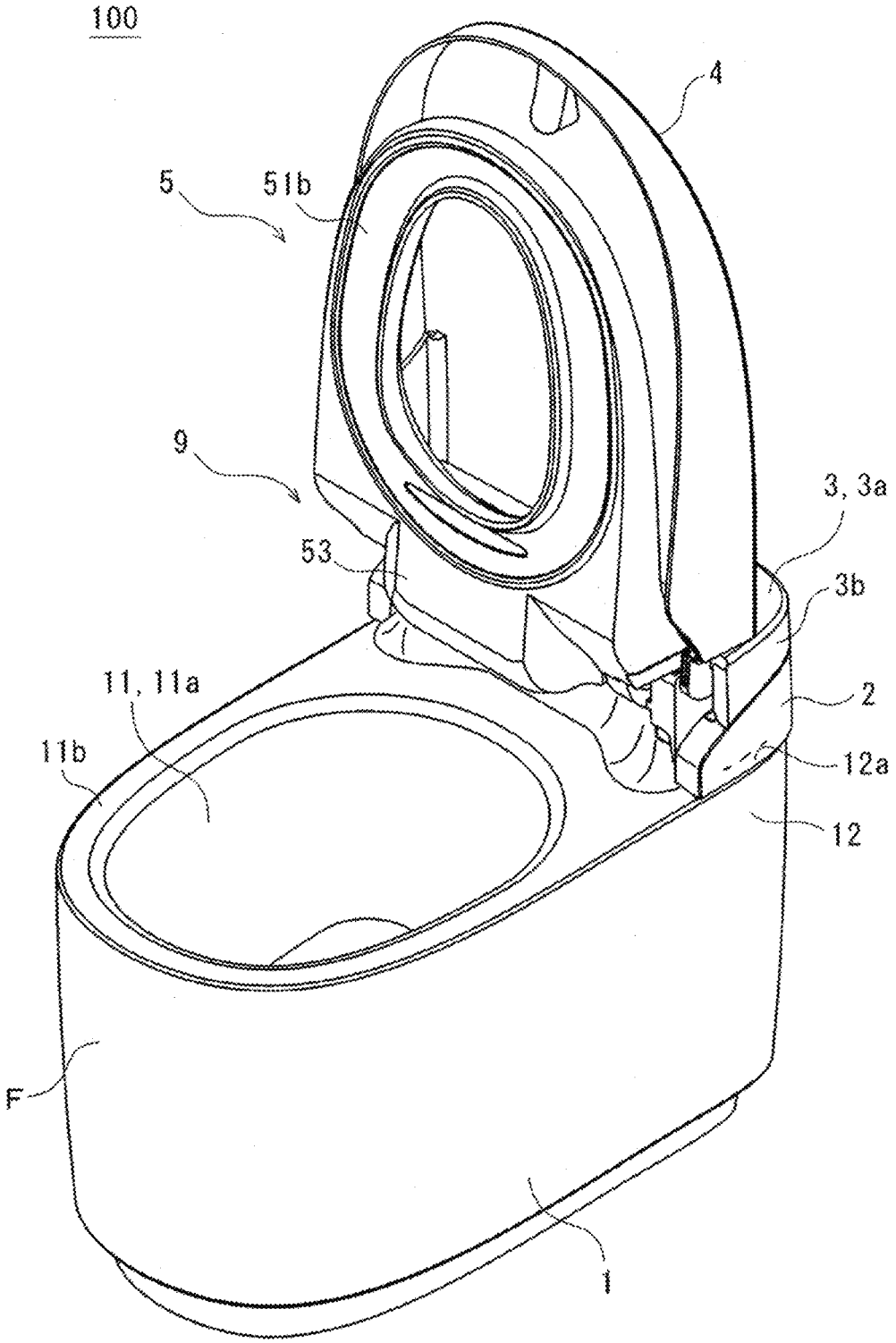
FIG. 2 is a perspective view that shows an external view of the toilet device in which a toilet lid and a toilet seat are placed in an open state according to some embodiments.

FIG. 1 is a perspective view that shows an external view of a toilet device 100 including a toilet seat device 9 of some embodiments, and FIG. 2 is a perspective view that shows an external view of the toilet device 100 in which a toilet lid 4 and a toilet seat 5 are placed in an open state. The toilet lid 4 shown in FIG. 1 is placed in the open state. The toilet device 100 includes a toilet body 1, a casing 2, a cover 3, the toilet lid 4, and the toilet seat 5, for example. The toilet seat device 9 is configured to include the casing 2 and the toilet seat 5, for example. The toilet body 1 includes a toilet bowl 11 on the front end F side, and a component placement part 12 in a rear part in rear of the toilet bowl 11. In the following description, a left-and-right direction of the toilet device 100 means a horizontal direction perpendicular to a front-and-rear direction of the toilet device 100, and the left and right are defined based on the toilet device 100 viewed from the front end F side.

The toilet bowl 11 includes a receiving surface 11*a* of a bowl-like shape for receiving waste, and a rim part 11*b* formed around an upper opening of the receiving surface 11*a*. On the rim part 11*b*, the toilet seat 5 is placed. Onto the receiving surface 11*a*, flush water is discharged from an upper left part on the rear side to the front side when viewed from the front end F, for example. The flush water discharged onto the receiving surface 11*a* swirls in one direction and flows down along the receiving surface 11*a* to flush the receiving surface 11*a*, and is discharged together with waste through a drainage path (omitted in the drawings) connected to the bottom of the receiving surface 11*a*.

The height of an upper end part 12*a* of the component placement part 12 is nearly identical with the height of the rim part 11*b* of the toilet bowl 11, and the casing 2 is mounted on the upper end part 12*a*. Part of a functional component is provided in the toilet seat 5, and the other part other than the part of the functional component, not illustrated, is accommodated in the casing 2, as will be described later. Functional components include a toilet flushing device, a flush water supply device, a private part cleaning device for cleaning the private part of the sitting person, a toilet seat heating device for warming the toilet seat 5, a blower device for providing warm air into the toilet bowl 11, a deodorizing device for absorbing and removing odors produced in the toilet bowl 11, a sterilizing water supply device for supplying sterilizing water into the toilet bowl 11, and a cleaning foam supply device, for example.

Figure 3:
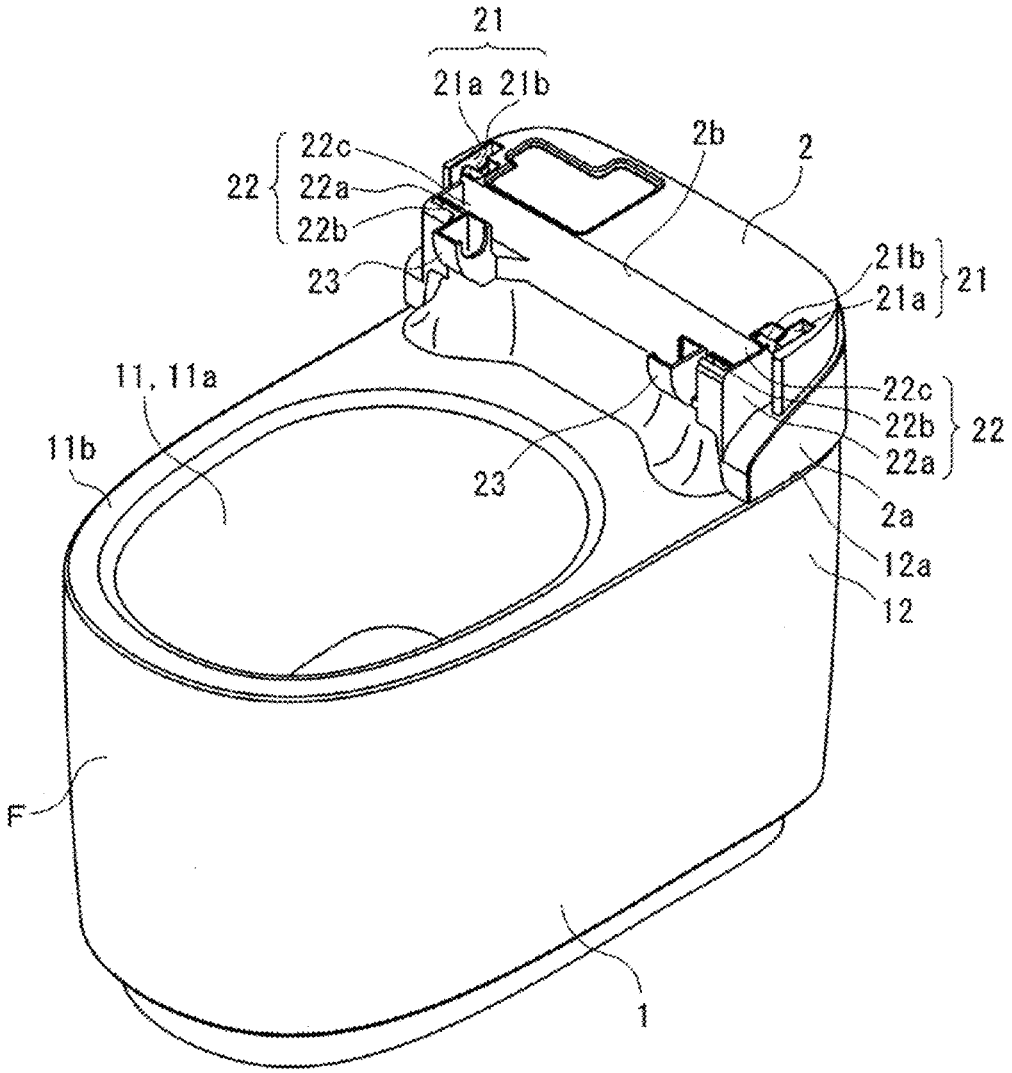
FIG. 3 is a perspective view that shows an external view of the toilet device in a state where a cover, the toilet lid, and the toilet seat have been detached according to some embodiments.

FIG. 3 is a perspective view that shows an external view of the toilet device 100 in a state where the cover 3, the toilet lid 4, and the toilet seat 5 have been detached. The casing 2 has a box-like or dish-like shape, for example, and is configured to accommodate the functional components as described above. The width of the casing 2 in the front-and-rear direction extends from a rear end part of the toilet body 1 to the vicinity of a rear edge part of the toilet bowl 11, and the width thereof in the left-and-right direction extends along the entire lateral width of the toilet body 1. The casing 2 is mounted, at a circumferential edge part 2*a*, on the upper end part 12*a* of the component placement part 12. On each of the left and right sides of a front part of the casing 2, a toilet lid hinge part 21 and a toilet seat hinge part 22 are provided.

Each toilet lid hinge part 21 includes a hinge shaft 21*b* within a recess 21*a* provided to hole an upper surface of the casing 2. The toilet lid hinge parts 21 are provided respectively in left and right side portions of the casing 2. The front part of each recess 21*a* is cut out to form a space in which an arm part (omitted in the drawings) of the toilet lid 4 rotates and moves. Each hinge shaft 21*b* is a cylindrical shaft body of which an axial direction is set to a left-and-right direction, and is provided such as to protrude into a recess 21*a*. The hinge shafts 21*b* in the left and right toilet lid hinge parts 21 are provided to be coaxial with each other. By fitting the hinge shafts 21*b* into shaft through holes provided in the arm parts of the toilet lid 4, the toilet lid 4 is attached to the casing 2.

Each toilet seat hinge part 22 includes a support part 22*a*, a hinge bearing 22*b*, and a recess 22*c*. The toilet seat hinge parts 22 are provided respectively in the left and right side portions of the casing 2 to be positioned forward of the toilet lid hinge parts 21. Each support part 22*a* is provided in a wall-like shape extending forward from a front end surface 2*b* of the casing 2, and the rear side and the lower side of the support part 22*a* are fixed to the casing 2. Each hinge bearing 22*b* has a cylindrical shape of which a central axis direction is set to a left-and-right direction, and is provided such as to extend inward in an upper end part of a front part of a support part 22*a*. An upper side of a circumferential side part of each hinge bearing 22*b* is cut out, and, when a cross section perpendicular to the central axis is viewed, the width of the opening part is smaller than the diameter of the hinge bearing 22*b*. The hinge bearings 22*b* in the left and right toilet seat hinge parts 22 are provided such that the central axes of the hinge bearings 22*b* are coaxial with each other.

Each recess 22*c* is formed between the front end surface 2*b* of the casing 2 and a hinge bearing 22*b* such as to hole the upper surface of the casing 2 downward. The outside in a left-and-right direction of each recess 22*c* is closed by a support part 22*a* of a wall-like shape, and the recesses 22*c* penetrates toward inside. As will be described later, the toilet seat 5 includes hinge shafts 55, an axial direction of each of which is set to a left-and-right direction, and, by fitting the hinge shafts 55 into the hinge bearings 22*b*, the toilet seat 5 is attached to the casing 2.

The casing 2 includes insertion parts 23 that communicate with an internal space of the casing 2, and the insertion parts 23 are provided on the inner side along a left-and-right direction with respect to the toilet seat hinge parts 22. The insertion parts 23 are provided at two positions on the left and right sides, and a flow pipe through which a fluid, such as water, flows may be provided in one insertion part 23, and an electrical signal line may be provided in the other insertion part 23, for example. Each insertion part 23 is provided such as to protrude forward from the front end surface 2*b* of the casing 2. The upper side of each insertion part 23 opens in a rectangular shape, and the inner side in a left-and-right direction thereof opens in a semicircular shape. Such opening portions face an internal space of the toilet seat 5. The internal space of the casing 2 communicates with the internal space of the toilet seat 5 via the insertion parts 23, without the intervention of external space. The flow pipe and the signal line provided in the insertion parts 23 are connected to part of the functional components provided in the toilet seat 5.

Referring back to FIG. 1, the cover 3 includes a top board 3*a* and a side board 3*b* that cover the upside and a side surface of an upper part of the casing 2. The cover 3 can be attached to and detached from the casing 2. The top board 3*a* has a rectangular shape in plan view, in which the corners on the rear side are rounded. The side board 3*b* is formed to the left and right parts of and in the rear part of the top board 3*a* such as to extend downward from the sides of the top board 3*a*.

A rear part of the toilet lid 4 and a rear part of the toilet seat 5 are supported respectively by the toilet lid hinge parts 21 and the toilet seat hinge parts 22 provided in the casing 2 as the toilet body 1 side, to be rotatable about the shafts along a left-and-right direction. When placed in the open state, each of the toilet lid 4 and the toilet seat 5 stops in an upright state on the front side of the casing 2. The toilet lid 4 includes a planar top board that covers the toilet seat 5 and the toilet bowl 11 of the toilet body 1, and a side board that covers the front and the left and right sides of the toilet seat 5.

Figure 4:
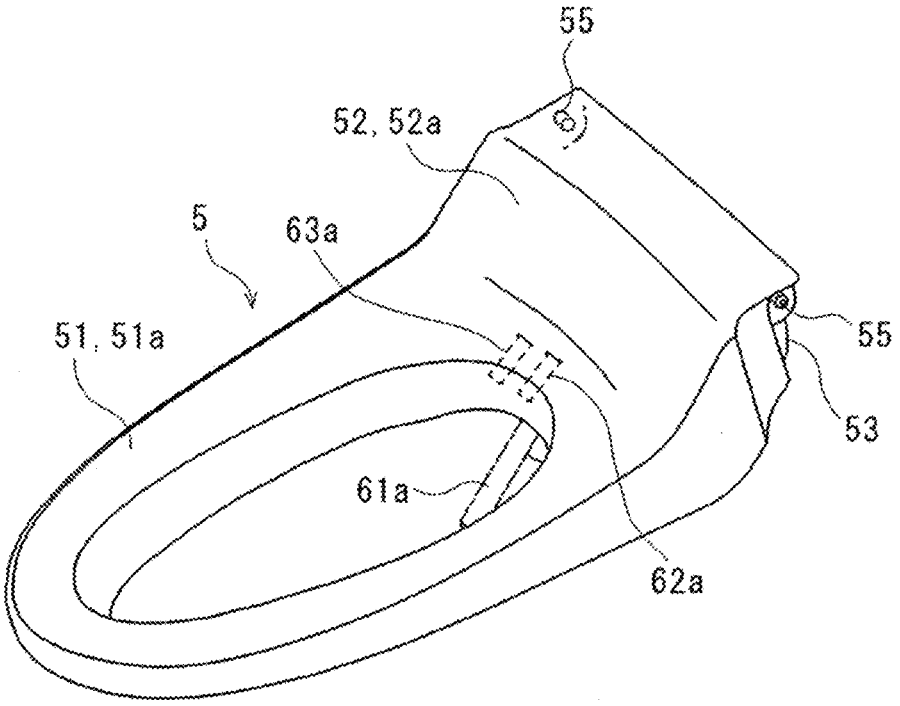
FIG. 4 is a perspective view that shows an external view of the toilet seat according to some embodiments.
Figure 5:
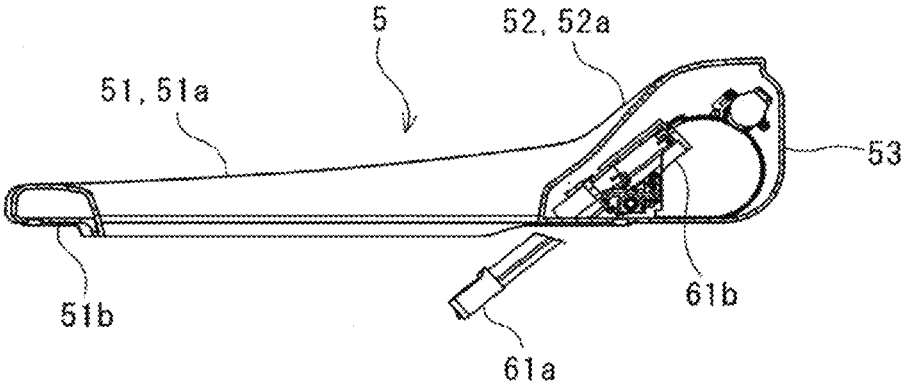
FIG. 5 is a longitudinal sectional view of the toilet seat according to some embodiments.

FIG. 4 is a perspective view that shows an external view of the toilet seat 5, and FIG. 5 is a longitudinal sectional view of the toilet seat 5. The toilet seat 5 includes a seat part 51 and a base end part 52. The toilet seat 5 also includes the hinge shafts 55, an axial direction of each of which is set to a left-and-right direction, provided respectively on the left and right sides of the base end part 52. By fitting the hinge shafts 55 into the hinge bearings 22*b*, the toilet seat 5 is rotatably supported by the toilet seat hinge parts 22. The seat part 51 has a hole corresponding to the upper opening of the receiving surface 11*a* in the toilet bowl 11, and is hence formed into a ring plate shape with hollow inside. A user sits on a seat surface part 51*a*, and a bottom surface 51*b* (see FIG. 2) faces and is in contact with the rim part 11*b*.

Atop face 52*a* of the base end part 52 is formed to be continuous with the seat surface part 51*a*. The base end part 52 includes an accommodation part 53 (see FIG. 2) in which a bulge is provided on the bottom surface 51*b* side in the center part in a left-and-right direction to form a space for accommodating the functional components.

Figure 6:
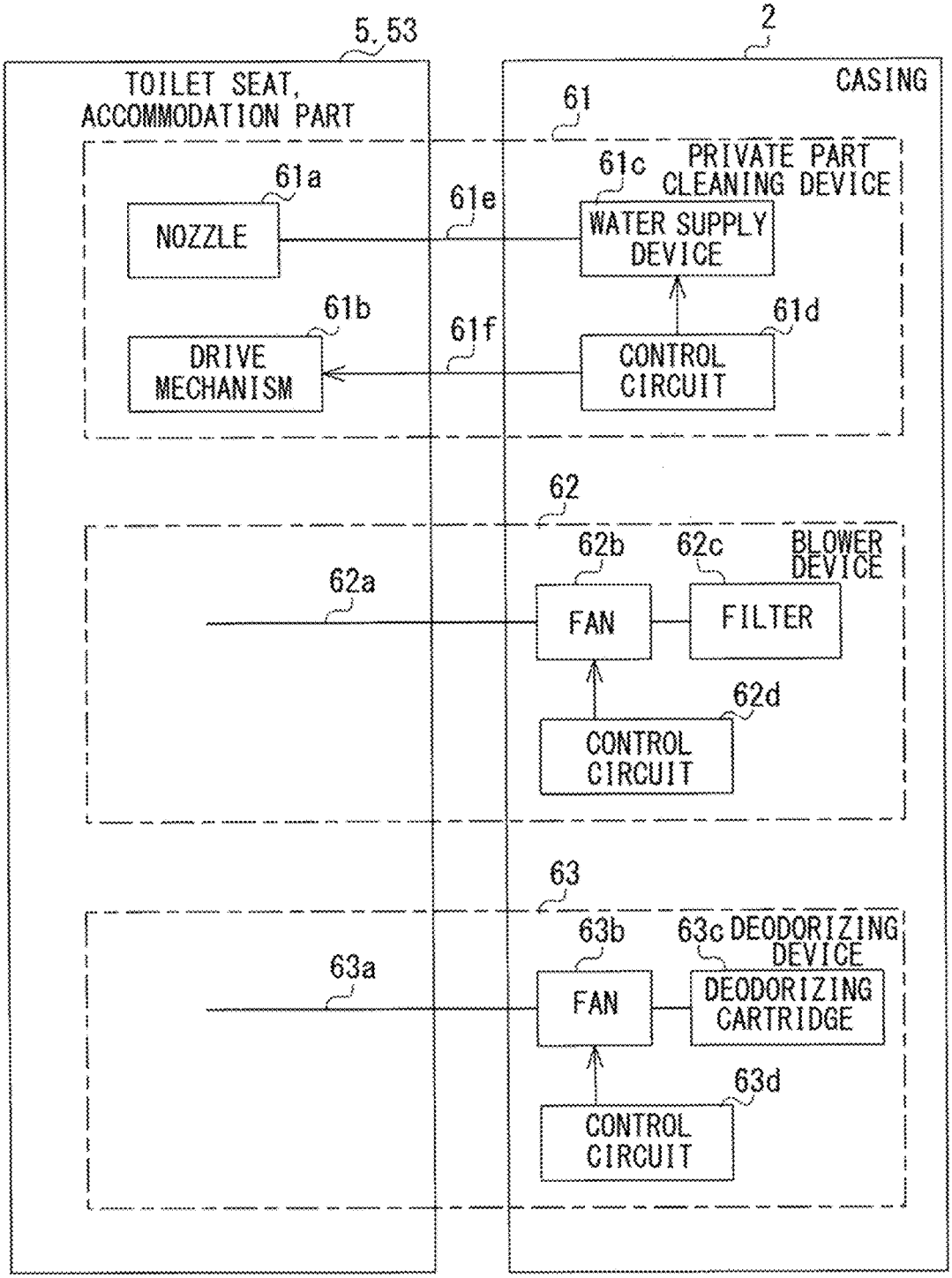
FIG. 6 is a functional block diagram that shows part of the configurations of functional components in the toilet seat device according to some embodiments.

FIG. 6 is a functional block diagram that shows part of the configurations of the functional components in the toilet seat device 9. The toilet seat device 9 includes functional components that eject liquid or that blow out or suction gas, such as a private part cleaning device 61, a blower device 62, a deodorizing device 63, and a sterilizing water supply device for the toilet bowl. The accommodation part 53 accommodates at least part of the private part cleaning device 61, blower device 62, and deodorizing device 63, for example. The accommodation part 53 may also accommodate part of the sterilizing water supply device. The private part cleaning device 61 includes a nozzle 61*a* that moves forward toward the center of the seat part 51 and moves backward into the accommodation part 53. The accommodation part 53 accommodates, in its internal space, a drive mechanism 61*b* for making the nozzle 61*a* to move forward and backward. A water supply device 61*c*, which supplies water to the nozzle 61*a*, and a control circuit 61*d* are provided within the casing 2. The water supply device 61*c* includes a warm water tank in which water is heated, for example, and the control circuit 61*d* controls the temperature of the water stored in the tank. To the nozzle 61*a*, a flow pipe 61*e* extending from the water supply device 61*c* is connected, and water to be ejected from the nozzle 61*a* is supplied through the flow pipe 61*e*. To the drive mechanism 61*b*, a signal line 61*f* extending from the control circuit 61*d* is connected, and the drive mechanism 61*b* operates based on a signal from the control circuit 61*d*.

The blower device 62 includes a flow pipe 62*a* through which warm air blows out toward the center of the seat part 51, and part of the flow pipe 62*a* is provided in the internal space of the accommodation part 53. The flow pipe 62*a* is connected to a fan 62*b* provided within the casing 2, and air introduced from the outside is sent to the fan 62*b* through a filter 62*c*. The air introduced from the outside is heated by a heater (omitted in the drawings) provided at one of a position anterior to the fan 62*b* and a position posterior to the fan 62*b*. A control circuit 62*d* that performs control for supplying a current to the fan 62*b* and the like is provided within the casing 2.

The deodorizing device 63 includes a flow pipe 63*a* through which air within the toilet bowl 11 is suctioned, and part of the flow pipe 63*a* is provided in the internal space of the accommodation part 53. The flow pipe 63*a* is connected to a fan 63*b* provided within the casing 2, and the air is discharged to the outside through a deodorizing cartridge 63*c*. The deodorizing cartridge 63*c* contains a deodorant, such as activated carbon, and the air suctioned through the flow pipe 63*a* is made to flow through the deodorant to be deodorized. A control circuit 63*d* that performs control for supplying a current to the fan 63*b* is provided within the casing 2.

There will now be described the functions of the toilet seat device 9 and the toilet device 100 of some embodiments. As described based on FIGS. 4 through 6, the accommodation part 53 of the toilet seat 5 accommodates part of the private part cleaning device 61, blower device 62, deodorizing device 63, and the like as functional components. The other part of the private part cleaning device 61, blower device 62, deodorizing device 63, and the like is provided within the casing 2, so that increase in weight of the toilet seat 5 can be restrained in the toilet seat device 9.

Restraining increase in weight of the toilet seat 5 can prevent increasing the strength or rigidity of the toilet seat hinge parts 22 that rotatably support the toilet seat 5, thereby also restraining increase in weight of the toilet seat hinge parts 22. Also, restraining increase in weight of the toilet seat 5 can also restrain increase in load torque at the time of rotating the toilet seat 5, thereby preventing scale-up of a drive system for rotating the toilet seat 5.

If the control circuits of the private part cleaning device 61, blower device 62, deodorizing device 63, and the like are provided in the toilet seat 5, the control circuits may possibly fail because of vibration or impact caused by rotation of the toilet seat 5. Accordingly, by providing the control circuits of the private part cleaning device 61, blower device 62, deodorizing device 63, and the like within the casing 2, the control circuits can be fixed without being moved, so that the failure due to vibration or impact can be reduced.

Also, if the fan 62*b* of the blower device 62 and the fan 63*b* of the deodorizing device 63 are provided in the toilet seat 5, sound or vibration may directly propagate to the toilet seat 5 when the fan 62*b* or fan 63*b* is driven, so that the sitting person may possibly feel incongruity. Accordingly, by providing the fan 62*b* and the fan 63*b* within the casing 2, they can be disposed at positions farther from the sitting person, so that the sound or vibration caused when the fan 62*b* or fan 63*b* is driven can be made less likely to propagate to the toilet seat 5. If each fan has excellent silence property, the sitting person may feel less incongruity even though the fan is provided in the toilet seat 5.

The filter 62*c* of the blower device 62 and the deodorizing cartridge 63*c* of the deodorizing device 63 can be provided to be attachable and detachable within the casing 2. In this case, maintenance work, such as cleaning and replacement, of the filter 62*c* or the deodorizing cartridge 63*c* can be performed after the cover 3 covering the casing 2 is detached and the filter 62*c* or the deodorizing cartridge 63*c* is taken out of the casing 2.

Figure 7:
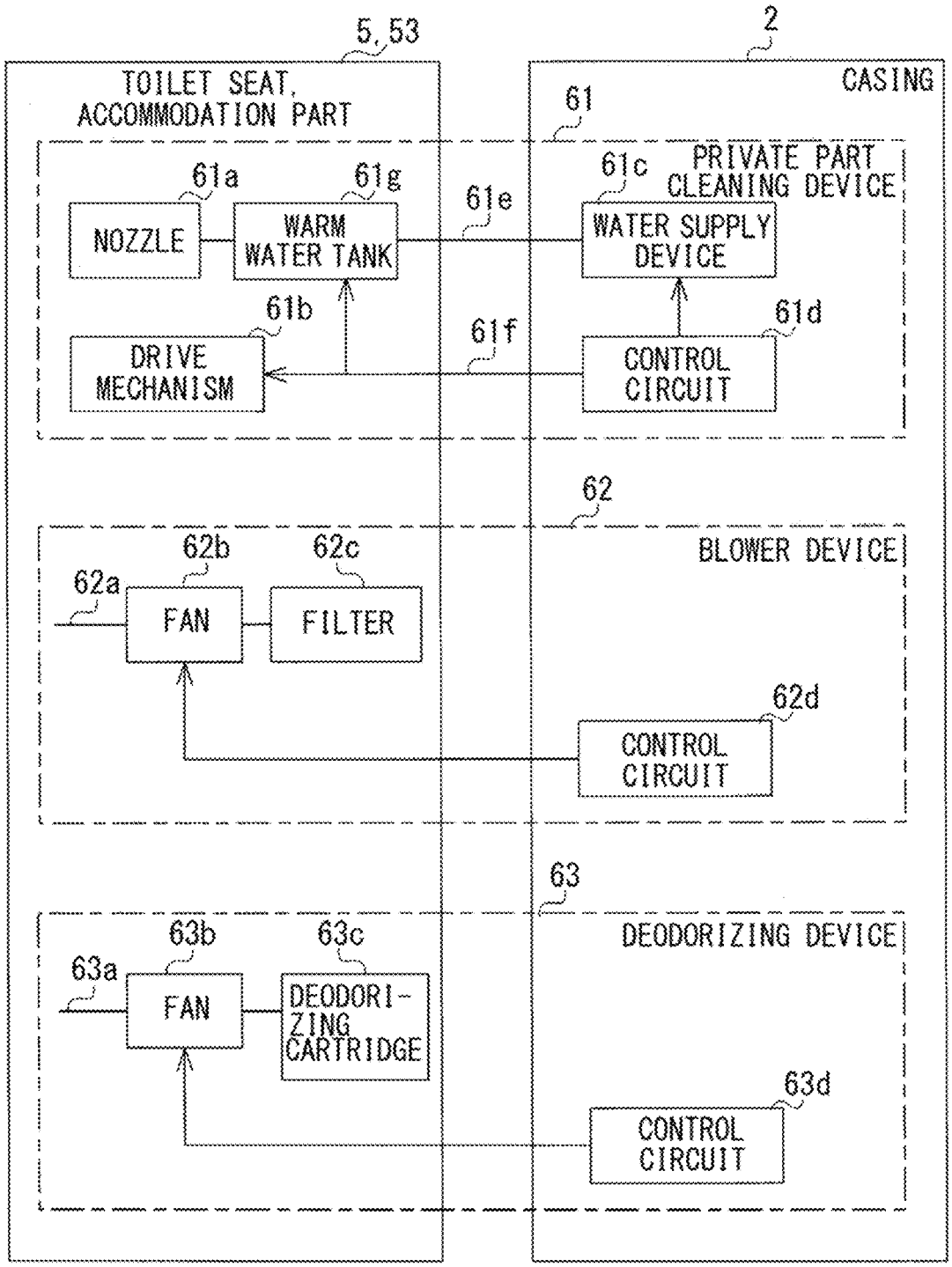
FIG. 7 is a functional block diagram that shows part of the configurations of functional components in the toilet seat device according to some embodiments.

FIG. 7 is a functional block diagram that shows part of the configurations of the functional components in the toilet seat device 9 of some embodiments. In the toilet device 100, the nozzle 61*a*, the drive mechanism 61*b*, and a warm water tank 61*g* of the private part cleaning device 61 are accommodated in the accommodation part 53 of the toilet seat 5, and the water supply device 61*c* and the control circuit 61*d* are provided within the casing 2. The warm water tank 61*g* is provided with a heater (omitted in the drawings), and the control circuit 61*d* controls the temperature. By providing the warm water tank 61*g* in the toilet seat 5, increase of functional components accommodated in the casing 2 can be prevented. Meanwhile, the weight of the toilet seat 5 will be increased by the warm water tank 61*g*.

Also, in the toilet seat device 9 of some embodiments, the flow pipe 62*a*, the fan 62*b*, and the filter 62*c* of the blower device 62 are accommodated in the accommodation part 53 of the toilet seat 5, and the control circuit 62*d* is provided within the casing 2. The fan 62*b* is connected to the control circuit 62*d* with a signal line. By accommodating the fan 62*b* and the filter 62*c* in the accommodation part 53 of the toilet seat 5, the flow pipe 62*a* can be made shorter, so that the flow pipe 62*a* does not contribute to the load torque in the insertion parts 23.

Also, in the toilet device 100 of some embodiments, the flow pipe 63*a*, the fan 63*b*, and the deodorizing cartridge 63*c* of the deodorizing device 63 are accommodated in the accommodation part 53 of the toilet seat 5, and the control circuit 63*d* is provided within the casing 2. The fan 63*b* is connected to the control circuit 63*d* with a signal line. By accommodating the fan 63*b* and the deodorizing cartridge 63*c* in the accommodation part 53 of the toilet seat 5, the flow pipe 63*a* can be made shorter, so that the flow pipe 63*a* does not contribute to the load torque in the insertion parts 23.

The filter 62*c* of the blower device 62 and the deodorizing cartridge 63*c* of the deodorizing device 63 may be provided to be attachable and detachable in the accommodation part 53 of the toilet seat 5, for example, so that maintenance work, such as cleaning and replacement, of the filter 62*c* and the deodorizing cartridge 63*c* can be performed. For example, a window that can be opened and closed may be provided in the base end part 52 of the toilet seat 5 so that the filter 62*c* and the deodorizing cartridge 63*c* provided inside can be attached and detached. Alternatively, recesses may be provided in the base end part 52 of the toilet seat 5, for example, so that the filter 62*c* and the deodorizing cartridge 63*c* that each are configured as a unit can be inserted into the recesses to be attached, or can be detached therefrom.

In the toilet device 100, the functional components, which eject liquid or blow out or suction gas, may also include a cleaning foam supply device, an in-bowl spray device for wetting the receiving surface 11*a* of the toilet bowl 11 with water, and a sterilizing water supply device for sterilizing an inner portion of the toilet bowl 11, besides the private part cleaning device 61, blower device 62, and deodorizing device 63 described above. Also with regard to each of such cleaning foam supply device, in-bowl spray device, and sterilizing water supply device, at least part of the component may be provided in the toilet seat 5, and the other part of the component may be provided in the casing 2.

Figure 8:
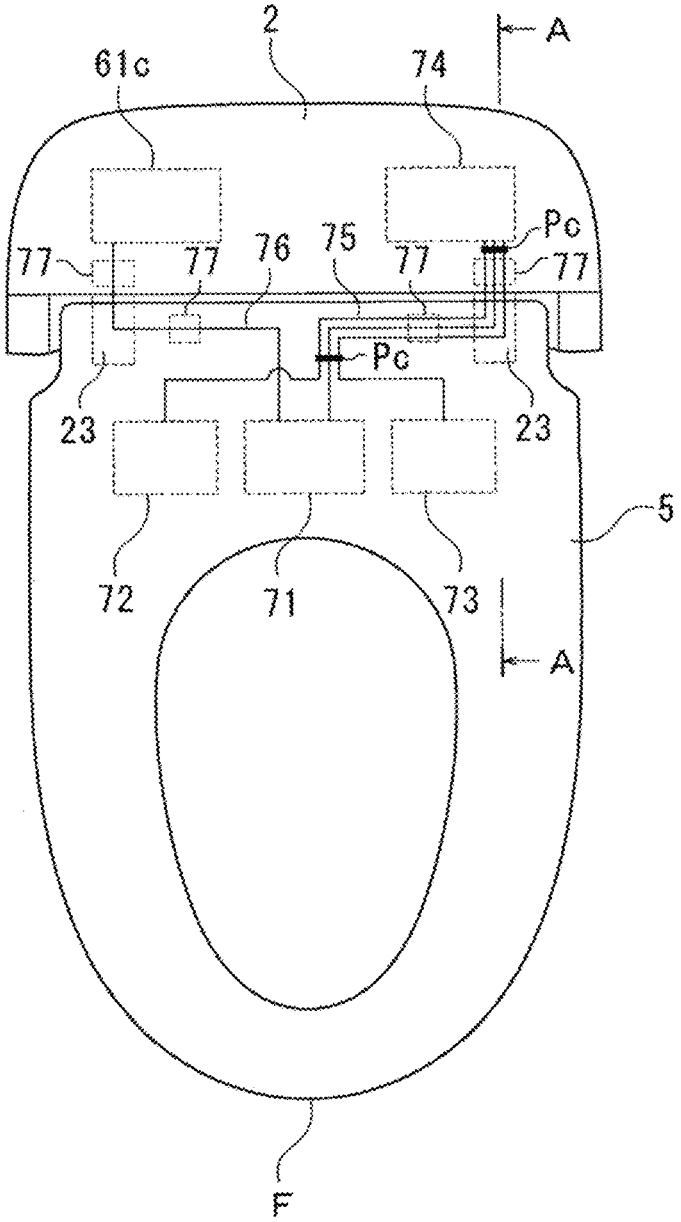
FIG. 8 is a configuration diagram that shows part of the functions of the casing and the toilet seat according to some embodiments.
Figure 9:
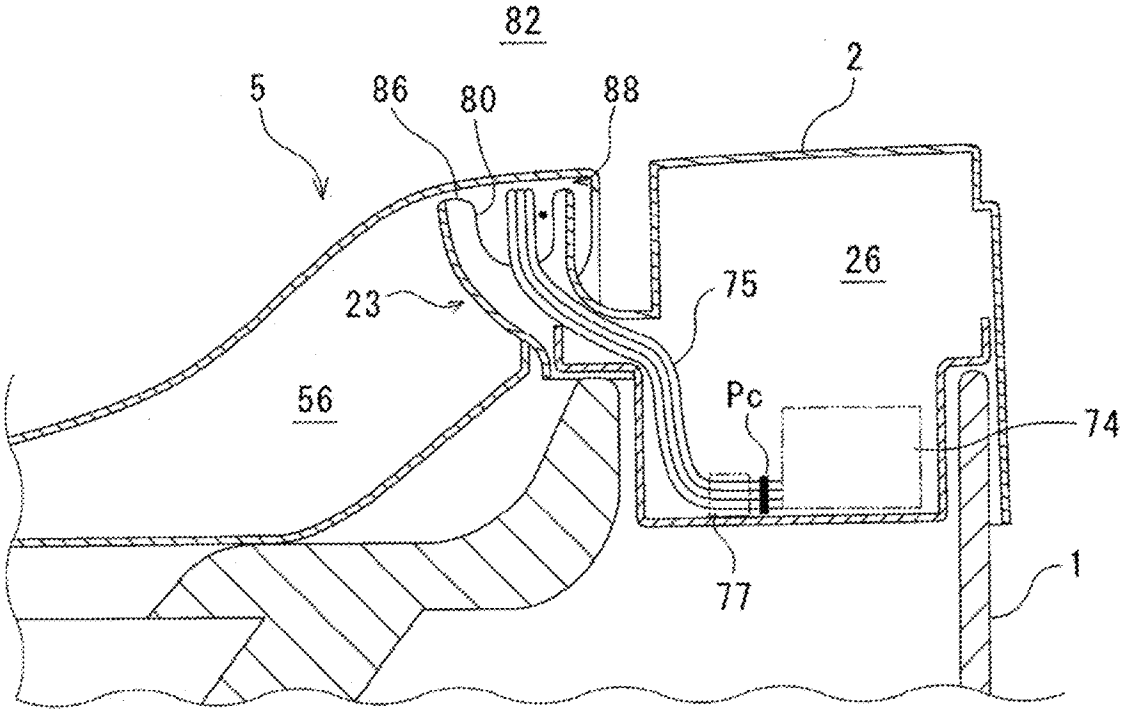
FIG. 9 is a sectional view taken along line A-A in FIG. 8 according to some embodiments.

FIG. 8 is a configuration diagram that shows part of the functions of the casing 2 and the toilet seat 5, and FIG. 9 is a sectional view taken along line A-A in FIG. 8. In the toilet seat 5, a bidet unit 71, a blower unit 72, and a deodorizing unit 73 are provided. The bidet unit 71 includes the nozzle 61*a*, the drive mechanism 61*b*, and the warm water tank 61*g* of the private part cleaning device 61 shown in FIG. 7. The blower unit 72 includes the flow pipe 62*a*, the fan 62*b*, and the filter 62*c* of the blower device 62. The deodorizing unit 73 includes the flow pipe 63*a*, the fan 63*b*, and the deodorizing cartridge 63*c*. In the casing 2, the water supply device 61*c* of the private part cleaning device 61 and a circuit board 74 are provided. The circuit board 74 includes the control circuit 61*d* of the private part cleaning device 61, the control circuit 62*d* of the blower device 62, and the control circuit 63*d* of the deodorizing device 63.

The bidet unit 71, the blower unit 72, and the deodorizing unit 73 are connected to the circuit board 74 with signal lines 75. The bidet unit 71 is connected to the water supply device 61*c* with a hose 76 having flexibility. The signal lines 75 are bundled at positions Pc spaced away from each other in a longer direction, and are provided in the insertion part 23 on the right side when viewed from the front end F. Meanwhile, the hose 76 is provided in the insertion part 23 on the left side when viewed from the front end F. Each of the signal lines 75 and the hose 76 has a loose portion located between a fixed position where the signal line or hose is fixed to the casing 20 by means of a fixture 70 and a fixed position where the signal line or hose is fixed to the toilet seat 5 by means of a fixture 77, and the loose portion is inserted within the corresponding insertion part 23.

Each insertion part 23 includes a draw port 80 through which the signal lines 75 or the hose 76 is drawn into the internal space of the toilet seat 5. When the toilet seat 5 is placed in the closed state, the internal space 26 of the casing 2 communicates with the internal space 56 of the toilet seat 5 via the draw ports 80 of the insertion parts 23, without the intervention of external space 82. The draw port 80 of each insertion part 23 opens inward in a left-and-right direction. Each draw port 80 is a cutout recessed from a tip part toward the base end side of the insertion part 23. Also, at the tip part of each insertion part 23, a tip opening 86 is provided. An edge surface of each draw port 80 is provided continuously with an edge surface of a corresponding tip opening 86. When the toilet seat 5 is placed in the closed state, the tip part of each insertion part 23 is located away from an upper surface part of the toilet seat 5 with a gap 88 in between. The minimum width of the gap 88 may be set smaller than the outer diameters of each signal line 75 and the hose 76, for example.

There will now be described the features of the toilet seat device 9 and the toilet device 100 of some embodiments.

The toilet seat device 9 in some embodiments of the disclosure includes the toilet seat 5, the casing 2 provided in rear of the toilet seat 5, and a functional component that ejects liquid or that blows out or suctions gas. At least part of the functional component is provided in the toilet seat 5, and the other part of the functional component is provided in the casing 2. Accordingly, in the toilet seat device 9, increase in weight of the toilet seat 5 can be restrained.

The functional component is the private part cleaning device 61 that cleans the private part of a sitting person, the blower device 62 that provides warm air into the toilet bowl 11, or the deodorizing device 63 that deodorizes an inner portion of the toilet bowl 11. Accordingly, in the toilet seat device 9, increase in weight of the toilet seat 5 caused by the private part cleaning device 61, blower device 62, or deodorizing device 63 can be restrained.

The private part cleaning device 61 includes the nozzle 61*a* through which water is ejected, and the drive mechanism 61*b* that makes the nozzle 61*a* to move forward and backward. The nozzle 61*a* and the drive mechanism 61*b* are provided in the toilet seat 5. Accordingly, in the toilet seat device 9, the nozzle 61*a* and the drive mechanism 61*b* are provided in the toilet seat 5 and the other part of the private part cleaning device 61 is provided in the casing 2, so that increase in weight of the toilet seat 5 can be restrained.

Also, with regard to the blower device 62 and the deodorizing device 63, the flow pipe 62*a* through which gas blows out and the flow pipe 63*a* through which fluid is suctioned are provided in the toilet seat 5. Accordingly, in the toilet seat device 9, the flow pipe 62*a* and the flow pipe 63*a* are provided in the toilet seat 5, and the other part of each of the blower device 62 and the deodorizing device 63 is provided in the casing 2, so that increase in weight of the toilet seat 5 can be restrained.

The toilet device 100 includes the aforementioned toilet seat device 9 and the toilet body 1. Accordingly, in the toilet device 100, increase in weight of the toilet seat 5 can be restrained.

Figure 10:
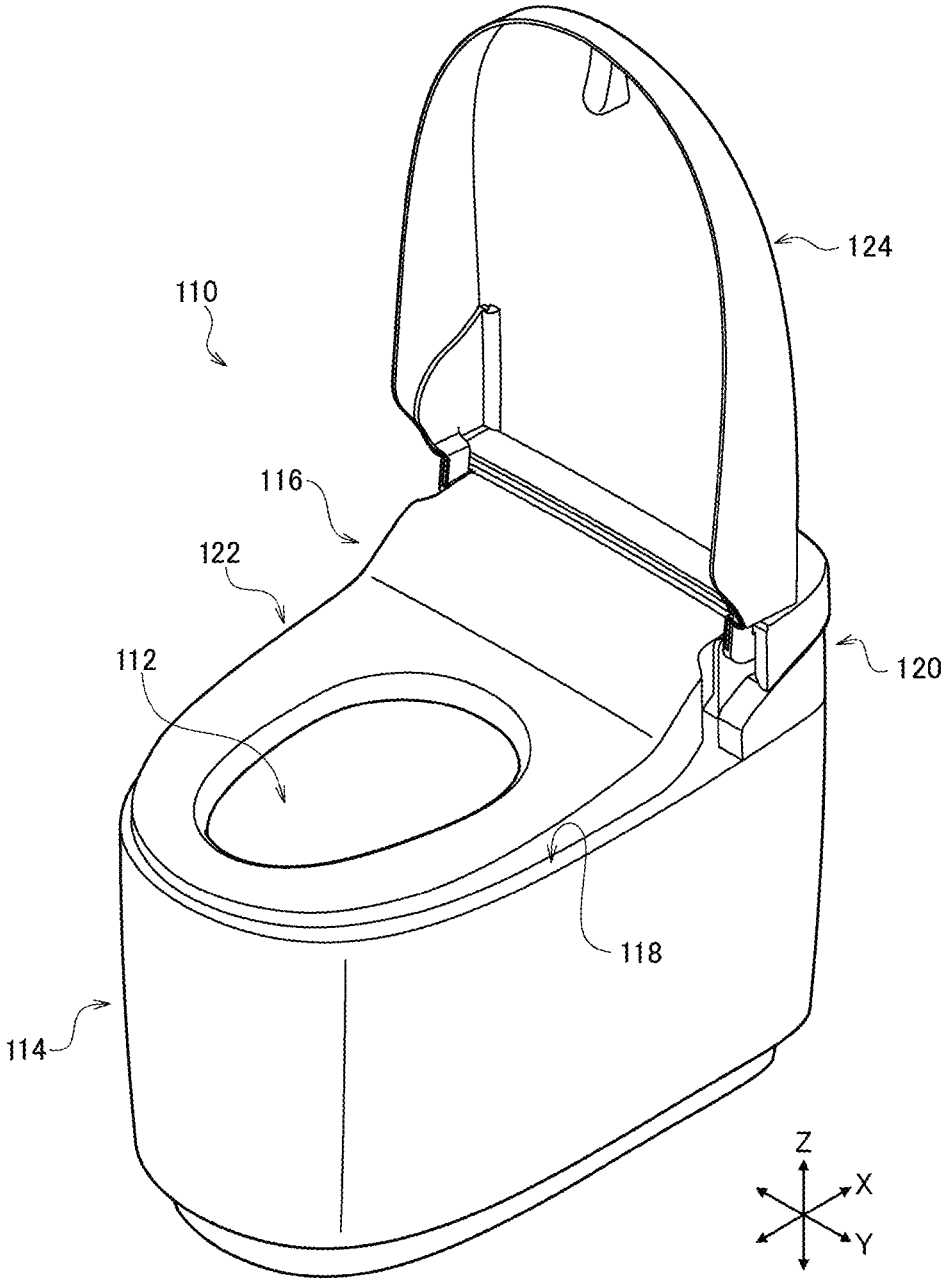
FIG. 10 is a perspective view of a toilet device according to some embodiments.
Figure 11:
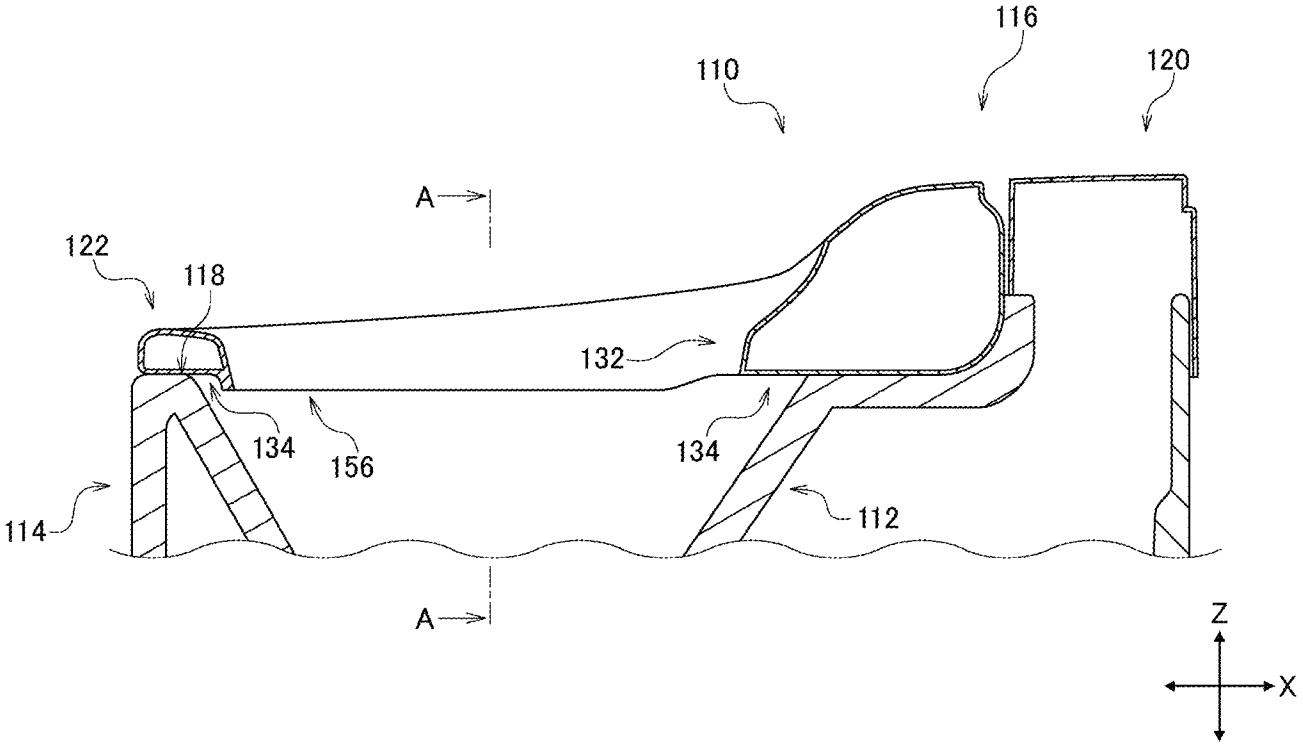
FIG. 11 is a sectional side view of part of the toilet device according to some embodiments.

FIG. 10 is a perspective view of a toilet device 110 of some embodiments. FIG. 11 is a sectional side view of part of the toilet device 110. The toilet device 110 includes a toilet body 114 that includes a toilet bowl 112 in a front part, and a toilet seat unit (toilet seat device) 116 attached to the toilet body 114. The toilet body 114 includes, besides the toilet bowl 112, a rim part 118 that forms a circumferential edge part of an upper opening of the toilet bowl 112. The toilet seat unit 116 mainly includes a casing 120, a toilet seat 122, and a shutter (not illustrated). In the following, description will be made using three kinds of directions perpendicular to one another. These directions are front-and-rear direction X, left-and-right direction Y, and up-and-down direction Z of the toilet body 114. The front-and-rear direction X and left-and-right direction Y are horizontal direction corresponding to the front, rear, left, and right of a person who sits on the toilet seat 122 in a normal posture. The up-and-down direction Z are vertical direction.

The casing 120 is provided in a rear part of the toilet body 114. The casing 120 accommodates multiple first functional components, which are not illustrated. To the casing 120, a toilet lid 124 is rotatably attached via a hinge mechanism. The casing 120 is disposed at a position that does not overlap, in a vertical direction Z, the toilet bowl 112 of the toilet body 114.

The toilet seat 122 is rotatably attached to the casing 120 via a hinge mechanism, which is not illustrated. The toilet seat 122 is rotatable between a laid position (see FIG. 11) at which the toilet seat 122 is laid over the rim part 118 of the toilet body 114, and an upright position (not illustrated) at which the toilet seat 122 is positioned upright with respect to the toilet body 114. The toilet seat 122 as a whole has a ring shape having a hollow structure.

Figure 12:
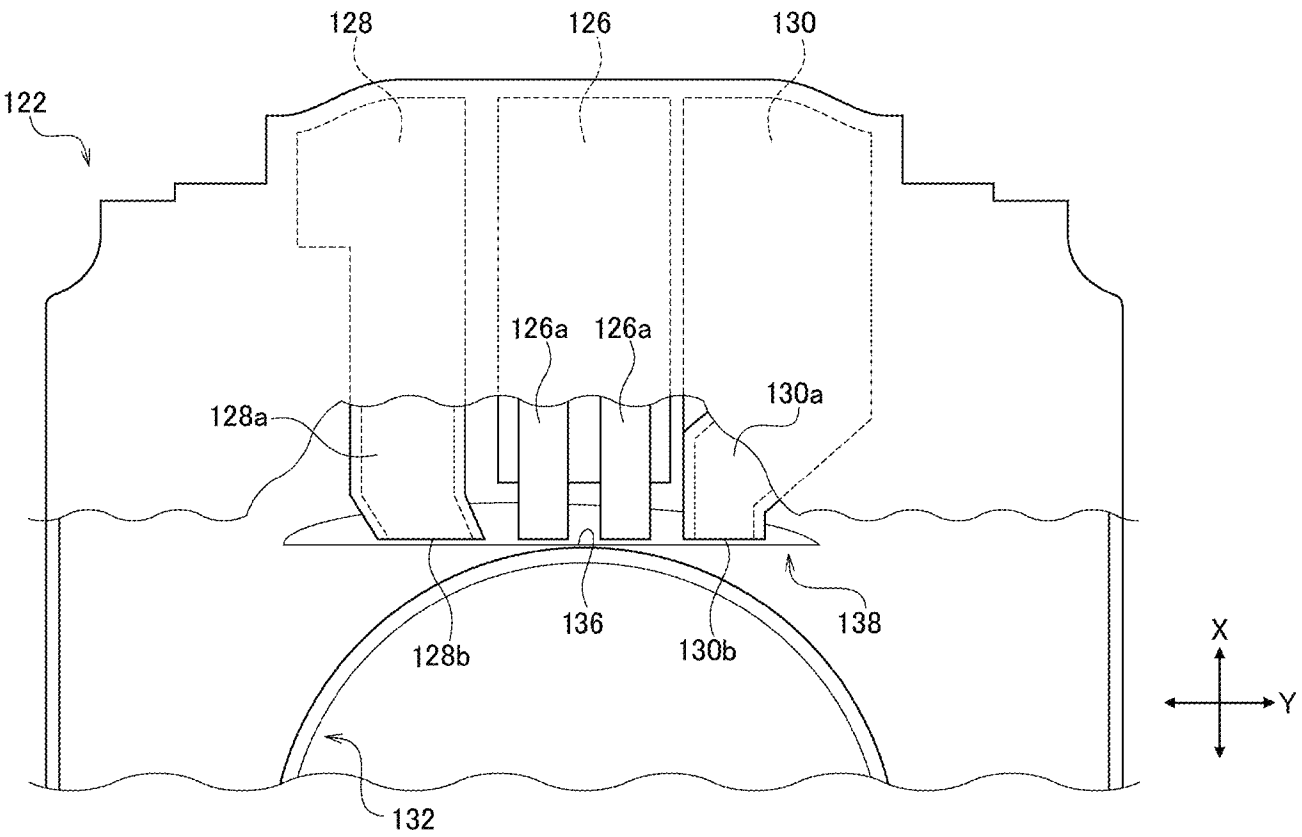
FIG. 12 is a top view that shows an internal structure of part of the toilet seat according to some embodiments.

FIG. 12 is a top view that shows an internal structure of part of the toilet seat 122. Within the toilet seat 122, a cavity part is continuously provided in a circumferential direction, and, within a rear part of the cavity part, multiple second functional components are accommodated. The multiple second functional components are accommodated within the toilet seat 122, at positions that overlap, in a front-and-rear direction X, a center opening part 132 (described later) of the toilet seat 122 and in rear of the center opening part 132.

The functional components are provided to implement certain functions associated with the toilet device 110. The functional components include a private part cleaning device 126 for cleaning the private part of the sitting person sitting on the toilet seat 122, a drying device 128 for blowing dry air to dry the sitting person, and a deodorizing device 130 for absorbing and removing odors produced in the toilet bowl 112, for example. Although not illustrated, the functional components also include a drive device for rotating the toilet seat 122 or the toilet lid 124, a water supply device for supplying water used for cleaning to the private part cleaning device 126 or the like, and a circuit board used to supply electricity to each functional component or to control each functional component. The casing 120 accommodates the abovementioned drive device, water supply device, and circuit board as the first functional components. The toilet seat 122 accommodates the private part cleaning device 126, drying device 128, and deodorizing device 130 as the second functional components.

Figure 13:
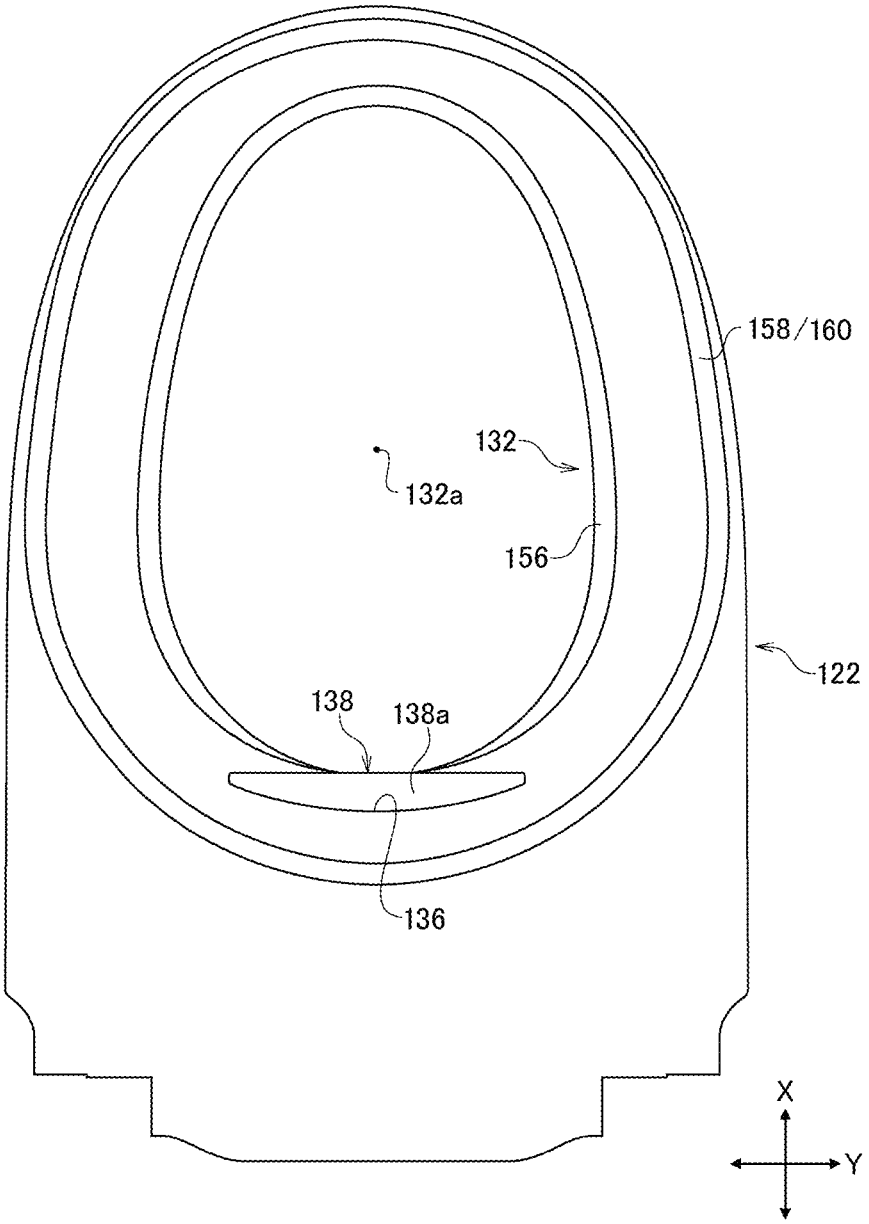
FIG. 13 is a bottom view that shows a reverse face of the toilet seat according to some embodiments.

FIG. 13 is a bottom view that shows a reverse face of the toilet seat 122. The toilet seat 122 has the center opening part 132 provided in the center part of the toilet seat 122, through which waste of the sitting person is brought in. When the toilet seat 122 at the laid position is viewed from a vertical direction, a circumferential direction of a circle around a center position 132*a* of the center opening part 132 as the center is defined as a "circumferential direction" of the toilet seat 122, and a radial direction of the circle is defined as a "radial direction" of the toilet seat 122.

Figure 14:
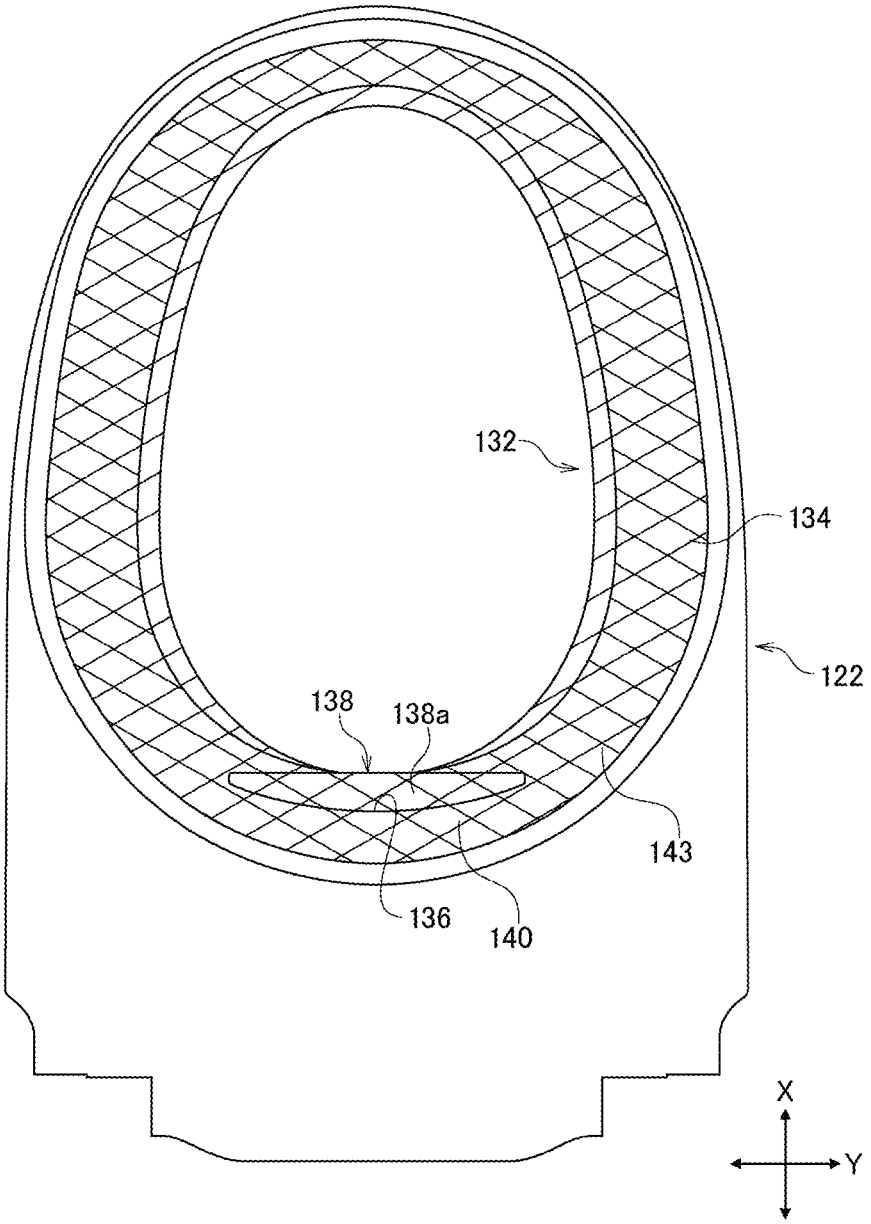
FIG. 14 is another bottom view that shows the reverse face of the toilet seat according to some embodiments.

FIG. 14 is another bottom view that shows the reverse face of the toilet seat 122. As shown in FIGS. 11 and 14, the reverse face as an outer surface of the toilet seat 122 has a toilet bowl facing area 134 provided at a position facing the toilet bowl 112 of the toilet body 114 in a vertical direction Z when the toilet seat 122 is placed at the laid position. The toilet bowl facing area 134 is the area with hatching in FIG. 14. The toilet bowl facing area 134 is provided such as to form a continuous ring shape around the center opening part 132 of the toilet seat 122. The toilet bowl facing area 134 in some embodiments is configured as part of a member provided continuously and seamlessly.

Figure 15:
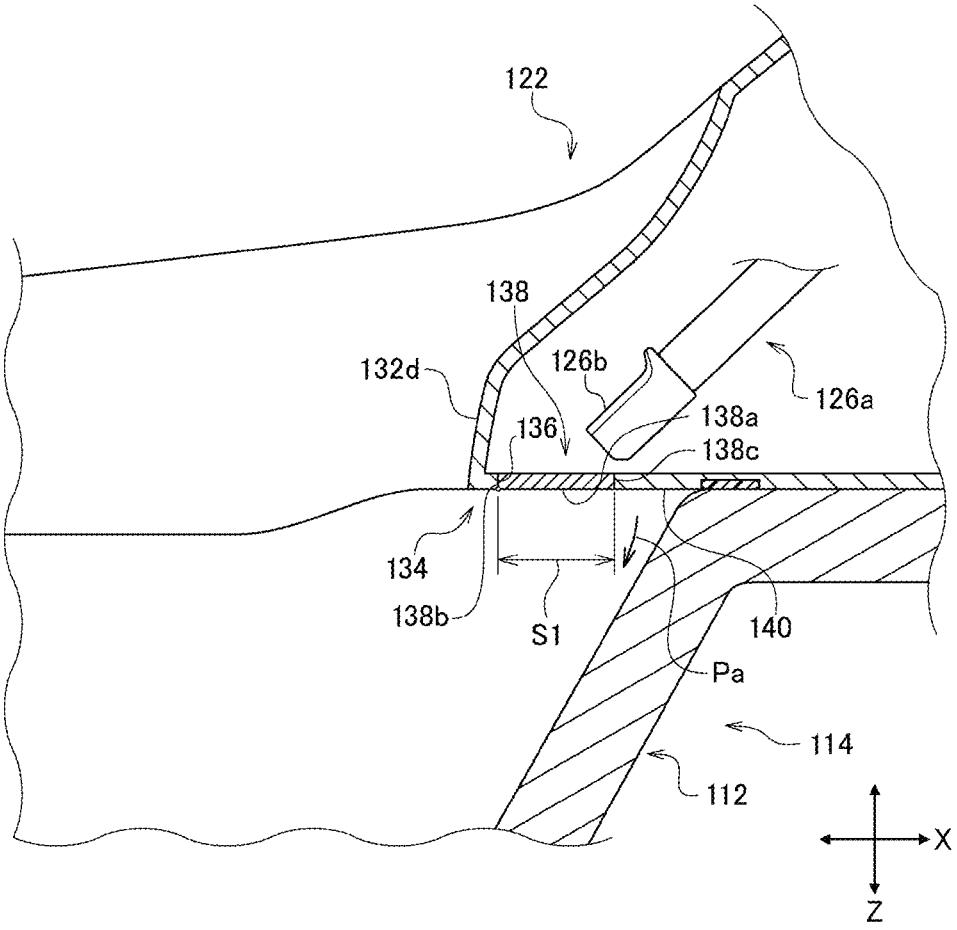
FIG. 15 is a partially magnified view of FIG. 11 according to some embodiments.

FIG. 15 is a partially magnified view of FIG. 11. As shown in FIGS. 14 and 15, an opening-and-closing port 136 is formed on the reverse face of the toilet seat 122. The opening-and-closing port 136 in some embodiments is formed at a position that overlaps, in a front-and-rear direction X, the center opening part 132 of the toilet seat 122 and in rear of the center opening part 132. The opening-and-closing port 136 in some embodiments is formed in rear of an inner circumferential wall that forms the center opening part 132 of the toilet seat 122. The opening-and-closing port 136 in some embodiments is formed in the toilet bowl facing area 134.

A shutter 138 is attached to the toilet seat 122 such as to enable opening and closing of the opening-and-closing port 136 of the toilet seat 122. The shutter 138 in some embodiments has an elongate shape extending in a left-and-right direction Y, of which a front side part has a linear shape and a rear side part has a curved shape with a rearward convex. As with the opening-and-closing port 136, the shutter 138 in some embodiments is provided in the toilet bowl facing area 134. The entirety of the shutter 138 in some embodiments is provided at a position that overlaps, in a front-and-rear direction X, the center opening part 132 of the toilet seat 122 and in rear of the center opening part 132.

Figure 16:
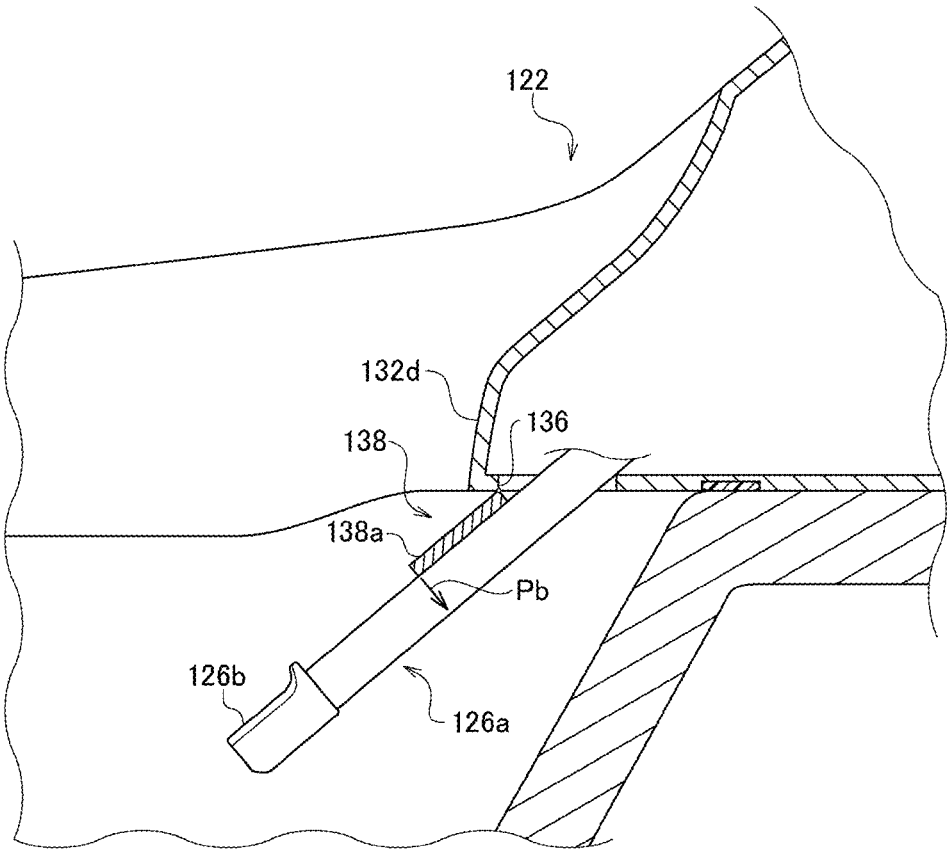
FIG. 16 is a diagram that shows an operation of a shutter according to some embodiments.

FIG. 16 is a diagram that shows an operation of the shutter 138. FIG. 15 shows a state where the shutter 138 is placed at a closed position at which the opening-and-closing port 136 is closed, and FIG. 16 shows a state where the shutter 138 is placed at an open position at which the opening-and-closing port 136 is open. The shutter 138 in some embodiments is rotatably attached to the toilet seat 122 via a rotational shaft (not illustrated). The rotational shaft in some embodiments extends along a horizontal direction. The shutter 138 rotates about the rotational shaft in a direction Pa to open the opening-and-closing port 136, and rotates in a direction Pb, opposite to the direction Pa, to close the opening-and-closing port 136. When the shutter 138 in some embodiments is placed at the closed position, the shutter 138 is fitted into the opening-and-closing port 136 to plug the opening-and-closing port 136.

As shown in FIGS. 14 and 15, the shutter 138 has a first flat surface 138*a* that constitutes a large part of an outer surface of the shutter 138. The "outer surface" means a surface of the shutter 138 exposed to the outside. Also, the "large part" as used herein means 70 percent or more of the entire outer surface of the shutter 138 when the outer surface of the shutter 138 is viewed from a normal direction along a normal line of the first flat surface 138*a*. When viewed from the same viewpoint, the first flat surface 138*a* of the shutter 138 may suitably constitute 90 percent or more of the entire outer surface of the shutter 138. The outer surface of the shutter 138 in some embodiments is formed smoothly and continuously overall, without any part protruding from the first flat surface 138*a* of the shutter 138.

Advantages thereof will be described. Since the outer surface of the shutter in Patent Literature 1 has an uneven three-dimensional-like structure, when a person wipes down the shutter, the person needs to largely move the fingers along the unevenness. In some embodiments, on the other hand, a large part of the outer surface of the shutter 138 is constituted by the first flat surface 138*a* that has a two-dimensional-like structure with less unevenness. Accordingly, the movement of fingers at the time of wiping down the outer surface of the shutter can be made smaller, so that favorable cleanability can be obtained.

The toilet seat 122 has a second flat surface 140 that constitutes the reverse face of the toilet seat 122. The opening-and-closing port 136 is formed on the second flat surface 140, and the second flat surface 140 constitutes a circumferential edge surface of the opening-and-closing port 136. The second flat surface 140 is provided to include an area of the toilet bowl facing area 134 of the toilet seat 122, which overlaps, in a front-and-rear direction X, the center opening part 132 of the toilet seat 122. The first flat surface 138*a* of the shutter 138 is provided to be flush with the second flat surface 140 of the toilet seat 122 when the shutter 138 is placed at the closed position. Being "flush" as used herein includes the case where there is no positional deviation in a normal direction of the first flat surface 138*a* between the first flat surface 138*a* and the second flat surface 140, and also includes the case where there is little positional deviation, such as within a range of 0 to 3.0 mm. Accordingly, a person can wipe down the first flat surface 138*a* of the shutter 138 and the second flat surface 140 of the toilet seat 122 without getting caught on anything therebetween, thereby obtaining more favorable cleanability.

A surface area 143 that includes the outer surface of the shutter 138 and the second flat surface 140 of the toilet seat 122 is provided such as to form a continuous ring shape around the center opening part 132 of the toilet seat 122. The surface area 143 is indicated by double hatching in FIG. 14. Accordingly, even when the shutter 138 is attached to the toilet seat 122, a person can easily wipe down the area around the center opening part 132 of the toilet seat 122 over the entire circumference, without getting caught on anything.

The shutter 138 is provided in the vicinity of the center opening part 132 of the toilet seat 122. The "vicinity" as used herein means a range within 3.0 cm from the inner circumferential surface of the center opening part 132 of the toilet seat 122 when the reverse face of the toilet seat 122 is viewed. The reverse face of the toilet seat 122 being viewed means the toilet seat 122 placed at the laid position being viewed from the lower side in the vertical direction. Accordingly, since the shutter 138 is disposed in an area to be easily reached when a hand is put in the center opening part 132 of the toilet seat 122, the outer surface of the shutter 138 can be easily wiped down as the toilet seat 122 is kept at the laid position. In order to obtain similar effects, the shutter 138 may be provided in the center opening part 132 of the toilet seat 122.

As shown in FIG. 15, in the entire range in a front-and-rear direction X of the shutter 138, a range from a front end 138*b* toward a rear end 138*c* occupying a large part of an entire range is defined as 51. In some embodiments, the range 51 means the entire range in a front-and-rear direction of the shutter 138. The "large part" as used herein means 70 percent or more of the entire range in a front-and-rear direction X of the shutter 138. The range 51 may suitably be 90 percent or more of the entire range in a front-and-rear direction X of the shutter 138, and may more suitably be the entire range of the shutter 138 as defined in some embodiments.

Figure 17:
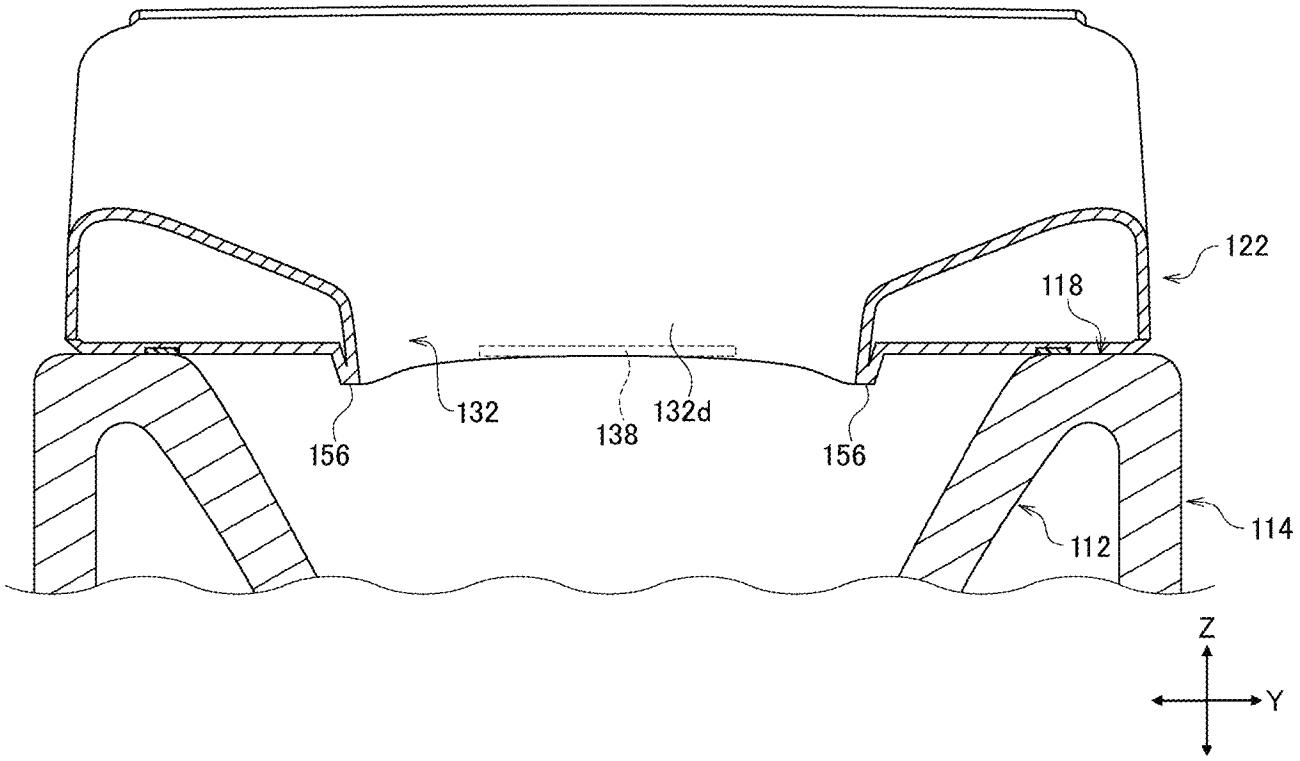
FIG. 17 is a sectional view taken along line A-A in FIG. 11 according to some embodiments.

FIG. 17 is a sectional view taken along line A-A in FIG. 11. As shown in FIGS. 15 and 17, the abovementioned range 51 of the shutter 138 is located in rear of an inner circumferential surface 132*d* of the center opening part 132 of the toilet seat 122 and at a position that overlaps the inner circumferential surface 132*d* when the toilet seat 122 at the laid position is viewed from the front side in the front-and-rear direction X. The "inner circumferential surface 132*d* of the center opening part 132 of the toilet seat 122" means a portion constituted by the toilet seat 122 formed separately from the shutter 138. The condition is satisfied when the toilet seat 122 is viewed from the front side at a cross section that passes through the center opening part 132 of the toilet seat 122 and that is perpendicular to a front-and-rear direction X. It also can be considered that the abovementioned range 51 of the shutter 138 in some embodiments is covered by a lower end part of the inner circumferential surface 132*d* of the toilet seat 122 when the toilet seat 122 is viewed from the front side.

Accordingly, a layout can be achieved in which, when a user looks into the center opening part 132 of the toilet seat 122 at the laid position from the upper side, a wide range of the shutter 138 is hidden by the inner circumferential surface 132*d*. Therefore, the shutter 138 is less likely to appear in an external view when the toilet seat 122 is placed at the laid position, so that neat appearance can be achieved, and favorable design properties can be obtained.

The shutter 138 is provided at a position hidden by the inner circumferential surface 132*d* of the center opening part 132 of the toilet seat 122 when the toilet seat 122 at the laid position is viewed from the front side. In other words, it can also be said that the shutter 138 is provided at a position where it cannot be visually recognized when the toilet seat 122 is viewed from the front side at a cross section that passes through the center opening part 132 of the toilet seat 122 and that is perpendicular to a front-and-rear direction X. It can also be said that the entirety of the shutter 138 is located in rear of the inner circumferential surface 132*d* of the center opening part 132 of the toilet seat 122 and at a position that overlaps, in a front-and-rear direction X, the inner circumferential surface 132*d*. Accordingly, the shutter 138 is provided at a position where, when a user looks into the toilet seat 122 at the laid position from the upper side, the shutter 138 is difficult to see through the center opening part 132 of the toilet seat 122. Therefore, even when the shutter 138 is attached to the toilet seat 122, the shutter 138 is less likely to appear in an external view when the toilet seat 122 is placed at the laid position, so that neat appearance can be achieved, and favorable design properties can be obtained.

Other features of the toilet seat unit 116 will now be described. As shown in FIGS. 12, 15, and 16, the private part cleaning device 126 includes a pair of cleaning nozzles 126*a*. The pair of cleaning nozzles 126*a* are arranged side by side. Each cleaning nozzle 126*a* is provided to be tilted downward toward the front side. At a tip part positioned in a lower part of each cleaning nozzle 126*a*, a nozzle hole 126*b* from which cleaning water is ejected is provided.

The tip part of each cleaning nozzle 126*a* is driven by a drive mechanism, such as a rack and pinion mechanism, so that the tip part can move forward and backward. When the tip part of each cleaning nozzle 126*a* is moved forward by the drive mechanism in one of the forward and backward direction, the tip part strikes the shutter 138 to apply pushing force to the shutter 138, thereby rotating and moving the shutter 138 in the direction Pa in which the shutter 138 is opened. The cleaning nozzles 126*a* are provided such as to protrude forward and outside through the opening-and-closing port 136 of the toilet seat 122. To the shutter 138, a biasing member, not illustrated, applies biasing force toward a position at which the opening-and-closing port 136 of the toilet seat 122 is closed. When each cleaning nozzle 126*a* is moved backward by the drive mechanism in the other of the forward and backward direction and the pushing force by the cleaning nozzle 126*a* is weakened, the biasing force by the biasing member rotates and moves the shutter 138 in the direction Pb in which the shutter 138 is closed.

The drying device 128 is disposed on one side in a left-and-right direction Y with respect to the private part cleaning device 126. The drying device 128 includes a blowing duct 128*a* provided with a blowing outlet 128*b* at a tip part. The drying device 128 can heat outside air introduced by driving a fan (not illustrated), by means of a heater (not illustrated). The drying device 128 can also blow out the heated outside air as dry air forward from the blowing outlet 128*b* of the blowing duct 128*a*.

The deodorizing device 130 is disposed on the other side in the left-and-right direction Y with respect to the private part cleaning device 126. The deodorizing device 130 includes a deodorizing duct 130*a* provided with a suction port 130*b* at a tip part. The deodorizing device 130 suctions odorous air through the suction port 130*b* with a fan (not illustrated) driven, and removes odors from the suctioned air by means of a deodorant, thereby deodorizing the air. When the shutter 138 is placed at the open position, the deodorizing device 130 suctions, through the suction port 130*b*, air that has passed through the opening-and-closing port 136 to remove odors from the air.

The private part cleaning device 126, functioning as a second functional component, can implement a certain function that the private part cleaning device 126 should implement, by means of the cleaning nozzles 126*a* that pass through the opening-and-closing port 136 of the toilet seat 122. The certain function is to clean the private part of the sitting person. The drying device 128 and the deodorizing device 130, also functioning as second functional components, can implement certain functions that the drying device 128 and the deodorizing device 130 should implement, with the air that passes through the opening-and-closing port 136 of the toilet seat 122. The certain function of the drying device 128 is to dry the buttocks of the sitting person and the reverse face of the toilet seat 122, and the certain function of the deodorizing device 130 is to remove odors from air.

Accordingly, compared to the case where the functional components are built into the casing 120, the functions of the functional components can be implemented more easily at positions closer to the middle position in a front-and-rear direction X of the toilet bowl 112. In the case of the private part cleaning device 126, the distance in a front-and-rear direction X required to extend the cleaning nozzles 126*a* to the positions where the cleaning nozzles 126*a* need to be located to clean the private part of the sitting person can be made smaller. This can also reduce the height of the cleaning nozzles 126*a*, compared to the case where the private part cleaning device 126 is built into the casing 120. In the case of the drying device 128 or the deodorizing device 130, the drying function or the deodorizing function can be effectively implemented at a position closer to the middle position in a front-and-rear direction X of the toilet bowl 112.

Figure 18:
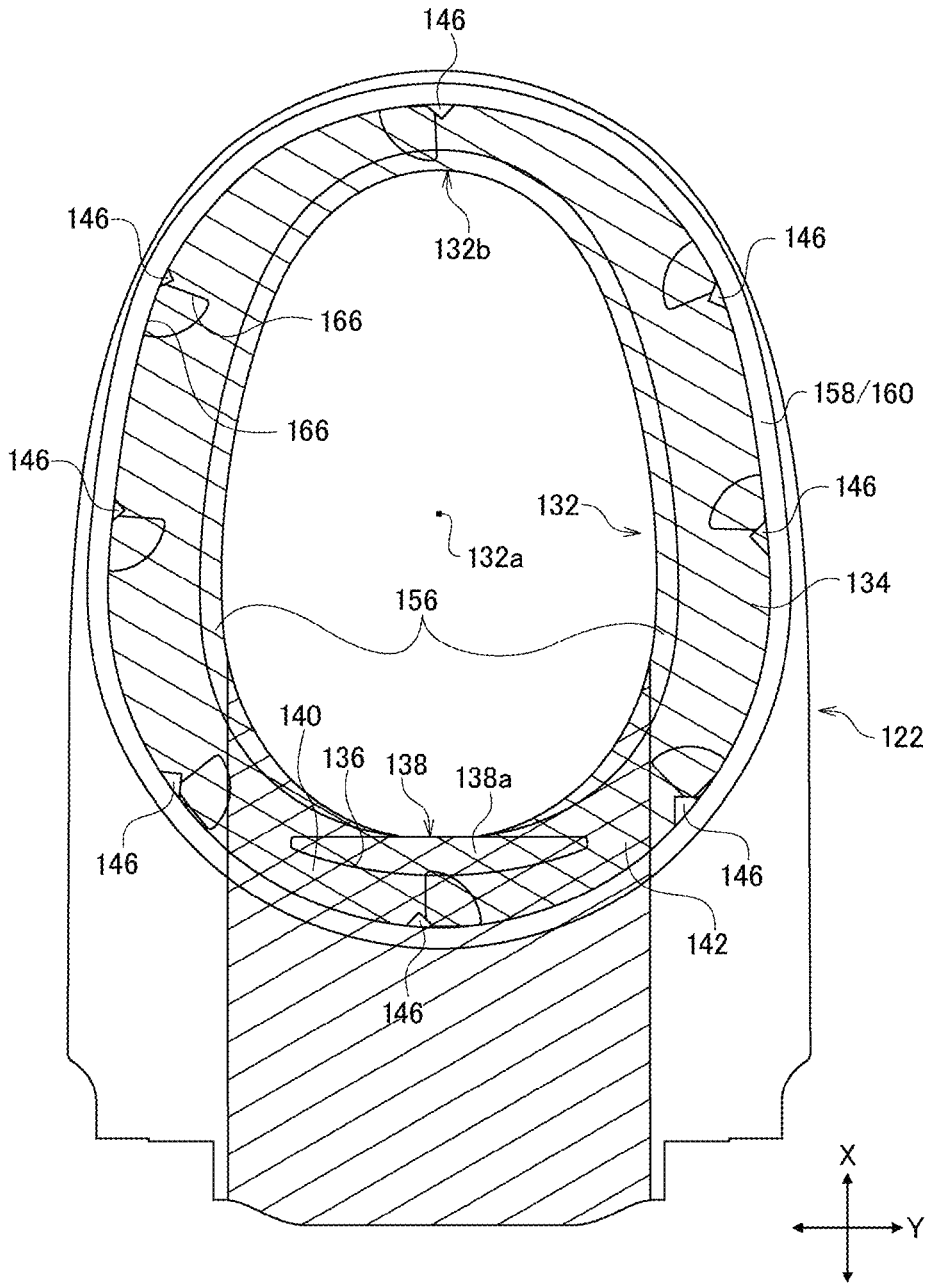
FIG. 18 is a bottom view that shows the reverse face of the toilet seat according to some embodiments.

FIG. 18 is a bottom view that shows the reverse face of the toilet seat 122 in the third embodiment. The toilet device 110 of some embodiments employs the following configuration to clean the reverse face of the toilet seat 122. When the reverse face of the toilet seat 122 is viewed, the reverse face has a rear-side reverse face area 142 provided at a position that overlaps, in a front-and-rear direction X, the center opening part 132 of the toilet seat 122 and in rear of the center opening part 132. The opening-and-closing port 136 of the toilet seat 122 described previously is formed in the rear-side reverse face area 142, and the shutter 138 described previously is provided in the rear-side reverse face area 142.

As is the case in some embodiments, the reverse face of the toilet seat 122 has the toilet bowl facing area 134. The toilet bowl facing area 134 is an area to which a splash of waste received in the toilet bowl 112 or a splash of cleaning liquid ejected from a cleaning nozzle 126*a* could adhere, so that the area could get dirty. In the toilet bowl facing area 134, an area that overlaps the rear-side reverse face area 142 is particularly likely to get dirty because of a splash of liquid waste.

Figure 19:
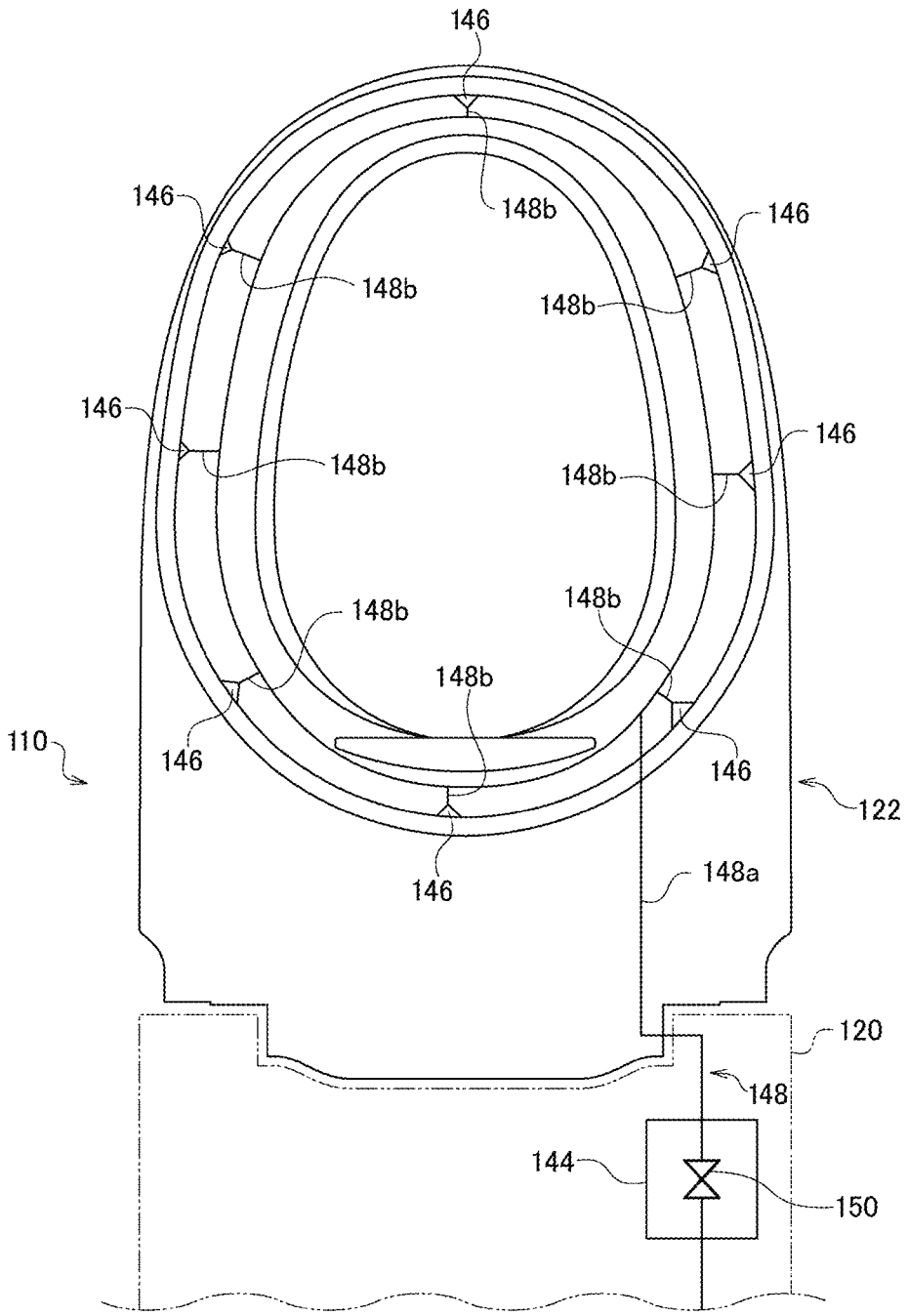
FIG. 19 is a configuration diagram that shows part of the functions of the toilet device according to some embodiments.

FIG. 19 is a configuration diagram that shows part of the functions of the toilet device 110. The toilet device 110 of some embodiments includes a liquid supply device 144 for supplying a cleaning liquid, and multiple discharge parts 146 from which the cleaning liquid can be discharged such as to spread on the reverse face of the toilet seat 122. The cleaning liquid in some embodiments is clean water made primarily of water, but may be made primarily of alcohol or the like other than water.

The liquid supply device 144 in some embodiments is accommodated in the casing 120. The liquid supply device 144 includes an on-off valve 150 that is provided midway along a liquid supply line 148 for supplying the cleaning liquid to the multiple discharge parts 146 and is capable of opening and closing the liquid supply line 148. The liquid supply line 148 is constituted by a hose or the like disposed within the casing 120 and the toilet seat 122. The liquid supply line 148 includes a common liquid line 148*a* disposed to pass inside the casing 120 and the toilet seat 122, and multiple branch liquid lines 148*b* that branch off from the common liquid line 148*a* within the toilet seat 122 and connect to the respective discharge parts 146.

Figure 20:
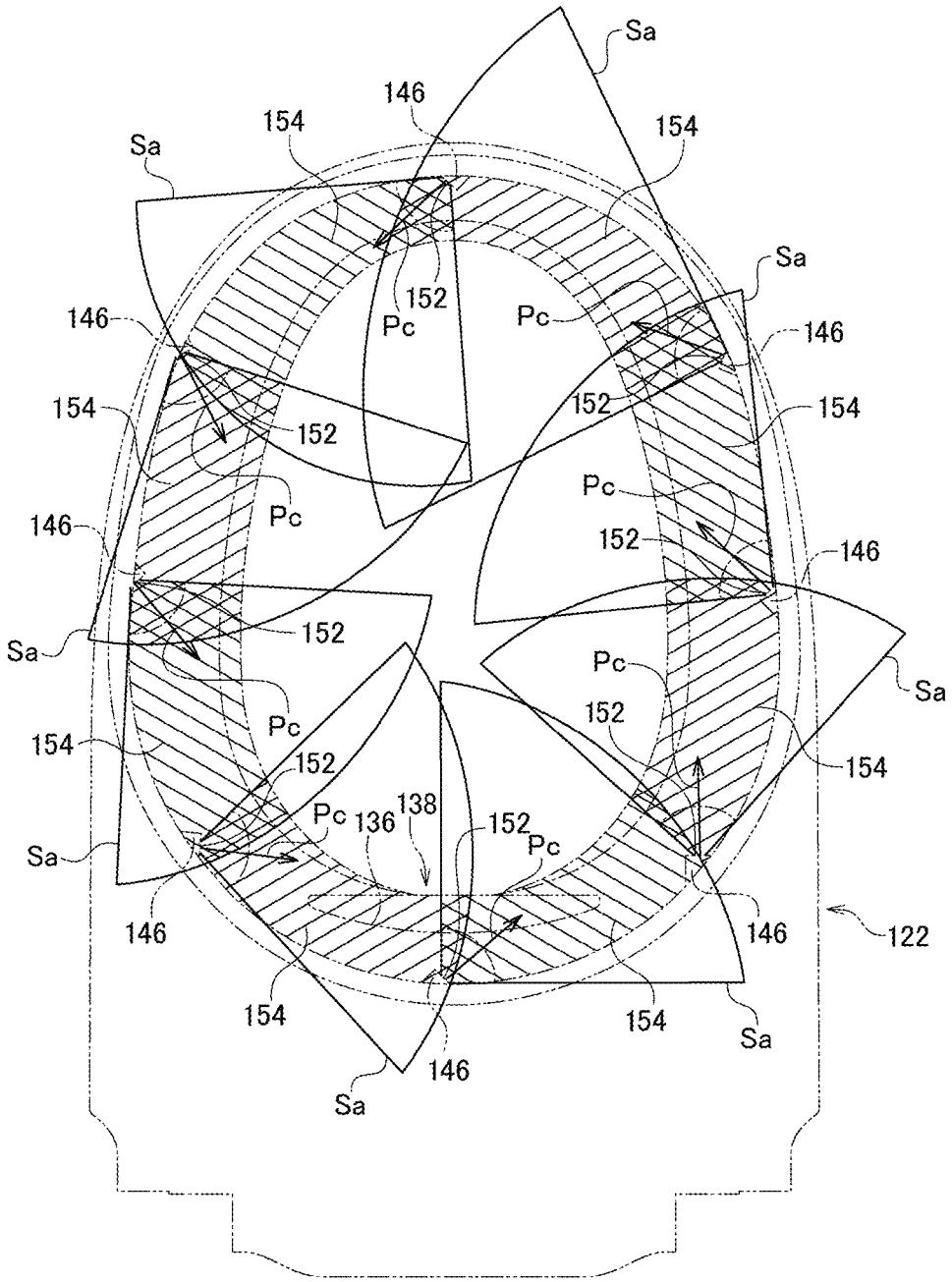
FIG. 20 is a diagram that schematically shows a range in which a cleaning liquid discharged from each discharge part spreads on the reverse face of the toilet seat according to some embodiments.

FIG. 20 is a diagram that schematically shows a range in which the cleaning liquid discharged from each discharge part 146 spreads on the reverse face of the toilet seat 122. The discharge parts 146 in some embodiments are provided such as to protrude downward from the reverse face of the toilet seat 122. Within each discharge part 146, part of a branch liquid line 148*b* is provided, and, at the downstream end of the branch liquid line 148*b*, a discharge outlet 152 is provided. The multiple discharge parts 146 are provided, with a space in between, along a circumferential direction of the toilet seat 122.

From each discharge part 146 in some embodiments, the cleaning liquid is discharged such as to at least spread over a liquid spread range 154 that extends from the discharge outlet 152 in a discharging direction Pc. In FIG. 20, a range Sa, over which the cleaning liquid discharged through a discharge outlet 152 could linearly spread on a virtual plane, is indicated by a solid line. In some embodiments, in the range Sa of the solid line, an area that overlaps the toilet bowl facing area 134 on the reverse face of the toilet seat 122 (the area with hatching) corresponds to the liquid spread range 154. The discharging direction Pc means a direction along the central axis line of the corresponding discharge outlet 152.

The total range of the liquid spread ranges 154 of the multiple discharge parts 146 is set such as to occupy the entirety of or a large part of the toilet bowl facing area 134 of the toilet seat 122 (see FIG. 18). The "large part" as used herein means 90 percent or more of the entire toilet bowl facing area 134 when the reverse face of the toilet seat 122 is viewed. It also can be considered that the total range of the liquid spread ranges 154 is set such as to form a continuous ring shape around the center opening part 132 of the toilet seat 122. In some embodiments, it also can be considered that the total range of the liquid spread ranges 154 is set such as to include a range in which the rear-side reverse face area 142 and the toilet bowl facing area 134 of the toilet seat 122 overlap each other (the range with double hatching in FIG. 18). From part of the multiple discharge parts 146, the cleaning liquid is discharged such as to spread on the rear-side reverse face area 142 of the toilet seat 122. The rear-side reverse face area 142 includes the outer surface of the shutter 138. Accordingly, it also can be considered that, from part of the discharge parts 146, the cleaning water is discharged such as to spread on the outer surface of the shutter 138.

To satisfy the conditions regarding the liquid spread range 154 as described above, the number, positions, the discharging direction Pc of the cleaning liquid, and the discharging ranges of the discharge parts 146 may be adjusted, for example. Also, to satisfy the conditions, a portion for leading the cleaning liquid discharged from each discharge part 146 may be provided. In any case, it is considered that the toilet seat unit 116, or the toilet device 110 including the toilet seat unit 116 is configured to satisfy the aforementioned conditions regarding the liquid spread range 154 through such adjustments.

The liquid spread range 154 of one discharge part 146 is set such as to overlap another discharge part 146 located adjacent to the one discharge part 146 in the discharging direction Pc and also to overlap the liquid spread range 154 of the another discharge part 146. In some embodiments, the discharging direction Pc of every discharge part 146 is set to one circumferential direction.

There will now be described the operations performed by the toilet device 110 set forth above. When predetermined cleaning start conditions are satisfied, the liquid supply device 144 opens the liquid supply line 148 by means of the on-off valve 150 and keeps it open for a predetermined liquid supply time. After the liquid supply time elapses, the liquid supply device 144 closes the liquid supply line 148. The cleaning start conditions include, as a first condition, the toilet seat 122 being placed at the laid position. For example, the toilet device 110 may be provided with a sensor for detecting whether or not the toilet seat 122 is placed in the laid position, and whether or not the first condition is satisfied may be determined based on the detection result of the sensor. The cleaning start conditions may include, as a second condition, a cleaning start instruction having been received. The cleaning start instruction may be provided through an operation performed on an operation member, such as a lever, or electrical equipment, such as a remote controller and a smartphone, for example.

When the on-off valve 150 opens the liquid supply line 148, the cleaning liquid is supplied from the liquid supply device 144 through the liquid supply line 148 to the discharge parts 146, so as to be discharged from the discharge parts 146. When the on-off valve 150 closes the liquid supply line 148, the supply of the cleaning liquid from the liquid supply device 144 is stopped. When the cleaning liquid is supplied to the discharge parts 146, the cleaning liquid is discharged from the discharge parts 146 such as to spread on the reverse face of the toilet seat 122.

As described previously, from part of the multiple discharge parts 146, the cleaning liquid is discharged such as to spread on the rear-side reverse face area 142 of the toilet seat 122. Accordingly, the rear-side reverse face area 142 of the toilet seat 122, which is particularly likely to get dirty, can be cleaned with the cleaning liquid, so that cleanliness of the reverse face of the toilet seat 122 can be more improved.

The toilet device 110 includes the shutter 138 that can open and close the opening-and-closing port 136 formed in the rear-side reverse face area 142 of the toilet seat 122. Accordingly, the cleaning operation for the rear-side reverse face area 142 of the toilet seat 122 can also clean the outer surface of the shutter 138. Particularly, there is the advantage of obtaining favorable cleanliness of the shutter 138 positioned in the rear-side reverse face area 142 of the toilet seat 122, which is likely to get dirty.

Also, the total range of the liquid spread ranges 154 of the multiple discharge parts 146 is set such as to form a continuous ring shape around the center opening part 132 of the toilet seat 122. Accordingly, a wide range of an area that could get dirty can be cleaned, so that the cleanliness of the reverse face of the toilet seat 122 can be more improved. Especially, since the total range is set such as to occupy the entirety of or a large part of the toilet bowl facing area 134, the cleanliness of the reverse face of the toilet seat 122 can be further improved.

Also, the shutter 138 includes the first flat surface 138*a* that constitutes a large part of the outer surface of the shutter 138. Accordingly, compared to the case where a large part of the outer surface of the shutter 138 has a three-dimensional-like structure, the cleaning liquid can be delivered to a wide range of the outer surface of the shutter 138 more easily.

Also, the first flat surface 138*a* of the shutter 138 is provided to be flush with the second flat surface 140 of the toilet seat 122 when the shutter 138 is placed at the closed position. Accordingly, the cleaning liquid can smoothly spread without getting caught on anything between the first flat surface 138*a* of the shutter 138 and the second flat surface 140 of the toilet seat 122, so that the cleaning liquid can be easily delivered to the entire outer surface of the shutter 138.

Figure 21:
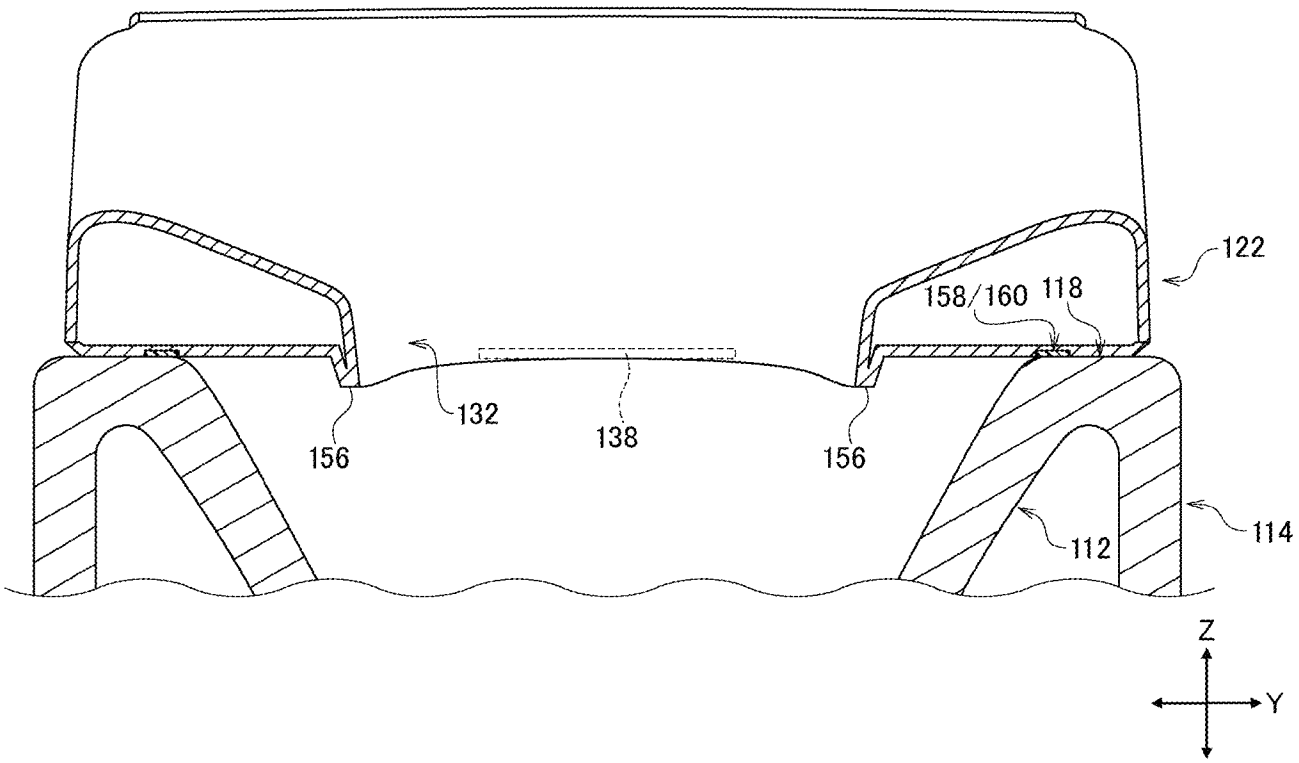
FIG. 21 is a sectional front view of the toilet device according to some embodiments.

Other features of the toilet device 110 will be described. FIG. 21 is a sectional front view of the toilet device 110 of some embodiments. As shown in FIGS. 18 and 21, the toilet seat 122 includes an inner circumferential-side convex part 156 that projects downward from an inner circumferential edge part of the reverse face of the toilet seat 122, based on the state where the toilet seat 122 is placed at the laid position. The inner circumferential-side convex part 156 in some embodiments is configured as part of a member constituted by another area of the reverse face of the toilet seat 122.

The inner circumferential-side convex part 156 is continuously provided along a circumferential direction in the inner circumferential edge part of the reverse face of the toilet seat 122. Specifically, the inner circumferential-side convex part 156 is continuously provided along a circumferential direction in a range including a front end part 132*b* of the center opening part 132 of the toilet seat 122. More specifically, the inner circumferential-side convex part 156 is continuously provided along a circumferential direction in a range including a front half circumferential portion 132*c* of the center opening part 132 of the toilet seat 122. The front half circumferential portion 132*c* is a portion of a range around the center position 132*a* of the center opening part 132 of the toilet seat 122 when the reverse face of the toilet seat 122 is viewed, and the portion is a continuous range with an angle of 90 degrees around the center position 132*a* on each of the both sides along a circumferential direction with respect to the front end part 132*b* of the center opening part 132. Also, the inner circumferential-side convex part 156 may be continuously provided along the entire circumferential portion of the center opening part 132 of the toilet seat 122.

When the cleaning liquid is made to spread on the reverse face of the toilet seat 122, the outer circumferential surface of the inner circumferential-side convex part 156 can lead the cleaning liquid to spread downward. The outer circumferential surface of the inner circumferential-side convex part 156 in some embodiments is a smoothly-curved surface extending downward toward the radially inner side. Accordingly, the cleaning liquid spreading on the reverse face of the toilet seat 122 can be stopped at the tip part of the inner circumferential-side convex part 156, thereby preventing the cleaning liquid spreading from the reverse face to the top face of the toilet seat 122.

The inner circumferential-side convex part 156 is provided to be positioned lower than the upper surface of the rim part 118 of the toilet body 114 in a vertical direction Z. The inner circumferential-side convex part 156 is provided such as to cover, from the radially inner side, a gap between the rim part 118 of the toilet body 114 and the toilet seat 122. Accordingly, a splash of waste received in the toilet bowl 112 can be caught by the inner circumferential-side convex part 156, thereby preventing waste remaining between the toilet body 114 and the toilet seat 122.

The toilet device 110 includes a flow regulation structure 158 for regulating a flow of cleaning liquid, spreading on the reverse face of the toilet seat 122, toward the radially outer side. More specifically, the flow regulation structure 158 regulates a flow of cleaning liquid toward the radially outer side through the gap between the rim part 118 of the toilet body 114 and the toilet seat 122. The flow regulation structure 158 in some embodiments is a seal member 160 disposed between the rim part 118 of the toilet body 114 and the toilet seat 122. The seal member 160 is an elastic body, such as rubber. The seal member 160 is provided between the rim part 118 of the toilet body 114 and the toilet seat 122 to seal the gap therebetween, thereby regulating the flow of cleaning liquid as described above.

The seal member 160 is provided such as to form a continuous ring shape around the center opening part 132 of the toilet seat 122. When the reverse face of the toilet seat 122 is viewed, all the discharge parts 146 on the reverse face of the toilet seat 122 are provided to be positioned on the radially inner side with respect to the seal member 160. Accordingly, the cleaning liquid discharged from each of the multiple discharge parts 146 and spreading on the reverse face of the toilet seat 122 does not flow outward from the flow regulation structure 158 of a ring shape and remains inside the flow regulation structure 158. Thus, the flow regulation structure 158 of a ring shape is provided to allow the cleaning liquid discharged from each of the multiple discharge parts 146 to remain inside the flow regulation structure 158.

Figure 22:
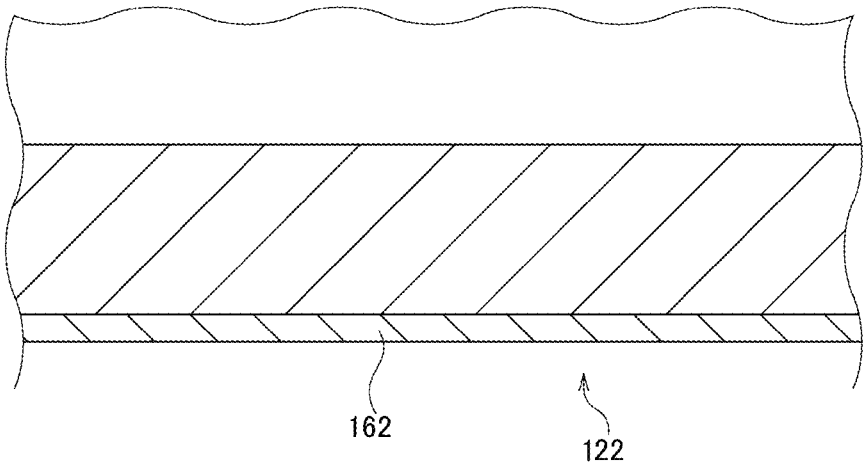
FIG. 22 is a partial sectional view of the reverse face of the toilet seat according to some embodiments.

FIG. 22 is a partial sectional view of the reverse face of the toilet seat 122. The toilet seat 122 includes a liquid repellent layer 162 with which the reverse face of the toilet seat 122 is coated, in a range where the cleaning liquid discharged from the discharge parts 146 spreads. The liquid repellent layer 162 constitutes the outermost surface of the reverse face of the toilet seat 122 and has liquid repellency for repelling the cleaning liquid that adheres to the surface. In some embodiments, on the reverse face of the toilet seat 122, the toilet bowl facing area 134 is coated with the liquid repellent layer 162. The toilet bowl facing area 134 is also considered to be an area surrounded by the seal member 160 of a ring shape on the reverse face of the toilet seat 122.

The liquid repellent layer 162 in some embodiments contains a fluorine-based water repellent, a silicon-based water repellent, or the like as a major component, and has the property of repelling clean water made primarily of water. Accordingly, after the reverse face of the toilet seat 122 is cleaned with the cleaning liquid, the cleaning liquid can be separated early from the reverse face of the toilet seat 122, so that the reverse face of the toilet seat 122 can be dried faster. Further, the outer surface of the seal member 160 may also be coated with the liquid repellent layer 162 in the range where the cleaning liquid spreads.

Figure 23A:
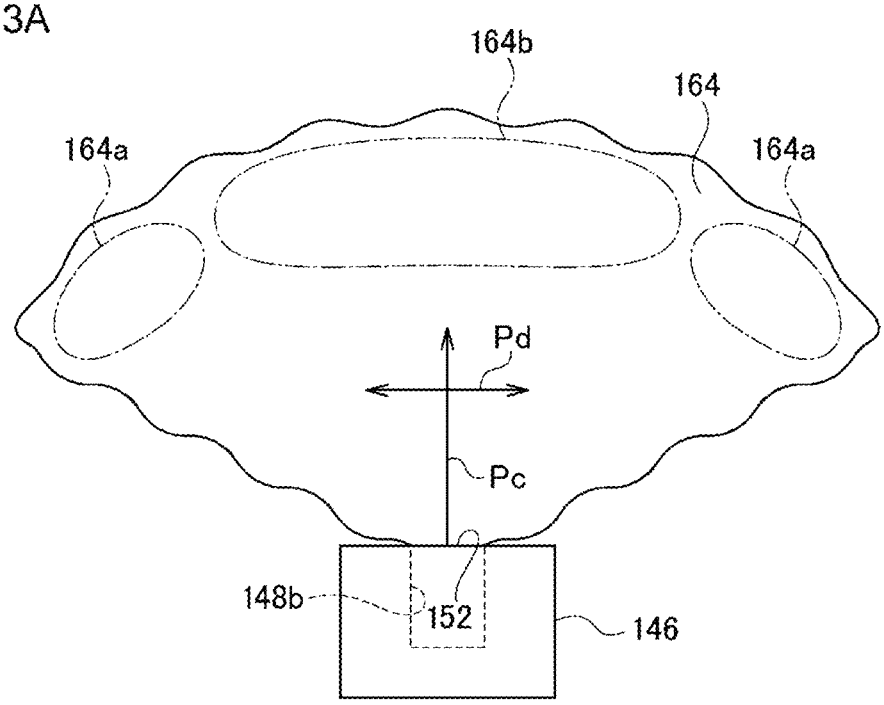
FIG. 23A is a diagram that schematically shows how the cleaning liquid spreads on the reverse face of the toilet seat according to some embodiments.
Figure 23B:
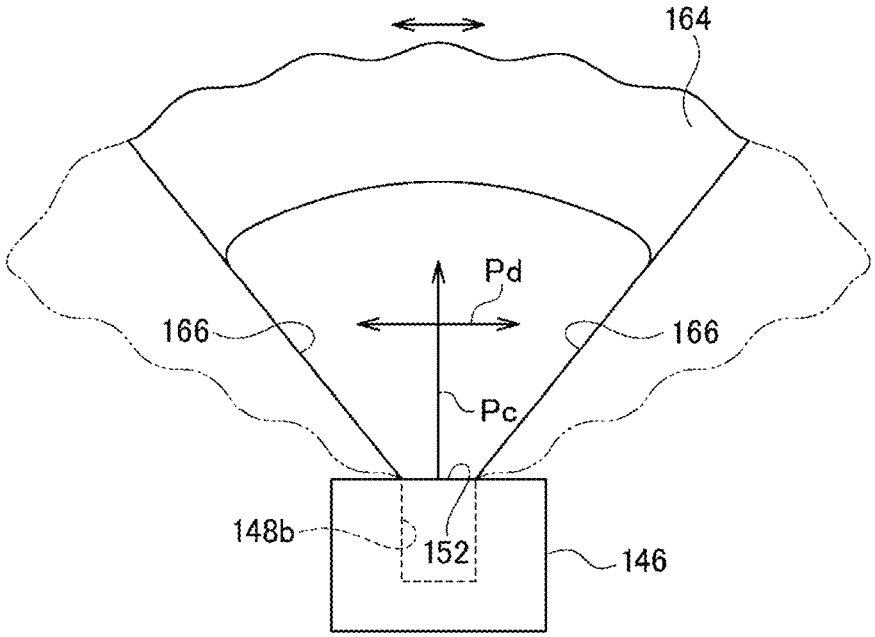
FIG. 23B is a diagram that schematically shows how the cleaning liquid spreads on the reverse face of the toilet seat according to some embodiments.

FIGS. 23A and 23B are diagrams that each schematically show how a cleaning liquid 164 spreads on the reverse face of the toilet seat 122. FIG. 23A shows a discharge part 146 in a second modification, and FIG. 23B shows a discharge part 146 in some embodiments.

When the reverse face of the toilet seat 122 is viewed, a horizontal direction perpendicular to the discharging direction Pc from a discharge part 146 is defined as a widening direction Pd. The inventors have found that, when the cleaning liquid 164 is discharged such as to spread on the reverse face of the toilet seat 122, the flow of the cleaning liquid 164 is likely to be turbulent immediately after the cleaning liquid 164 is discharged from a discharge part 146, so that the cleaning liquid 164 tends to easily spread in the widening direction Pd. When the cleaning liquid 164 widely spreads in the widening direction Pd, the flow volume of the cleaning liquid 164, spreading on the reverse face of the toilet seat 122, in both side parts 164*a* in a widening direction Pd becomes larger than the flow volume thereof in a middle part 164*b*. Accordingly, the flow volume of the cleaning liquid 164 tends to largely vary depending on the position in a widening direction Pd.

Figure 24A:
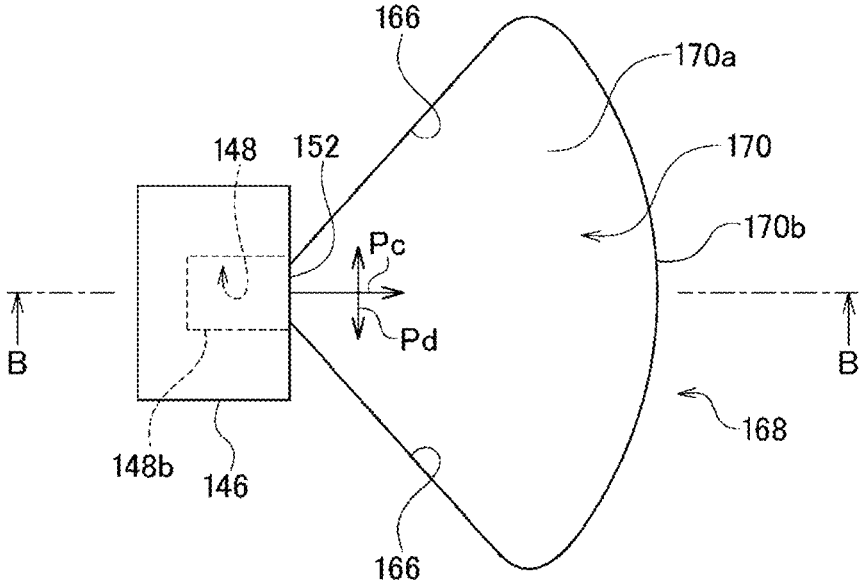
FIG. 24A shows a discharge part and FIG. 24B is a sectional view taken along line B-B in FIG. 24A according to some embodiments.
Figure 24B:
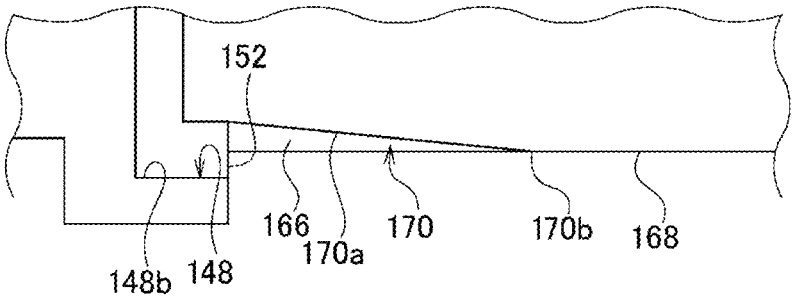

Countermeasures thereto will be described. FIG. 24A shows a discharge part 146 in some embodiments, and FIG. 24B is a sectional view taken along line B-B in FIG. 24A. The toilet seat 122 in some embodiments includes a pair of leading parts 166. After the cleaning liquid is discharged from a discharge part 146 in the discharging direction Pc, the pair of leading parts 166 can regulate the spread of the cleaning liquid toward the both sides in the widening direction Pd and also can lead the cleaning liquid in the discharging direction Pc.

The pair of leading parts 166 are provided for each of the multiple discharge parts 146. The pair of leading parts 166 are provided near the corresponding discharge part 146. The pair of leading parts 166 in some embodiments are stepped surfaces that project downward from the reverse face of the toilet seat 122 placed at the laid position. On the reverse face of the toilet seat 122 in some embodiments, a recess part 170 is formed to be recessed upward from a circumferential edge surface 168, which is part of the reverse face of the toilet seat 122. The pair of leading parts 166 are constituted by recess side surfaces of the recess part 170 formed on the reverse face of the toilet seat 122. A recess bottom surface 170*a* of the recess part 170 is an inclined surface that inclines downward from the discharge outlet 152 of a discharge part 146 toward the discharging direction Pc. An end side part 170*b* of the recess bottom surface 170*a*, located on the side in the discharging direction Pc, is provided continuously with the circumferential edge surface 168 of the reverse face of the toilet seat 122 without a step. The pair of leading parts 166 are formed to be spaced away from each other in the widening direction Pd, toward the discharging direction Pc away from the discharge part 146. The recess bottom surface 170*a* of the recess part 170, which is the reverse face of the toilet seat 122 provided continuously with the discharge outlet 152, is provided to be continuous with an inner upper surface of the liquid supply line 148 within the discharge part 146 without a step.

As shown in FIG. 23B, when the cleaning liquid 164 discharged from a discharge part 146 spreads on the reverse face of the toilet seat 122, the cleaning liquid 164 flows along the pair of leading parts 166, so that the spread of the cleaning liquid 164 toward the both sides in the widening direction Pd can be regulated. The flow of the cleaning liquid 164 is aligned while the cleaning liquid 164 flows along the pair of leading parts 166, so that, when the cleaning liquid 164 flows away from the pair of leading parts 166, the cleaning liquid 164 is less likely to widely spread toward the both sides in the widening direction Pd. Accordingly, wide spread of the cleaning liquid 164 in the widening direction Pd can be prevented, thereby reducing large differences in flow volume of the cleaning liquid 164 spreading on the reverse face of the toilet seat 122, among the positions in a widening direction Pd. As a result, this can reduce the occurrence of inconsistency in cleaning due to differences in flow volume of the cleaning liquid 164 among the positions in a widening direction Pd.

Figure 25:
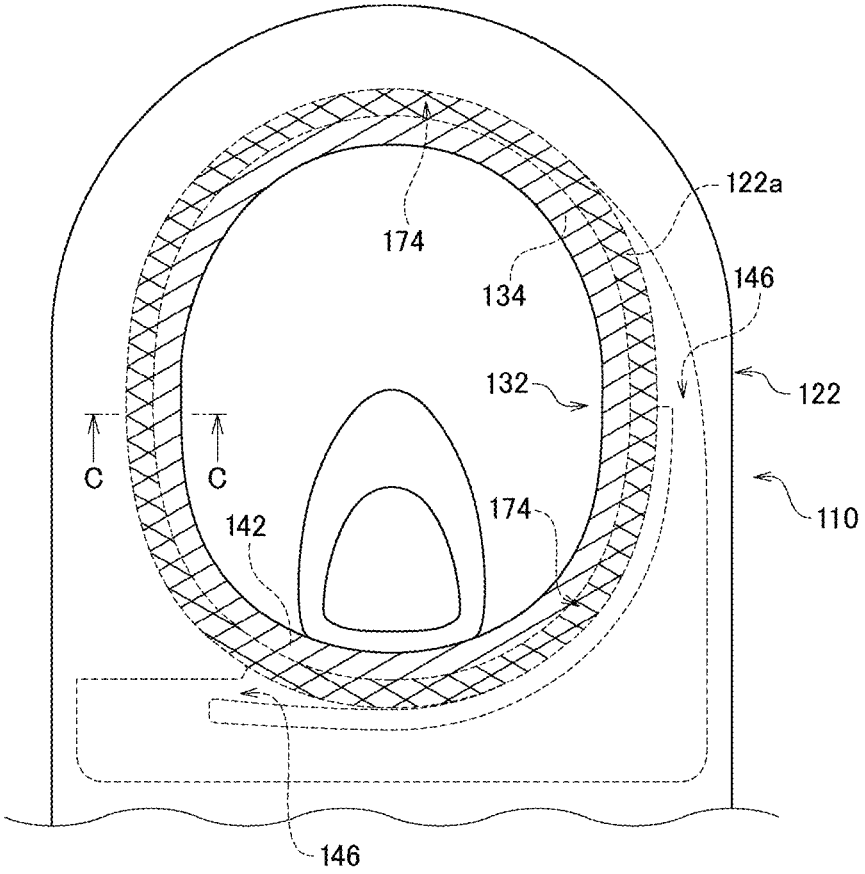
FIG. 25 is a top view of the toilet device according to some embodiments.
Figure 26:
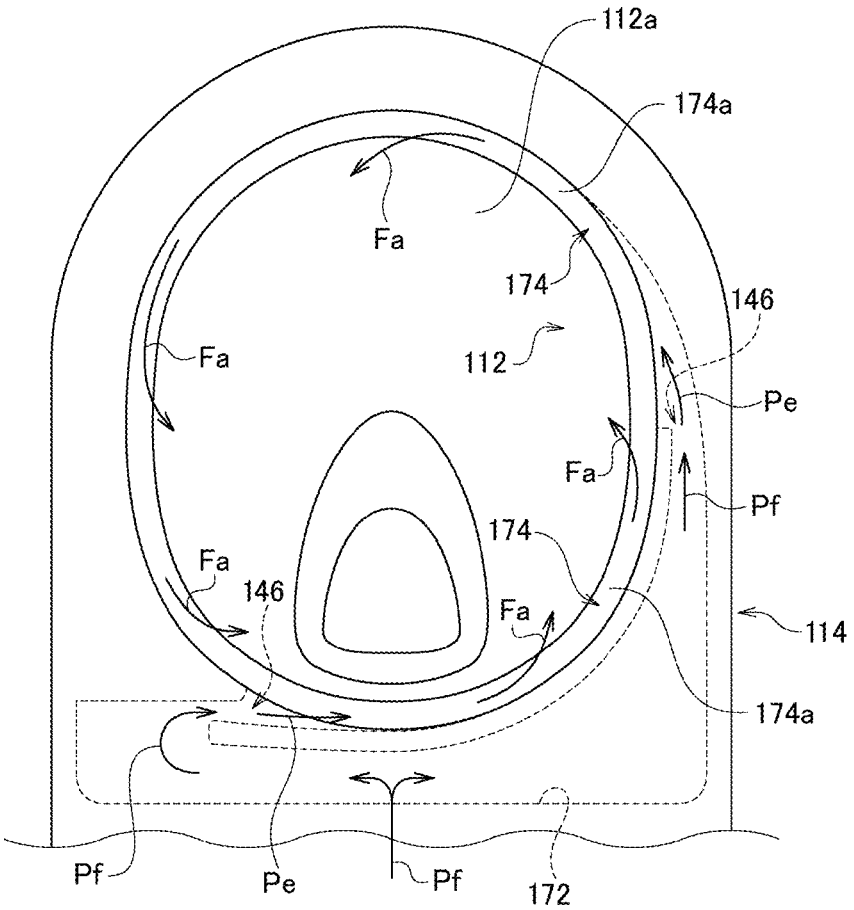
FIG. 26 is a top view of the toilet body according to some embodiments.
Figure 27:
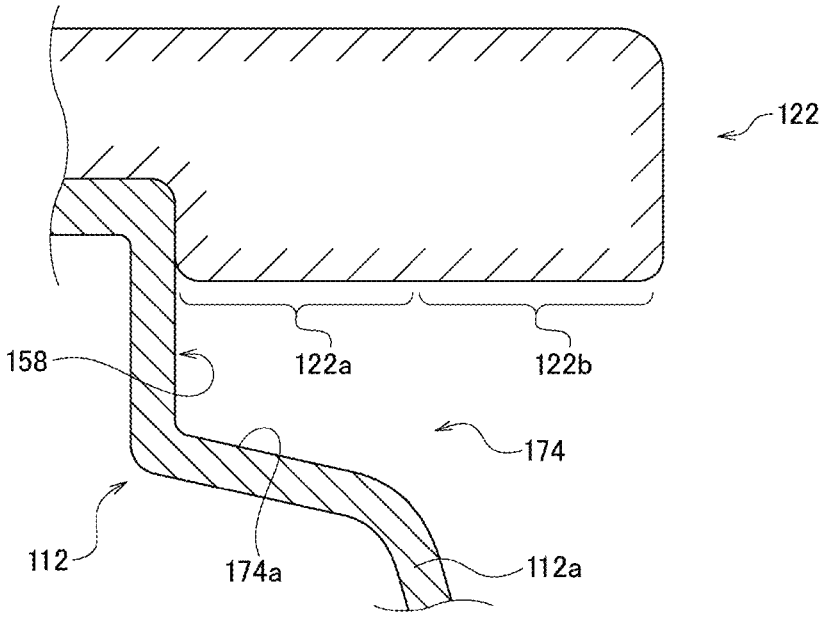
FIG. 27 is a sectional view taken along line C-C in FIG. 25 according to some embodiments.

FIG. 25 is a top view of the toilet device 110 of some embodiments. FIG. 26 is a top view of the toilet body 114. FIG. 27 is a sectional view taken along line C-C in FIG. 25. The toilet device 110 of some embodiments differs from that of the aforementioned embodiment in providing the discharge parts 146 in the toilet body 114, instead of in the toilet seat 122. Also, the toilet seat 122 in some embodiments is not provided with the shutter 138.

The toilet body 114 includes multiple discharge parts 146 formed in an upper part of the toilet bowl 112. Cleaning water as a cleaning liquid is discharged from each discharge part 146 along a direction Pe, forming a flow Fa of water for flushing the inner surface of the toilet bowl 112. The discharge parts 146 in some embodiments form, as the flow Fa of water for flushing an inner portion of the toilet bowl 112, a swirling flow that swirls along one circumferential direction within the toilet bowl 112. To each discharge part 146, the cleaning water is supplied along a direction Pf from a cleaning water supply device through a water passage 172 formed in the toilet body 114.

The toilet bowl 112 includes a receiving surface part 112*a* of a bowl-like shape configured to receive waste, and a water conduit 174 is formed in an upper end part of the toilet bowl 112. The water conduit 174 includes a shelf part 174*a* configured to receive cleaning water. The shelf part 174*a* is formed to have a gradient gentler than that of an inner circumferential surface portion of the receiving surface part 112*a* provided continuously with the lower side of the shelf part 174*a*. The water conduit 174 is provided for each of the multiple discharge parts 146 and formed to extend from the corresponding discharge part 146 in the one circumferential direction. The water conduits 174 are provided to lead the cleaning water to swirl and flow in the one circumferential direction. Each water conduit 174 in some embodiments is formed to be continuous with another water conduit 174 located adjacent to the water conduit 174 in the one circumferential direction. Accordingly, the multiple water conduits 174 as a whole are formed to be continuous in a ring shape.

The reverse face of the toilet seat 122 includes a conduit forming surface 122*a* that forms an inner upper surface of each water conduit 174. The conduit forming surface 122*a* is the area with double hatching in FIG. 25. The conduit forming surface 122*a* constitutes part of the toilet bowl facing area 134 described previously. The toilet bowl facing area 134 is the area with hatching in FIG. 25. The cleaning water discharged from the discharge parts 146 spreads on the conduit forming surface 122*a*, which is part of the reverse face of the toilet seat 122, and is also led by the water conduits 174. Thus, the cleaning water is led radially inward while spreading on the conduit forming surface 122*a*, and further flows to spread on another area 122*b* of the toilet bowl facing area 134 located on the radially inner side with respect to the conduit forming surface 122*a*. As a result, the total range of the liquid spread ranges 154 of the multiple discharge parts 146 occupies the entirety of the toilet bowl facing area 134 of the toilet seat 122.

In this way, the total range of the liquid spread ranges 154 of the multiple discharge parts 146 is set such as to occupy the entirety of the toilet bowl facing area 134 of the toilet seat 122. It also can be considered that the total range of the liquid spread ranges 154 is set such as to form a continuous ring shape around the center opening part 132 of the toilet seat 122. From the multiple discharge parts 146, the cleaning liquid is discharged such as to spread on the rear-side reverse face area 142 of the toilet seat 122.

The flow regulation structure 158 in some embodiments is the upper end part of the toilet bowl 112 that regulates a flow of cleaning water spreading toward the radially outer side on the reverse face of the toilet seat 122.

The disclosure has been described based on some embodiments. In the following, modifications of individual constituting elements will be described.

The toilet seat 122 is rotatably attached to the toilet body 114 via the casing 120 in the example described above. However, the toilet seat 122 may be rotatably attached directly to the toilet body 114. Also, the toilet seat 122 may be attached to the toilet body 114 to be unable to rotate. In this case, the toilet seat 122 may be detachably attached to the toilet body 114.

When the opening-and-closing port 136 of the toilet seat 122 is opened or closed, the movement of the shutter 138 is not particularly limited. For example, the shutter 138 may be slid to open or close the opening-and-closing port 136. Also, the first flat surface 138*a* of the shutter 138 and the second flat surface 140 of the toilet seat 122 may be provided at positions to be not flush with each other. Also, the surface area 143 including the outer surface of the shutter 138 and the second flat surface 140 of the toilet seat 122 may be partially provided around the center opening part 132 of the toilet seat 122, instead of forming a ring shape. To obtain the aforementioned effect, the second flat surface 140 of the toilet seat 122 has only to be continuous in a ring shape, and a convex part, such as a leg part, may be provided in part of the second flat surface 140. Also, the shutter 138 may constitute the inner circumferential surface 132*d* of the center opening part 132 of the toilet seat 122.

To obtain the aforementioned effect, the range 51 of the shutter 138, occupying a large part of the shutter 138, has only to be located in rear of the inner circumferential surface 132*d* of the toilet seat 122 and at a position that overlaps the inner circumferential surface 132*d* when the toilet seat 122 is viewed from the front side. For example, the range 51 of the shutter 138 occupying a large part of the shutter 138 may partially stick out downward from the lower end part of the inner circumferential surface 132*d* of the toilet seat 122.

The kind of a functional component accommodated in the toilet seat 122 is not particularly limited. Within the toilet seat 122, only one of the private part cleaning device 126, the deodorizing device 130, and the drying device 128 may be accommodated, or a different functional component may be accommodated.

Each discharge part 146 has only to be configured such that the cleaning liquid can be discharged therefrom to spread on at least part of the rear-side reverse face area 142 of the toilet seat 122. For example, each discharge part 146 may be configured such that the cleaning liquid can be discharged therefrom to spread on only a range of the rear-side reverse face area 142 that overlaps the toilet bowl facing area 134 of the toilet seat 122.

To obtain the aforementioned effect, instead of the liquid spread ranges 154 of the multiple discharge parts 146, the liquid spread range 154 in which the cleaning liquid discharged from a single discharge part 146 spreads on the reverse face of the toilet seat 122 may be set such as to form a continuous ring shape around the center opening part 132 of the toilet seat 122.

The inner circumferential-side convex part 156 has only to be configured to project downward from the inner circumferential edge part of the reverse face of the toilet seat 122, based on the state where the toilet seat 122 is placed at the laid position, and the shape of the inner circumferential-side convex part 156 is not particularly limited. For example, the inner circumferential surface of the inner circumferential-side convex part 156 may be a plane surface simply extending downward, instead of a curved surface.

When the disclosure embodied by some embodiments and modifications set forth above are generalized, the following technical ideas are derived.

In some embodiments, the shutter may include a first flat surface that constitutes a large part of an outer surface of the shutter. In this aspect, a large part of the outer surface of the shutter is constituted by the first flat surface that has a two-dimensional-like structure with less unevenness. Therefore, the movement of fingers at the time of wiping down the outer surface of the shutter can be made smaller, so that favorable cleanability can be obtained.

In some embodiments, the toilet seat may include a second flat surface that constitutes the reverse face of the toilet seat and that has the opening-and-closing port formed thereon, and the first flat surface may be provided to be flush with the second flat surface when the shutter is placed at a closed position at which the opening-and-closing port is closed. In this aspect, a person can wipe down the first flat surface of the shutter and the second flat surface of the toilet seat without getting caught on anything therebetween, so that more favorable cleanability can be obtained.

In some embodiments, a surface area that includes the outer surface of the shutter and the second flat surface may be provided such as to form a continuous ring shape around the center opening part of the toilet seat. In this aspect, even when the shutter is attached to the toilet seat, a person can easily wipe down the area around the center opening part of the toilet seat over the entire circumference, without getting caught on anything.

In some embodiments, the shutter may be provided at a position hidden by the inner circumferential surface of the center opening part of the toilet seat when the toilet seat placed at the laid position is viewed from the front side. In this aspect, even when the shutter is attached to the toilet seat, the shutter is less likely to appear in an external view when the toilet seat is placed at the laid position, so that neat appearance can be achieved, and favorable design properties can be obtained.

In some embodiments, the toilet seat unit may further include a deodorizing device accommodated in the toilet seat, and, when the shutter is placed at an open position at which the opening-and-closing port is open, the deodorizing device may remove odors from air that has passed through the opening-and-closing port. In this aspect, compared to the case where the deodorizing device is built into a functional device provided in a rear part of the toilet body, the deodorizing function can be implemented more effectively at a position closer to the middle position of the toilet bowl.

Another embodiment of the disclosure will be described.

Figure 28:
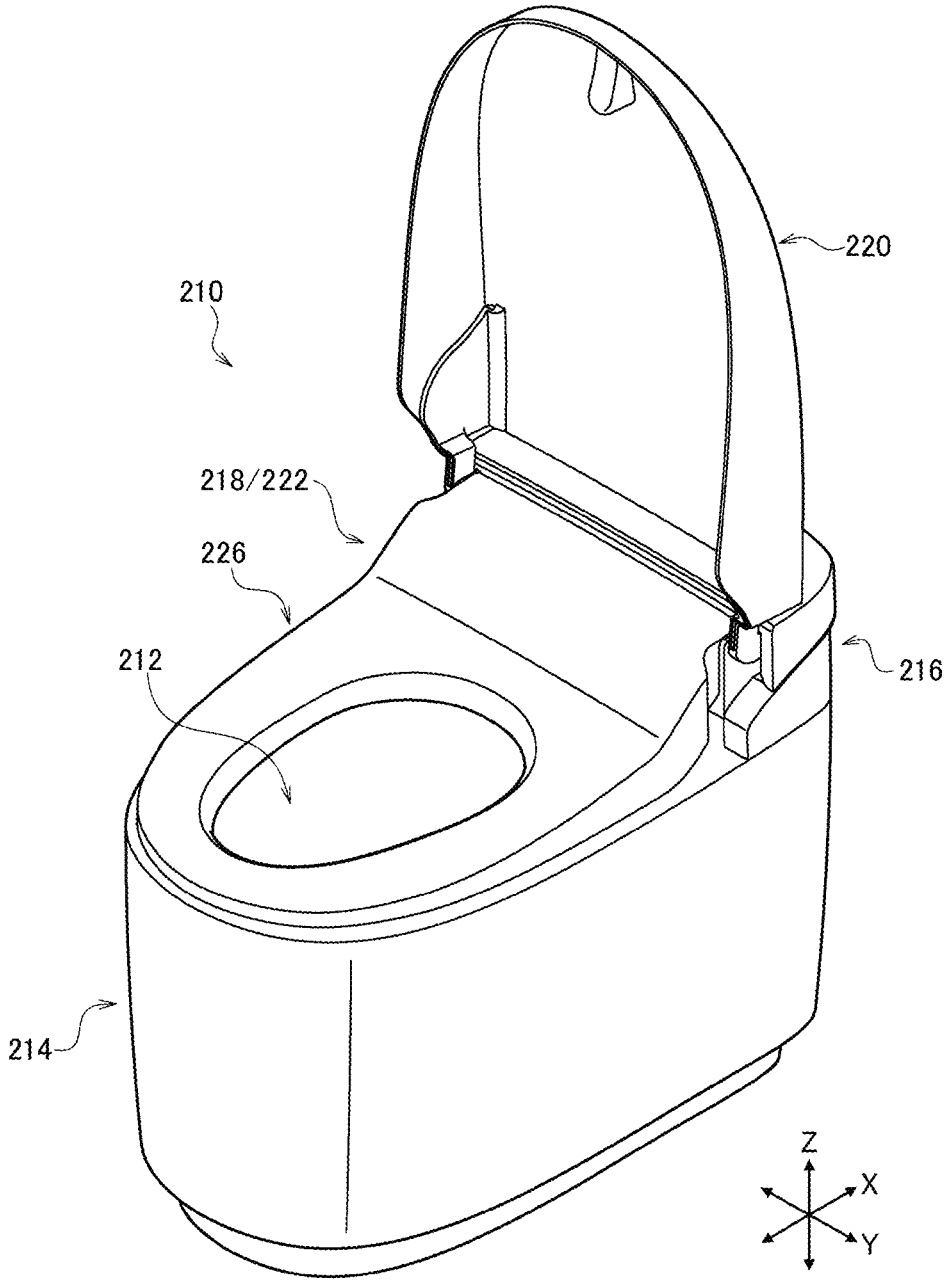
FIG. 28 is a perspective view of a toilet device according to some embodiments.

FIG. 28 is a perspective view of a toilet device 210 of some embodiments. The toilet device 210 includes a toilet body 214 that includes a toilet bowl 212 in a front part, a casing 216 provided in a rear part of the toilet body 214, and a toilet seat 218 rotatably attached to the casing 216 via a hinge mechanism (not illustrated). The casing 216 accommodates multiple first functional components, which are not illustrated. To the casing 216, a toilet lid 220 is rotatably attached via a hinge mechanism (not illustrated).

Figure 29:
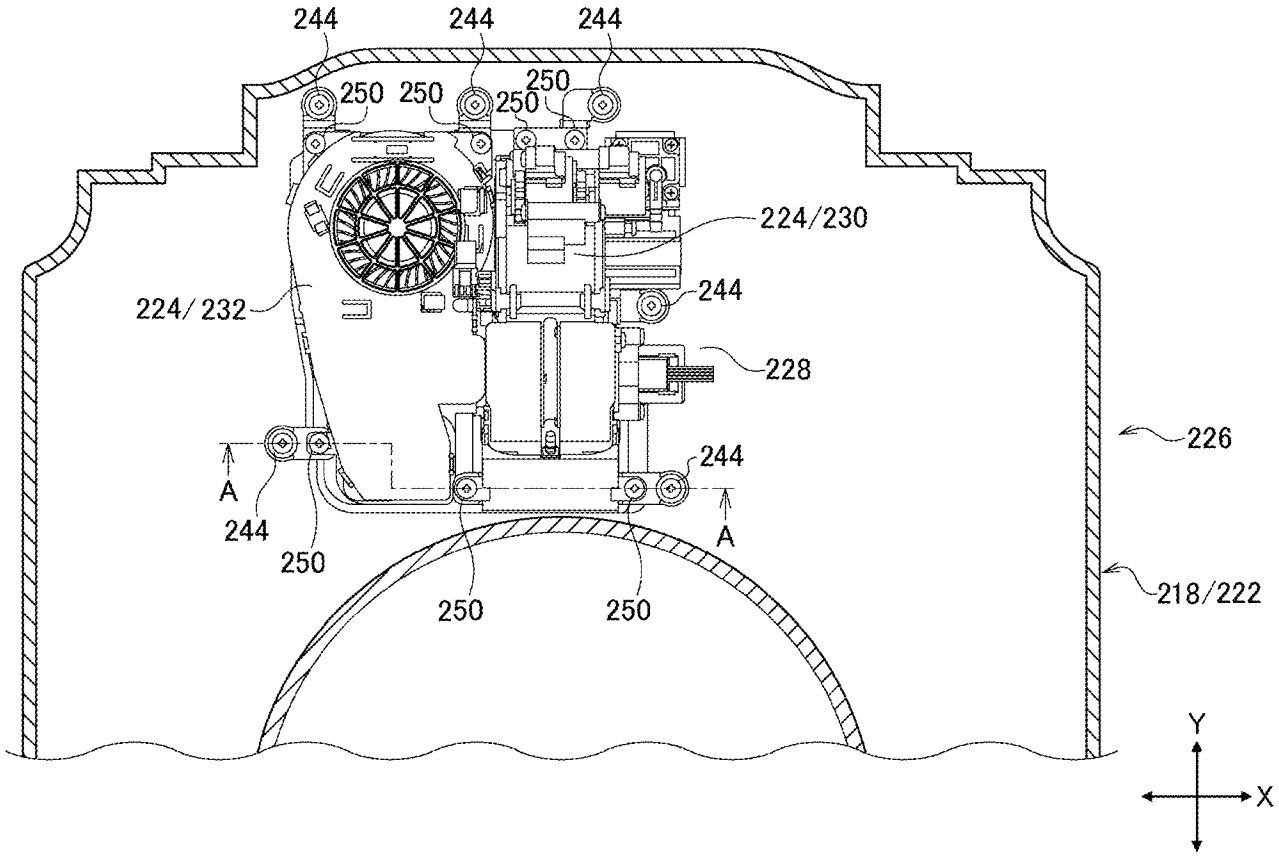
FIG. 29 is a top view that shows an internal structure of part of the toilet seat according to some embodiments.

FIG. 29 is a top view that shows an internal structure of part of the toilet seat 218. The toilet device 210 includes a functional device 226. The functional device 226 includes a base member 222 having a hollow structure, and multiple second functional components 224 accommodated in the base member 222. The base member 222 in some embodiments is the toilet seat 218. It can be considered that the base member 222 in some embodiments is movably attached to the toilet body 214 via the casing 216.

The toilet seat 218 as a whole has a ring shape having a hollow structure. Within the toilet seat 218, a cavity part is provided continuously in a circumferential direction, and, within a rear part of the cavity part, the multiple second functional components 224 are accommodated. On an inner lower surface part in a rear part of the toilet seat 218, a base part 228 for supporting the multiple second functional components 224 is provided.

The functional components are provided to implement certain functions associated with the toilet device 210. The functional components include a private part cleaning device 230 for implementing the function to clean the private part of the sitting person sitting on the toilet seat 218, and a drying device 232 for implementing the function to blow dry air to dry the sitting person, for example. Although not illustrated, the functional components also include a drive device for rotating the toilet seat 218 or the toilet lid 220, and a water supply device for supplying water used for cleaning to the private part cleaning device 230 or the like, for example. The casing 216 accommodates the abovementioned drive device and water supply device as the first functional components. The toilet seat 218 accommodates the private part cleaning device 230 and the drying device 232 as the second functional components 224.

Figure 30:
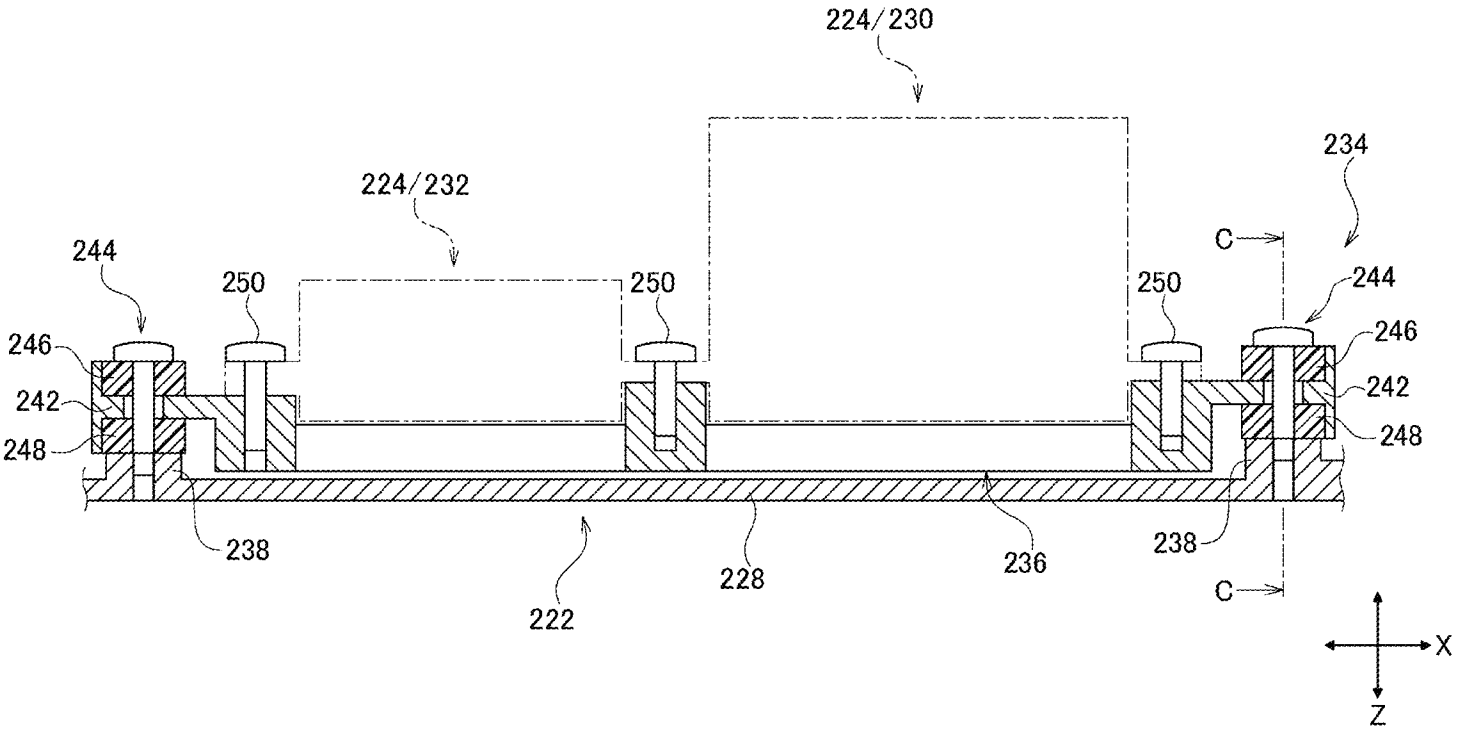
FIG. 30 is a sectional view taken along line A-A in FIG. 29 according to some embodiments.

FIG. 30 is a sectional view taken along line A-A in FIG. 29. The second functional components 224 are arranged to be spaced away from the base part 228, at positions facing the base part 228 in one of first direction (hereinafter, referred to as Z direction). The Z direction also correspond to a pressing direction Za in which a pressing member 244, described later, presses, and an anti-pressing direction Zb opposite to the pressing direction Za. The Z direction also correspond to axial direction of a shaft part 244*a* of the pressing member 244. The Z direction in some embodiments is vertical direction, and the base part 228 is positioned on the lower side, which is one side in a Z direction, and the second functional components 224 are positioned on the upper side, which is the other side in the Z direction. Two kinds of directions perpendicular to the Z direction are referred to as X direction and Y direction, which may be collectively referred to as XY directions.

The functional device 226 also includes a supporting structure 234, besides the aforementioned base part 228 and multiple second functional components 224. The supporting structure 234 allows the base part 228 to support the second functional components 224 to be relatively movable. The supporting structure 234 includes a support member 236, a receiving part 238, a fixed part 242, the pressing member 244, and multiple impact absorption members 246 and 248.

Figure 31:
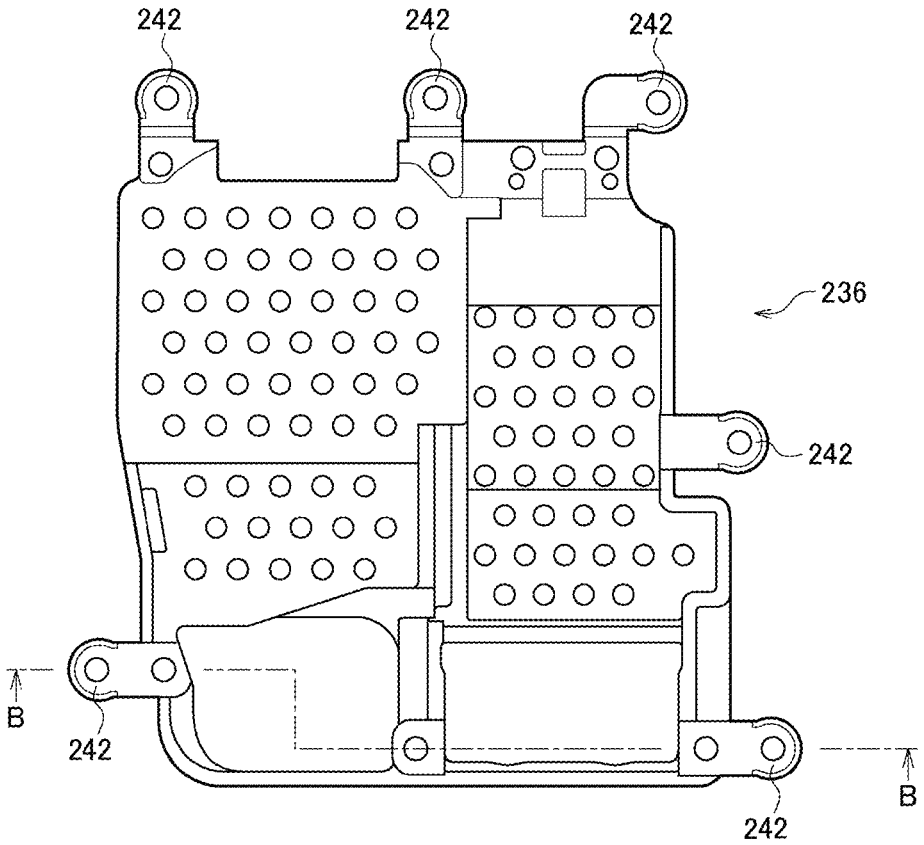
FIG. 31 shows a support member viewed from a Z direction according to some embodiments

FIG. 31 shows the support member 236 viewed from a Z direction. FIG. 30 is a sectional view of the support member 236 taken along line B-B in FIG. 31. As shown in FIGS. 30 and 31, the support member 236 is supported by the base part 228 to be relatively movable, and the support member 236 supports the multiple second functional components 224. The support member 236 in some embodiments as a whole has a plate shape. The support member 236 is disposed between the base part 228 and the multiple second functional components 224, to be spaced away from the base part 228. Each second functional component 224 is joined to the support member 236 to be not relatively movable, by means of a connector 250, such as a screw member. Each second functional component 224 in some embodiments is joined to the support member 236 at multiple positions.

Figure 32:
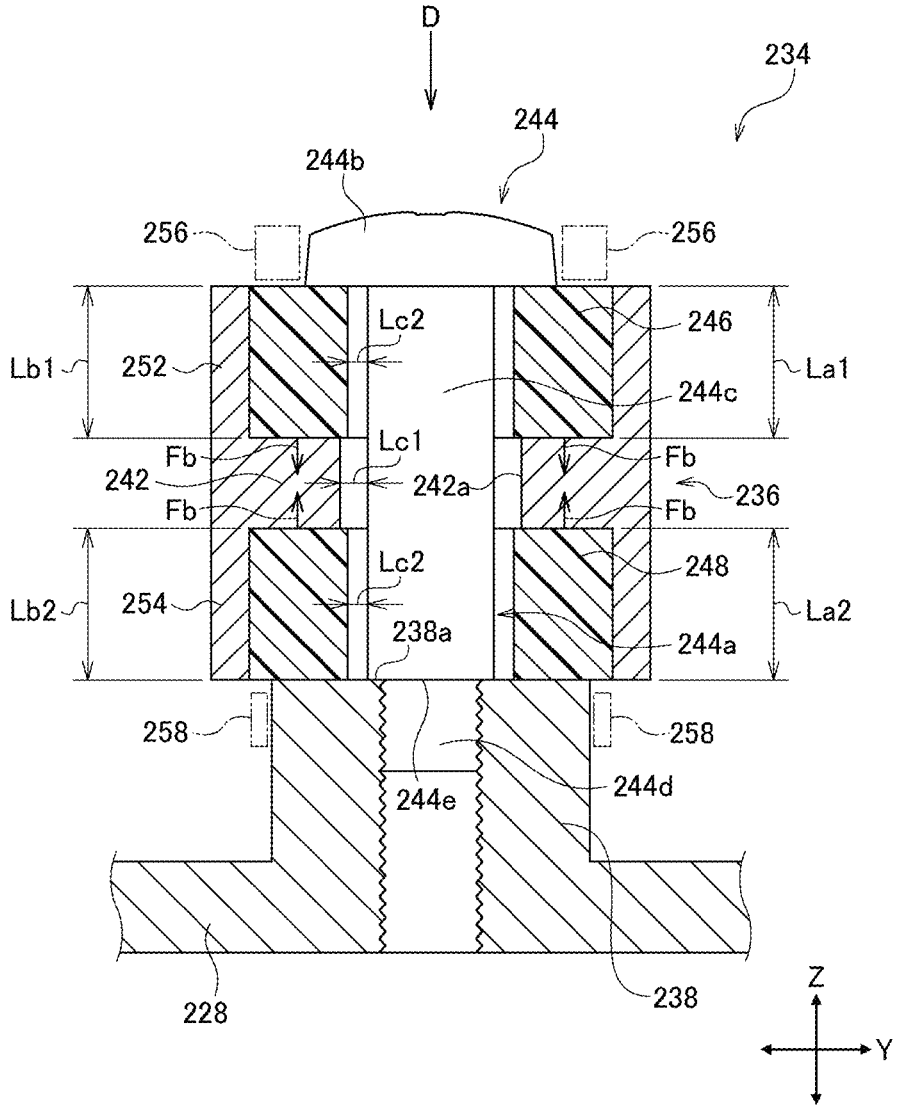
FIG. 32 is a sectional view taken along line C-C in FIG. 30 according to some embodiments.

FIG. 32 is a sectional view taken along line C-C in FIG. 30. The receiving part 238 is provided in the base part 228. More specifically, the receiving part 238 is provided such as to protrude from the base part 228 toward the second functional components 224 in the Z direction (upward in FIG. 32). At least three receiving parts 238 are provided in the base part 228.

The support member 236 includes multiple fixed parts 242 formed integrally with the multiple second functional components 224. Each fixed part 242 corresponds to a position where the support member 236 is fixed to a receiving part 238 to be relatively movable. Being "formed integrally" as used herein means that the relevant two elements are integrally movable, and whether or not the two elements are part of the same member is irrelevant. Although in some embodiments the fixed parts 242 are provided in the support member 236 provided separately from the second functional components 224, the fixed parts 242 may be provided in the second functional components 224.

Each fixed part 242 has a plate shape of which a depth direction is set to a Z direction. The fixed parts 242 are provided respectively for the receiving parts 238. When viewed from a Z direction, the fixed parts 242 in some embodiments are provided such as to protrude sideward from multiple side parts of the support member 236 (see FIG. 31).

Each pressing member 244 is connected to a corresponding receiving part 238 in the state of pressing the impact absorption members 246 and 248 and the fixed part 242, from the side opposite to the receiving part 238. Each pressing member 244 in some embodiments is a screw member. Each pressing member 244 includes the shaft part 244*a* that penetrates through a through hole 242*a* formed in a fixed part 242, and a head part 244*b* that presses the fixed part 242 from the side opposite to the receiving part 238. In some embodiments, a male thread part is formed in each shaft part 244*a*, and a female thread hole is formed in each receiving part 238. Each pressing member 244 in some embodiments is connected to a receiving part 238 to be not relatively movable, by screwing the male thread part of the shaft part 244*a* into the female thread hole of the receiving part 238. The head part 244*b* is provided at an end part of the shaft part 244*a* opposite to the fixed part 242. In the following, a radial direction of a circle with the central axis line of a shaft part 244*a* placed as the center may be simply referred to as a "radial direction".

Figure 33:
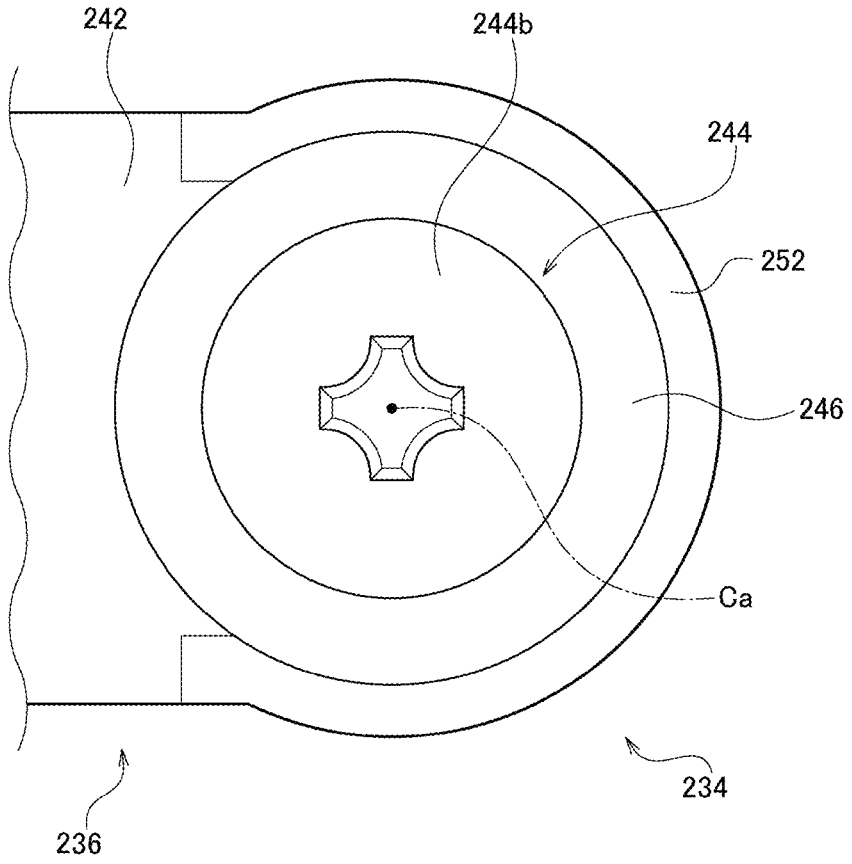
FIG. 33 is a diagram viewed from the direction of arrow D shown in FIG. 32 according to some embodiments.

FIG. 33 is a diagram viewed from the direction of arrow D shown in FIG. 32. As shown in FIGS. 32 and 33, the impact absorption members 246 and 248 include a first impact absorption member 246 provided between a pressing member 244 and a fixed part 242, and a second impact absorption member 248 provided between a fixed part 242 and a receiving part 238. Each of the impact absorption members 246 and 248 in some embodiments has a ring shape, more specifically a circular ring shape, surrounding a shaft part 244*a*. Also, each of the impact absorption members 246 and 248 in some embodiments is a rubber member made of silicone or the like, i.e., an elastic body.

Each pressing member 244 presses a fixed part 242 together with impact absorption members 246 and 248 toward a receiving part 238, so as to be connected to the receiving part 238 in a state where the impact absorption members 246 and 248 have undergone elastic compressive deformation. Accordingly, the fixed part 242 is provided to be relatively movable in the Z direction with respect to the receiving part 238, with the elastic deformation of the impact absorption members 246 and 248 in the Z direction. Therefore, by pressing the fixed part 242 together with the impact absorption members 246 and 248 toward the receiving part 238, the pressing member 244 fixes the fixed part 242 to be relatively movable in the Z direction with respect to the receiving part 238. It also can be considered that the supporting structure 234 allows the base part 228 to support the support member 236 formed integrally with the fixed parts 242 and the second functional components 224 to be relatively movable in the Z direction, with the elastic deformation of the impact absorption members 246 and 248 in the Z direction.

The height dimensions of the first impact absorption member 246 and the second impact absorption member 248 are set to similar sizes when they are not elastically deformed. The height dimension as used herein means a dimension along a Z direction of the relevant constituting element. When viewed from a Z direction (from the viewpoint of FIG. 33), the first impact absorption member 246 is provided such as to project radially outward from the head part 244*b* of the pressing member 244. Although not illustrated, when viewed from the Z direction, the second impact absorption member 248 is provided such as to project radially outward from the receiving part 238.

The shaft part 244*a* of each pressing member 244 includes a stopper part 244*e* of a step shape formed between a large diameter part 244*c* on the base end side and a small diameter part 244*d* on the tip side. In the small diameter part 244*d*, the male thread part is formed. The shaft part 244*a* is screwed into a receiving part 238 such that the stopper part 244*e* reaches a bearing surface 238*a* provided on a tip end surface of the receiving part 238. The stopper part 244*e* reaches the bearing surface 238*a* of the receiving part 238, thereby regulating a move of the shaft part 244*a* in a Z direction. When the stopper part 244*e* reaches the receiving part 238, the pressing member 244 is located at a move regulation position at which a move in a Z direction with respect to the receiving part 238 is regulated. Accordingly, differences in distance between the head part 244*b* and the receiving part 238 caused by construction errors can be reduced, so that the elastic deformation amounts of the impact absorption members 246 and 248 can be stably managed.

Each fixed part 242 includes a first surrounding wall 252 that projects in a Z direction from a top face of the fixed part 242, located on one side in the Z direction, and a second surrounding wall 254 that projects in the other Z direction from a reverse face of the fixed part 242, located on the other side in the Z direction. The first surrounding wall 252 surrounds the first impact absorption member 246 from the radially outer side. The second surrounding wall 254 surrounds the second impact absorption member 248 from the radially outer side. The surrounding walls 252 and 254 in some embodiments surround the impact absorption members 246 and 248, over a range of a half circumference or greater about a central axis line Ca (see FIG. 33) of the shaft part 244*a* of the pressing member 244. Part of the surrounding walls 252 and 254 are open toward the radially outer side.

A height dimension La1 of the first impact absorption member 246 in some embodiments is set to a size similar to a height dimension Lb1 of the first surrounding wall 252 when the pressing member 244 is placed at the move regulation position. A height dimension La2 of the second impact absorption member 248 in some embodiments is set to a size similar to a height dimension Lb2 of the second surrounding wall 254 when the pressing member 244 is placed at the move regulation position.

Between the shaft part 244*a* of the pressing member 244 and the through hole 242*a* of the fixed part 242, a clearance Lc1 is provided in a radial direction. The clearance Lc1 is a dimensional difference between the outer diameter of the shaft part 244*a* and the inner diameter of the through hole 242*a*. Accordingly, the fixed part 242 is provided to be relatively movable in the XY directions (radial direction) with respect to the base part 228.

The supporting structure 234 is configured such that, when a fixed part 242 relatively moves in an XY direction with respect to the base part 228, the shaft part 244*a* of the corresponding pressing member 244 and the surrounding walls 252 and 254 sandwich and hold the impact absorption members 246 and 248 before the shaft part 244*a* gets into contact with the through hole 242*a* of the fixed part 242. In order to achieve the configuration, as a first condition, the impact absorption members 246 and 248 are fitted inside the surrounding walls 252 and 254 and in contact with the surrounding walls 252 and 254 in the supporting structure 234 of some embodiments. Also, as a second condition, a clearance Lc2, provided in a radial direction between the shaft part 244*a* of the pressing member 244 and the impact absorption members 246 and 248, is set smaller than the clearance Lc1 provided in a radial direction between the shaft part 244*a* and the through hole 242*a* of the fixed part 242. The clearance Lc2 is a dimensional difference between the outer diameter of the shaft part 244*a* of the pressing member 244 and the inner diameter of the impact absorption members 246 and 248.

Accordingly, when the fixed part 242 relatively moves in an XY direction with respect to the base part 228, the impact absorption members 246 and 248 can be elastically deformed in an XY direction. It can be considered that the supporting structure 234 allows the base part 228 to support the support member 236 formed integrally with the fixed parts 242 and the second functional components 224 to be relatively movable in the XY directions, with the elastic deformation of the impact absorption members 246 and 248 in the XY directions.

Figure 34B:
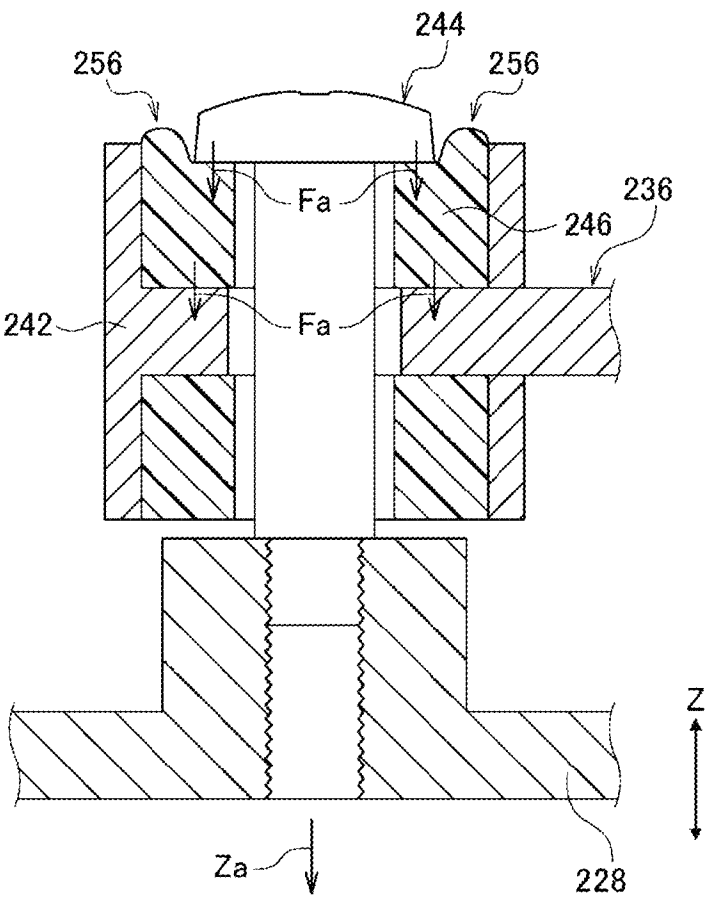
FIG. 34B is a diagram that shows an operation when an impact load is transmitted through the first load transmission route according to some embodiments.
Figure 34A:
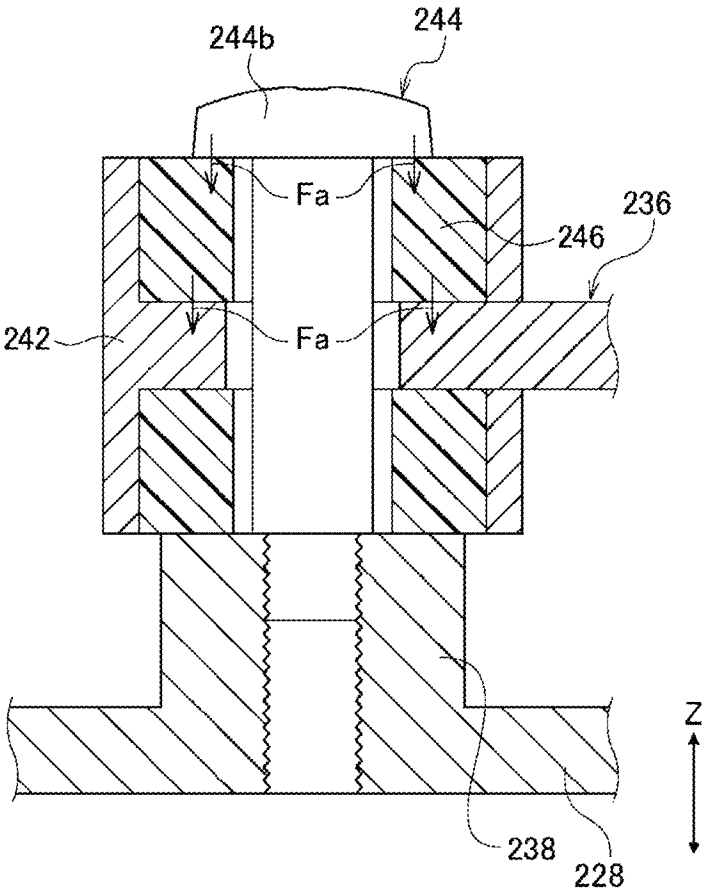
FIG. 34A is a diagram used to describe a first load transmission route according to some embodiments.

FIG. 34A is a diagram used to describe a first load transmission route in the supporting structure 234, and FIG. 34B is a diagram that shows an operation when an impact load is transmitted through the first load transmission route. In FIG. 34A, a direction in which a load is transmitted is indicated by an arrow Fa. The same applies to the following FIGS. 35A and 36A.

The supporting structure 234 includes load transmission routes through which a Z direction component of an impact load applied to the base part 228 can be transmitted from the base part 228 to the second functional components 224. The load transmission routes include a first load transmission route through which an impact load toward one Z direction (downward in FIG. 34) can be transmitted from the base part 228 to the second functional components 224. The first load transmission route in some embodiments is a route that passes through the receiving part 238 of the base part 228, the head part 244*b* of the pressing member 244, the first impact absorption member 246, the fixed part 242 of the support member 236, and the second functional components 224 in this order.

The first impact absorption member 246 is provided on the first load transmission route. The Z direction component of an impact load applied to the base part 228 is transmitted from the base part 228 to the second functional components 224 via the impact absorption member 246 on the first load transmission route. As shown in FIG. 34B, when a Z direction component of an impact load is to be transmitted through the first load transmission route, the first impact absorption member 246 deforms itself with a relative move of the base part 228 in a Z direction with respect to the second functional components 224 and the support member 236, so as to absorb the Z direction component.

Figure 35B:
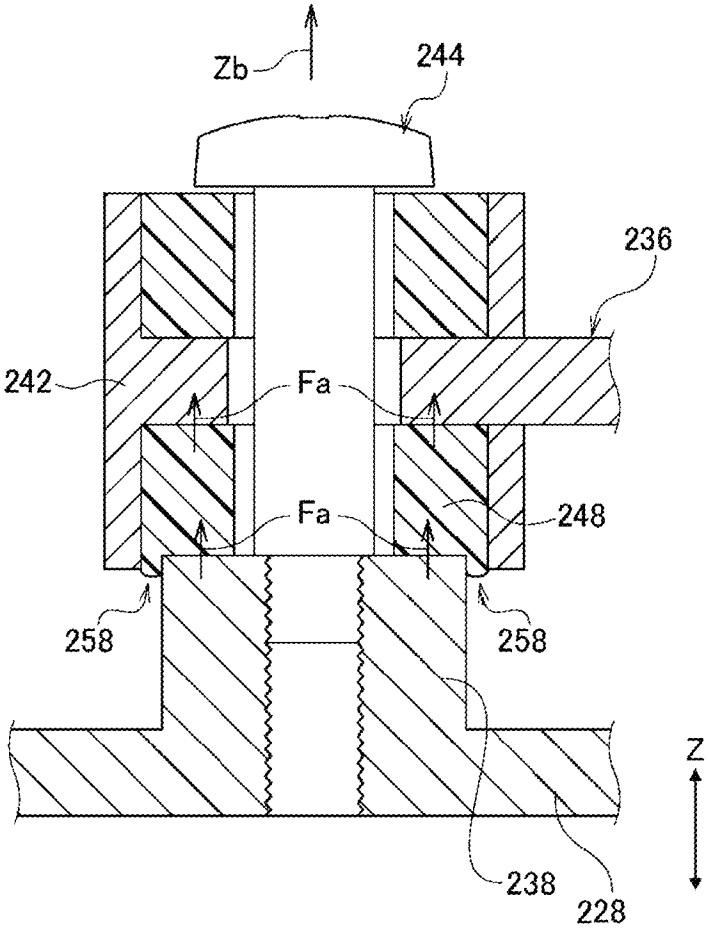
FIG. 35B is a diagram that shows an operation when an impact load is transmitted through the second load transmission route according to some embodiments.
Figure 35A:
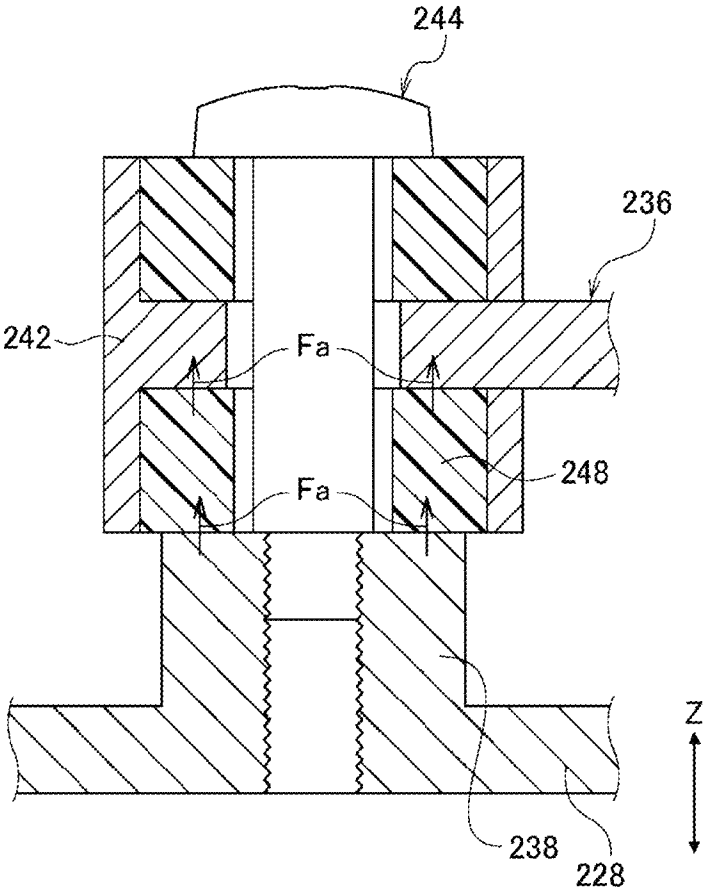
FIG. 35A is a diagram used to describe a second load transmission route according to some embodiments

FIG. 35A is a diagram used to describe a second load transmission route in the supporting structure 234, and FIG. 35B is a diagram that shows an operation when an impact load is transmitted through the second load transmission route. The load transmission routes include a second load transmission route through which an impact load toward the other Z direction (upward in FIG. 35) is to be transmitted.

The second load transmission route in some embodiments is a route that passes through the receiving part 238 of the base part 228, the second impact absorption member 248, the fixed part 242 of the support member 236, and the second functional components 224 in this order.

The second impact absorption member 248 is provided on the second load transmission route. The Z direction component of an impact load applied to the base part 228 is transmitted from the base part 228 to the second functional components 224 via the second impact absorption member 248 on the second load transmission route. As shown in FIG. 35B, when a Z direction component of an impact load is to be transmitted through the second load transmission route, the second impact absorption member 248 deforms itself with a relative move of the base part 228 in a Z direction with respect to the second functional components 224 and the support member 236, so as to absorb the Z direction component.

Figure 36:
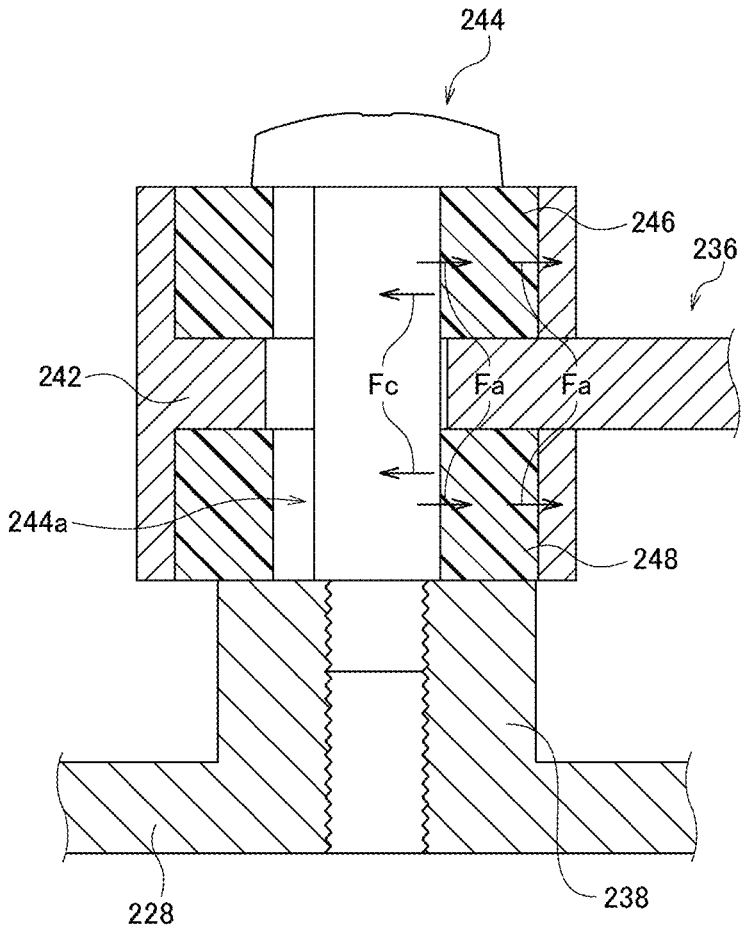
FIG. 36 is a diagram that shows an operation when an impact load is transmitted through a third load transmission route according to some embodiments.

FIG. 36 is a diagram that shows an operation when an impact load is transmitted through a third load transmission route in the supporting structure 234. The supporting structure 234 in some embodiments includes a third load transmission route through which an XY direction component of an impact load applied to the base part 228 can be transmitted from the base part 228 to the second functional components 224. The third load transmission route is a route that passes through the receiving part 238 of the base part 228, the shaft part 244*a* of the pressing member 244, the first impact absorption member 246 and the second impact absorption member 248, the first surrounding wall 252 and the second surrounding wall 254 of the fixed part 242 in the support member 236, and the second functional components 224 in this order.

The impact absorption members 246 and 248 are provided on the third load transmission route. The XY direction component of an impact load applied to the base part 228 is transmitted from the base part 228 to the second functional components 224 via the impact absorption members 246 and 248 on the third load transmission route. When an XY direction component of an impact load is to be transmitted through the load transmission route, the impact absorption members 246 and 248 deform themselves with a relative move of the base part 228 in an XY direction with respect to the second functional components 224 and the support member 236, so as to absorb the XY direction component.

It can be considered that the impact absorption members 246 and 248 as described above are provided to be deformable with a relative move of the base part 228 in a Z direction or an XY direction with respect to the second functional components 224 and the support member 236. With the deformation, the impact absorption members 246 and 248 can absorb an impact load transmitted from the base part 228 to the second functional components 224. The impact absorption members 246 and 248 in some embodiments can absorb an impact load by undergoing elastic compressive deformation.

There will now be described the operations and effects of the functional device 226 set forth above. It is assumed here that an impact load is applied to the base part 228. In some embodiments, accompanying the rotation of the toilet seat 218 in the functional device 226, an impact load is applied to the base part 228 of the toilet seat 218. The main component of the impact load is a component along a Z direction of the base part 228. When the impact load is applied to the base part 228, the base part 228 relatively moves with respect to the second functional components 224 and the support member 236, and, with the relative move, the impact absorption members 246 and 248 are deformed. As a result, the impact load transmitted from the base part 228 to the second functional components 224 can be reduced by the impact absorption members 246 and 248, so that the second functional components 224 can be protected.

To the base part 228, various impact loads, such as a torsion load, a bending load, and a shear load, are applied, which may cause deformation. In the toilet device 210 of some embodiments, before such an impact load is transmitted from the base part 228 to the second functional components 224, the impact load is transmitted to the support member 236 supporting the second functional components 224, so that the impact load can be partially borne by the support member 236. Accordingly, compared to the case where an impact load is transmitted directly from the base part 228 to the second functional components 224, the impact load transmitted from the base part 228 to the second functional components 224 can be reduced. Therefore, the second functional components 224 can be protected.

In this respect, with regard to the rigidity against a certain kind of load, the support member 236 may suitably have higher rigidity than a second functional component 224. The "certain kind of load" means at least one of a bending load, a torsion load, an axial load, and a shear load, for example. This means that, when a certain kind of load having the same magnitude is applied to each of the support member 236 and the second functional component 224, the degree of deformation of the support member 236 is smaller than that of the second functional component 224. Accordingly, the cross-sectional performance of the support member 236 and the elastic modulus of the material of the support member 236 is set such as to satisfy the condition. Therefore, the deformation of the support member 236 caused when a certain kind of load is transmitted from the base part 228 to the support member 236 can be restrained, so that the impact load transmitted to the second functional components 224 resulting from the deformation can be further reduced. Thus, the second functional components 224 can be further protected.

The impact absorption members 246 and 248 are provided to be deformable with a relative move of the base part 228 with respect to the support member 236. Accordingly, an impact load reduced by the impact absorption members 246 and 248 is transmitted from the base part 228 to the support member 236. Therefore, the deformation of the support member 236 caused by the impact load can be restrained, so that the impact load transmitted to the second functional components 224 resulting from the deformation can be reduced.

The support member 236 supports multiple second functional components 224. Accordingly, since a single support member 236 is used for the multiple second functional components 224, the number of necessary parts can be reduced. Also, since the impact absorption members 246 and 248 absorb the impact load, the multiple second functional components 224 can be protected.

The supporting structure 234 includes the pressing members 244 that each are connected to a receiving part 238 in the state of pressing the corresponding impact absorption members 246 and 248 and the corresponding fixed part 242 from the side opposite to the receiving part 238. Accordingly, the fixed parts 242 formed integrally with the second functional components 224 can be fixed to be relatively movable in the Z direction, and load components in the Z direction can be absorbed by the impact absorption members 246 and 248.

Since the impact absorption members 246 and 248 include the first impact absorption member 246 and the second impact absorption member 248, there are the following advantages. As shown in FIG. 34B, when an impact load in the pressing direction Za is applied to the base part 228, the first impact absorption member 246 between the pressing member 244 and the fixed part 242 is elastically deformed, so that the impact load is absorbed. Also, as shown in FIG. 35B, when an impact load in the anti-pressing direction Zb is applied to the base part 228, the second impact absorption member 248 between the fixed part 242 and the receiving part 238 is elastically deformed, so that the impact load is absorbed. Thus, impact loads in each Z direction can be absorbed by the impact absorption members 246 and 248, so that the second functional components 224 can be protected more effectively.

To each fixed part 242, elastic repulsion forces Fb, acting in direction opposite to each other, are applied respectively by the first impact absorption member 246 and the second impact absorption member 248, as shown in FIG. 32. The fixed part 242 remains at an initial position where the elastic repulsion forces Fb applied by the impact absorption members 246 and 248 are in balance with each other. When the fixed part 242 relatively moves in a Z direction with respect to the base part 228 because of an impact load transmitted from the base part 228 to the fixed part 242, the fixed part 242 vibrates in the Z direction until the fixed part 242 stops at the initial position because of the elastic repulsion forces Fb applied by the impact absorption members 246 and 248. There is also the advantage that the impact absorption members 246 and 248 elastically deformed while the fixed part 242 vibrates can absorb an impact load transmitted to the fixed part 242.

Each fixed part 242 includes the surrounding walls 252 and 254 surrounding the impact absorption members 246 and 248, and the surrounding walls 252 and 254 are provided to be relatively movable in radial direction with respect to the base part 228. Accordingly, when the fixed part 242 relatively moves in a radial direction with respect to the base part 228, the impact absorption members 246 and 248 between the shaft part 244*a* of the pressing member 244 and the surrounding walls 252 and 254 are elastically deformed. As a result, an impact load transmitted from the base part 228 to the fixed part 242 in an XY direction can be absorbed by the impact absorption members 246 and 248.

As shown in FIG. 36, when the impact absorption members 246 and 248 are elastically deformed in an XY direction, the fixed part 242 receives, from the impact absorption members 246 and 248, elastic repulsion forces Fc that act to return the fixed part 242 to the positions along an XY direction where the fixed part 242 have been located before the elastic deformation of the impact absorption members 246 and 248. Accordingly, also when the fixed part 242 relatively moves in an XY direction with respect to the base part 228, the elastic repulsion forces Fc applied by the impact absorption members 246 and 248 bring the fixed part 242 closer to the position where the fixed part 242 has been located before the relative move. As a result, this can prevent the occurrence of a large positional difference of each second functional component 224 between before and after an impact load is applied.

The base part 228 is provided in the toilet seat 218, which is movably attached to the toilet body 214. Even when impact loads are frequently applied to the base part 228 because of moves of the toilet seat 218, the second functional components 224 can be protected as described previously.

There will now be described other features of the functional device 226. FIG. 32 is now referred to. On the radially outer side with respect to the head part 244*b* of the pressing member 244, a first escape space 256 is provided to allow the first impact absorption member 246 to escape in a Z direction when the fixed part 242 relatively moves in a Z direction with respect to the base part 228. The first escape space 256 in some embodiments is provided at a position that overlaps a range over the entire circumference of the outer circumferential part of the first impact absorption member 246 when viewed from a Z direction.

On the radially outer side with respect to the receiving part 238, a second escape space 258 is provided to allow the second impact absorption member 248 to escape in a Z direction when the fixed part 242 relatively moves in a Z direction with respect to the base part 228. The second escape space 258 in some embodiments is provided at a position that overlaps a range over the entire circumference of the outer circumferential part of the second impact absorption member 248 when viewed from a Z direction.

When the fixed part 242 relatively moves with respect to the base part 228, the impact absorption members 246 and 248 between the pressing member 244 and the fixed part 242 and between the receiving part 238 and the fixed part 242 are compressively deformed. At the time, the impact absorption members 246 and 248 are to be compressively deformed in an XY direction, but, during the process, the surrounding walls 252 and 254 constrain the deformation of the impact absorption members 246 and 248. Meanwhile, in some embodiments, even in such a situation where the surrounding walls 252 and 254 constrain the deformation of the impact absorption members 246 and 248, the impact absorption members 246 and 248 can be elastically deformed such as to escape to the escape spaces 256 and 58, as shown in FIGS. 34B and 35B. As a result, the amount of elastic deformation of the impact absorption members 246 and 248 is increased, so that the impact load absorption capability of the impact absorption members 246 and 248 can be improved.

The second impact absorption member 248, located between the fixed part 242 and the receiving part 238, supports the fixed part 242. The pressing member 244 is connected to the receiving part 238 in a state where the second impact absorption member 248 is compressively deformed. Accordingly, the second impact absorption member 248, supporting the fixed part 242, is compressively deformed and can be hardened thereby. Therefore, the second impact absorption member 248 can stably support the fixed part 242 while reducing unstableness of the second functional components 224.

The disclosure has been described based on some embodiments. In the following, modifications of individual constituting elements will be described.

In the example described above, the base member 222 of the functional device 226 is a toilet seat. However, the specific example of the base member 222 is not particularly limited, as long as it can be used for the toilet device 210. For example, the base member 222 may be the casing 216, or may be the toilet lid 220 as a movable member rotatably attached to the toilet body 214. The movable member has only to be movably attached to the toilet body 214, and the movement thereof is not particularly limited. Also, although the toilet seat 218 or the toilet lid 220 is rotatably attached to the toilet body 214 via the casing 216 in the example described above, the toilet seat 218 or the toilet lid 220 may be rotatably attached directly to the toilet body 214.

In the example described above, the supporting structure 234 allows the base part 228 to support multiple second functional components 224. However, the base part 228 may support a single functional component. The support member 236 of the supporting structure 234 may support only a single functional component, instead of multiple functional components.

In the example described above, the supporting structure 234 allows the base part 228 to support the second functional components 224 via the support member 236. However, the supporting structure 234 may allow the base part 228 to support the functional components without the intervention of the support member 236. In this case, the fixed parts 242 of the supporting structure 234 are provided in the functional components, instead of in the support member 236. In any case, the fixed parts 242 of the supporting structure 234 have only to be formed integrally with the functional components.

In the example described above, the impact absorption members 246 and 248 as elastic bodies are provided to be able to undergo elastic compressive deformation with a relative move of the base part 228 with respect to the second functional components 224. However, the impact absorption members 246 and 248 may be provided to be able to undergo elastic tensile deformation. The elastic bodies as used herein include spring members, for example, besides rubber members. Also, besides the elastic bodies capable of absorbing impact loads by elastic deformation, the impact absorption members 246 and 248 may be viscous bodies capable of absorbing impact loads by viscous flowage. In any case, the impact absorption members 246 and 248 have only to be provided to be deformable, irrespective of whether or not elastic deformation is involved, with a relative move of the base part 228 with respect to the functional components, and to be capable of absorbing impact loads by their deformation.

The impact absorption members 246 and 248 have only to be provided to be deformable with a relative move of the base part 228 with respect to the second functional components 224, and the specific arrangement thereof is not particularly limited. For example, the impact absorption members 246 and 248 are provided between the pressing member 244 and the receiving part 238 in the example described above. Alternatively, the impact absorption members 246 and 248 may be provided at positions different from those between the pressing member 244 and the receiving part 238, and may be provided between the support member 236 and the base part 228 to be deformable with a relative move therebetween, for example.

In the example described above, the fixed parts 242 of the supporting structure 234 are provided to be relatively movable in both the XY directions and the Z direction with respect to the base part 228. However, the fixed parts 242 may be provided to be relatively movable only in either the XY directions or the Z direction and to be not relatively movable in the other direction. For example, the fixed parts 242 may be provided to be relatively movable only in the Z direction and to be not relatively movable in the XY directions, with respect to the base part 228.

Although each pressing member 244 is connected to a base receiving part 238 by means of a screw structure in the example described above, the connection means is not particularly limited. For example, a snap fit structure may also be used.

Although the impact absorption members 246 and 248 include the first impact absorption member 246 and the second impact absorption member 248 in the example described above, the impact absorption members may include only one of them.

The first escape space 256 and the second escape space 258 need not necessarily be provided, or only one of them may be provided.

Figure 37:
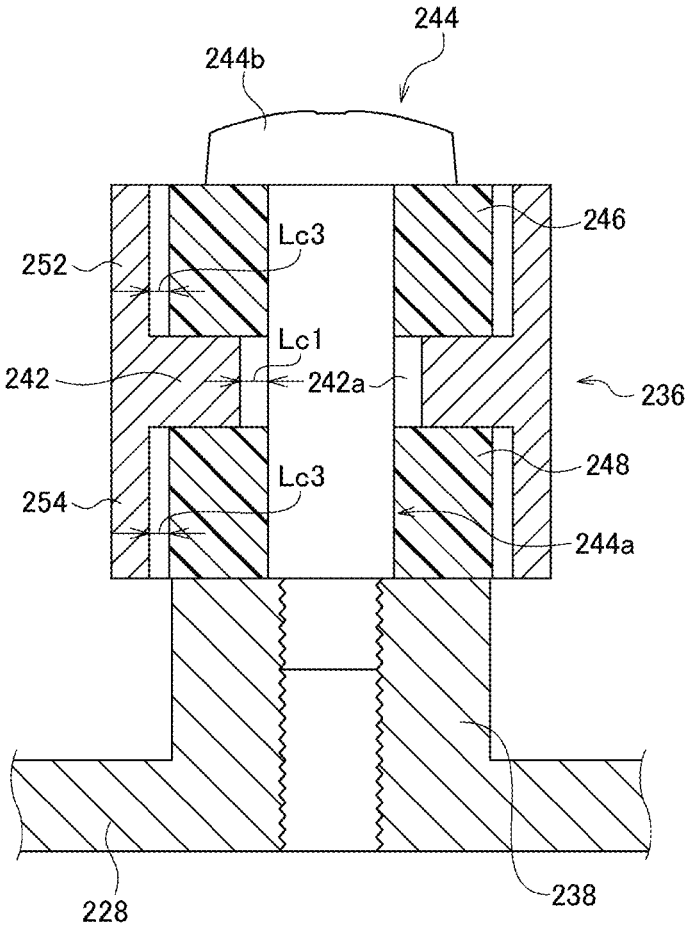
FIG. 37 shows a support structure, viewed from the same viewpoint as in FIG. 32 according to some embodiments.

To achieve the described above, the supporting structure 234 may be configured to satisfy the following first condition and second condition, for example. FIG. 37 shows the supporting structure 234 of some embodiments, viewed from the same viewpoint as in FIG. 32. The first condition is that the shaft part 244*a* of each pressing member 244 is fitted inside the impact absorption members 246 and 248 and in contact with the impact absorption members 246 and 248. The second condition is that a clearance Lc3, provided in a radial direction between the surrounding walls 252 and 254 and the impact absorption members 246 and 248, is set smaller than the clearance Lc1 provided in a radial direction between the shaft part 244*a* of the pressing member 244 and the through hole 242*a* of the fixed part 242. Also, although not illustrated, the total value of the clearance Lc2 in FIG. 32 and the clearance Lc3 in FIG. 37 may be set smaller than the clearance Lc1.

When the disclosure embodied by some embodiments and modifications set forth above are generalized, the following technical ideas are derived.

With regard to the functional device of some embodiments, the supporting structure may include a support member that is supported by the base part such as to be relatively movable and that supports the functional component. In this aspect, an impact load, which may cause deformation, applied to the base part is transmitted to the support member earlier than to the functional component, so that the impact load can be partially borne by the support member. Accordingly, compared to the case where an impact load is transmitted directly from the base part to the functional component, the impact load transmitted from the base part to the functional component can be reduced, so that the functional component can be protected.

With regard to the functional device of some embodiments, the support member may be supported by the base part such as to be relatively movable, and the impact absorption member may be provided to be deformable with a relative move of the base part with respect to the support member. In this aspect, an impact load reduced by the impact absorption member is transmitted from the base part to the support member. Therefore, the deformation of the support member caused by the impact load can be restrained, so that the impact load transmitted to the functional component resulting from the deformation can be reduced.

With regard to the functional device of some embodiments, the functional device may include a plurality of the functional components, and the support member may support the plurality of the functional components. In this aspect, since a single support member is used for multiple functional components, the number of necessary parts can be reduced. Also, since the impact absorption member absorbs an impact load, the multiple functional components can be protected.

With regard to the functional device of some embodiments, the supporting structure may further include a receiving part provided in the base part, a fixed part formed integrally with the functional component, and a pressing member connected to the receiving part in a state of pressing the fixed part from the side opposite to the receiving part. Also, the impact absorption member may be an elastic body provided at one of or both of a position between the pressing member and the fixed part, and a position between the fixed part and the receiving part. In this aspect, the fixed part formed integrally with the functional component can be fixed to be relatively movable in first direction along a pressing direction in which the pressing member presses, and load components in the first direction can be absorbed by the impact absorption member.

With regard to the functional device of some embodiments, the impact absorption member may include a first impact absorption member provided between the pressing member and the fixed part, and a second impact absorption member provided between the fixed part and the receiving part. In this aspect, impact loads in each first direction can be absorbed by the impact absorption member, so that the functional component can be protected more effectively.

With regard to the functional device of some embodiments, the pressing member may include a shaft part connected to the receiving part, and the impact absorption member may surround the shaft part from the outer side in a radial direction of the shaft part. Also, the fixed part may include a surrounding wall that surrounds the impact absorption member from the outer side in the radial direction, and the surrounding wall may be provided to be relatively movable in the radial direction with respect to the base part. In this aspect, when the fixed part relatively moves in a radial direction with respect to the base part, the impact absorption member between the shaft part of the pressing member and the surrounding wall is elastically deformed. As a result, an impact load transmitted from the base part to the fixed part in a second direction perpendicular to the first direction can be absorbed by the impact absorption member.

With regard to the functional device of some embodiments, the pressing member may include a head part provided at an end part of the shaft part opposite to the receiving part, and, on the outer side in the radial direction with respect to one of the receiving part and the head part, an escape space may be provided to allow the impact absorption member to escape when the base part relatively moves in an axial direction of the shaft part with respect to the fixed part. In this aspect, when the fixed part relatively moves in an axial direction with respect to the base part, even in a situation where the surrounding wall constrains the deformation of the impact absorption member, the impact absorption member can be elastically deformed such as to escape to the escape space. As a result, the amount of elastic deformation of the impact absorption member is increased, so that the impact load absorption capability of the impact absorption member can be improved.

In some embodiments, the base part may be provided in a movable member that is movably attached to a toilet body. In this aspect, even when impact loads are frequently applied to the base part because of moves of the movable member, the functional component can be protected as described previously.

Some embodiments and modifications of the disclosure have been described. Optional combinations of the above-mentioned constituting elements may also be employed as additional aspects of the present invention. For example, with some embodiments or the modification of the disclosure, an arbitrary matter described in some embodiments or a modification of the disclosure and the disclosure may be combined. Similarly, with some embodiments or a modification of the disclosure or the disclosure, an arbitrary matter described in some embodiments or a modification of the disclosure among the disclosures may be combined.

An example of such combinations will be described. For example, with the toilet seat device 100 in some embodiments, a feature regarding the shutter 138 or the like of the toilet seat unit 116 (toilet seat device) in some embodiments may be combined, or a feature regarding the functional device 226 in some embodiments may be combined.

The present disclosure relates to a toilet seat device.

The invention claimed is:

1. A toilet seat device comprising:

a toilet seat;

a casing provided in rear of the toilet seat;

a functional component that ejects liquid or that blows out or suctions gas; and a functional device comprising a base part and a support structure that allows the functional component to move relative to the base part, wherein the support structure comprises an impact absorption member provided to be deformable with a relative movement of the base part with respect to the functional component, a receiving part provided in the base part, a fixed part formed integrally with the functional component, and a pressing member connected to the receiving part in a state of pressing the fixed part from a side opposite to the receiving part, wherein the functional component is spaced away from the base part of the functional device and at least a first part of the functional component is provided in the toilet seat and a second part of the functional component is provided in the casing, and wherein the impact absorption member is an elastic body provided at one of or both of a position between the pressing member and the fixed part, and a position between the fixed part and the receiving part.

2. The toilet seat device of claim 1, wherein the functional component is one selected from a group consisting of a private part cleaning device that cleans a private part of a sitting person, a blower device that provides warm air into a toilet bowl, and a deodorizing device that deodorizes an inner portion of the toilet bowl.

3. The toilet seat device of claim 2, wherein the private part cleaning device comprises a nozzle through which water is ejected and a drive mechanism that makes the nozzle to move forward and backward, wherein the nozzle and the drive mechanism are provided in the toilet seat.

4. The toilet seat device of claim 2, wherein a flow pipe, through which gas blows out or is suctioned, is provided in the toilet seat.

5. A toilet device, comprising:

the toilet seat device of claim 1; and a toilet body.

6. The toilet seat device of claim 1, wherein the toilet seat is attached to a toilet body and has an opening-and-closing port formed on a reverse face, the toilet seat device further comprises a shutter attached to the toilet seat to enable opening and closing of the opening-and-closing port, and, when the toilet seat is placed at a laid position at which the toilet seat is laid over the toilet body and when the toilet seat is viewed from a front side, a large part of an entire range in a front-and-rear direction of the shutter, from a front end toward a rear end of the shutter, is located in rear of an inner circumferential surface of a center opening part of the toilet seat and at a position that overlaps the inner circumferential surface.

7. The toilet seat device of claim 6, wherein the shutter comprises a first flat surface that constitutes a large part of an outer surface of the shutter.

8. The toilet seat device of claim 7, wherein the toilet seat comprises a second flat surface that constitutes the reverse face of the toilet seat and that has the opening-and-closing port formed thereon, and the first flat surface is provided to be flush with the second flat surface when the shutter is placed at a closed position at which the opening-and-closing port is closed.

9. The toilet seat device of claim 8, wherein a surface area that includes the outer surface of the shutter and the second flat surface is provided to form a continuous ring shape around the center opening part of the toilet seat.

10. The toilet seat device of claim 6, wherein the shutter is provided at a position hidden by the inner circumferential surface of the center opening part of the toilet seat when the toilet seat placed at the laid position is viewed from the front side.

11. The toilet seat device of claim 6, further comprising a deodorizing device accommodated in the toilet seat, wherein, when the shutter is placed at an open position at which the opening-and-closing port is open, the deodorizing device removes odors from air that has passed through the opening-and-closing port.

12. A toilet device, comprising:

a toilet body; and the toilet seat device of claim 6, attached to the toilet body.

13. The toilet seat device of claim 1, wherein the support structure comprises a support member that is supported by the base part and that supports the functional component.

14. The toilet seat device of claim 13, wherein the support member is supported by the base part to be movable, and the impact absorption member is provided to be deformable with a relative movement of the base part with respect to the support member.

15. The toilet seat device of claim 13, wherein the toilet seat device comprises a plurality of the functional components, and the support member supports the plurality of the functional components.

16. The toilet seat device of claim 1, wherein the impact absorption member includes a first impact absorption member provided between the pressing member and the fixed part, and a second impact absorption member provided between the fixed part and the receiving part.

17. The toilet seat device of claim 1, wherein the pressing member comprises a shaft part connected to the receiving part, the impact absorption member surrounds the shaft part from an outer side in a radial direction of the shaft part, and the fixed part comprises a surrounding wall that surrounds the impact absorption member from the outer side in the radial direction, and the surrounding wall is provided to be relatively movable in the radial direction with respect to the base part.

18. The toilet seat device of claim 17, wherein the pressing member comprises a head part provided at an end part of the shaft part opposite to the receiving part, and, on the outer side in the radial direction with respect to one of the receiving part and the head part, an escape space is provided to allow the impact absorption member to escape when the base part relatively moves in an axial direction of the shaft part with respect to the fixed part.

19. The toilet seat device of claim 1, wherein the base part is provided in a movable member that is movably attached to a toilet body.

20. A toilet device comprising the toilet seat device of claim 1.

* * * * *